US008890903B2

(12) United States Patent
Russell et al.

(10) Patent No.: US 8,890,903 B2
(45) Date of Patent: Nov. 18, 2014

(54) SPATIAL LIGHT MODULATOR WITH STORAGE REDUCER

(75) Inventors: Andrew Ian Russell, Plano, TX (US); Karl Marion Guttag, Plano, TX (US); Joshua Abraham Lund, Dallas, TX (US); Craig Michael Waller, Dallas, TX (US); James E. Howard, Frisco, TX (US)

(73) Assignee: Syndiant, Inc., Dallas, TX (US)

( * ) Notice: Subject to any disclaimer, the term of this patent is extended or adjusted under 35 U.S.C. 154(b) by 0 days.

(21) Appl. No.: 13/330,994

(22) Filed: Dec. 20, 2011

(65) Prior Publication Data

US 2012/0154370 A1 Jun. 21, 2012

Related U.S. Application Data

(60) Provisional application No. 61/425,428, filed on Dec. 21, 2010.

(51) Int. Cl.
*G09G 5/10* (2006.01)
*G09G 3/34* (2006.01)

(52) U.S. Cl.
CPC ..... *G09G 3/346* (2013.01); *G09G 2340/02* (2013.01); *G09G 2300/0456* (2013.01); *G09G 2320/0266* (2013.01); *G09G 2354/00* (2013.01)
USPC ..... 345/690; 348/450; 382/232; 382/166

(58) Field of Classification Search
CPC ..... H04N 19/00818; H04N 19/00315; H04N 19/00763; H04N 19/009; H04N 19/00006; H04N 19/00121; H04N 19/00775; H04N 19/00836; G06T 9/005; G06T 3/4084; G06T 5/004
USPC ..... 348/14.13, 450; 382/232–253, 166
See application file for complete search history.

(56) References Cited

U.S. PATENT DOCUMENTS

| | | | | |
|---|---|---|---|---|
| 5,247,589 | A * | 9/1993 | Faul et al. | 382/166 |
| 5,341,442 | A * | 8/1994 | Barrett | 382/166 |
| 5,787,192 | A * | 7/1998 | Takaichi et al. | 382/166 |
| 5,940,117 | A | 8/1999 | Hassan et al. | |
| 6,125,201 | A * | 9/2000 | Zador | 382/166 |
| 6,650,773 | B1 * | 11/2003 | Maurer et al. | 382/166 |
| 6,865,291 | B1 * | 3/2005 | Zador | 382/166 |
| 7,050,642 | B2 * | 5/2006 | Graffagnino | 382/240 |
| 7,071,908 | B2 | 7/2006 | Guttag et al. | |
| 7,113,195 | B2 | 9/2006 | Willis et al. | |
| 7,283,105 | B2 | 10/2007 | Dallas et al. | |
| 7,317,464 | B2 | 1/2008 | Willis | |
| 7,602,975 | B2 * | 10/2009 | Chiang et al. | 382/232 |
| 2004/0150655 | A1 * | 8/2004 | Pau et al. | 345/604 |
| 2004/0155980 | A1 * | 8/2004 | Itoh et al. | 348/450 |
| 2004/0179155 | A1 | 9/2004 | Huang et al. | |

(Continued)

OTHER PUBLICATIONS

PCT International Search Report and Written Opinion received in PCT/US2011/066038.

(Continued)

*Primary Examiner* — Gregory J Tryder

(74) *Attorney, Agent, or Firm* — Alchemy-Partners, PC

(57) ABSTRACT

Described are devices and methods for reducing the need for storage on a display panel, for reducing the required bandwidth to a display panel, for increasing the light-on time for a display panel.

17 Claims, 34 Drawing Sheets

(56) References Cited

U.S. PATENT DOCUMENTS

| | | | | |
|---|---|---|---|---|
| 2004/0218825 | A1* | 11/2004 | Graffagnino | 382/240 |
| 2006/0034524 | A1* | 2/2006 | Kitamura | 382/232 |
| 2006/0077470 | A1* | 4/2006 | Saquib | 358/3.28 |
| 2006/0268981 | A1* | 11/2006 | Owens | 375/240.03 |
| 2009/0096710 | A1 | 4/2009 | Raman et al. | |
| 2011/0150501 | A1 | 6/2011 | Guttag et al. | |

OTHER PUBLICATIONS

International Preliminary Report on Patentability and Written Opinion issued in corresponding International Application No. PCT/US2011/066038 issued on Jun. 25, 2013 (10 pages).

* cited by examiner

Calculate Base

SPATIAL LIGHT MODULATOR WITH STORAGE REDUCER

CROSS-REFERENCE TO RELATED APPLICATIONS

This application makes reference to priority to U.S. Provisional Patent Application No. 61/425,428 to Guttag et al., entitled "Spatial Light Modulator with Storage Reducer," filed Dec. 21, 2010, which is incorporated herein by reference in its entirety.

BACKGROUND

1. Field of the Invention

The present invention relates to digital backplanes and various methods, systems and devices for controlling a digital backplane, light modulating elements and spatial light modulators.

2. Related Art

Increasing the resolution of a display typically requires a larger memory and more expensive processing and a larger amount of data to be transmitted from the controller to a spatial light modulator of the display. This may result in greater cost and/or greater power consumption, rendering the display useless for certain applications. Using a lower resolution display in order to keep the cost and power consumption low, is also undesirable because the lower resolution may not support the information which the viewer wishes to see.

SUMMARY

According to a first broad aspect of the present invention, there is provided a device comprising a compression engine for compressing a target image into a base image and a sharpener image.

According to a second broad aspect of the current invention, there is provided a device comprising a storage medium having stored therein a base image and a sharpener image for a target image.

According to a third broad aspect of the current invention, there is provided a device comprising a reconstructor for producing a reconstructed image based on a base image and a sharpener image.

According to a fourth broad aspect of the current invention, there is provided a method comprising the following steps: (a) converting a target image into a base image and a sharpener image, and (b) storing the base image and sharpener image on a storage medium.

According to a fifth broad aspect of the current invention, there is provided a method comprising the following steps: (a) generating a reconstructed image based on a base image and a sharpener image, and (b) displaying the reconstructed image on a visual display device, saving the reconstructed image to a storage medium and/or transmitting the reconstructed image to a computer.

According to a sixth broad aspect of the current invention, there is provided a spatial light modulator comprising: a pixel array, and a plurality of processing elements, wherein a pixel drive for each respective multi-primary color of each pixel of the pixel array is determined by one or more processing elements of the plurality of processing elements based on one or more multi-primary base values and one or more sharpener values.

According to a seventh broad aspect of the current invention, there is provided a device comprising: storage for color pixel data for a group of pixels, and a color-weighted averager for determining the color-weighted average of the color pixel data for the group of pixels, wherein each pixel in the group of pixels comprises one or more multi-primary color components.

According to an eighth broad aspect of the current invention, there is provided a device comprising a spatial light modulator comprising: a plurality of parallel processing elements for computing a respective drive for each respective pixel of a plurality of pixels, wherein the parallel processing elements compute the respective drive for each pixel based on compressed image data, and wherein the parallel processing elements are multiplier-free processing elements.

According to a ninth broad aspect of the current invention, there is provided a device comprising: an image compressor for compressing a target image, wherein the image compressor comprises: a low-pass filter and/or decimator for computing a lower resolution image based on the target image, an arithmetic module for computing a difference image based on the difference between the target image and the lower resolution image, and a bit-depth reducer for computing a bit-reduced image based on the difference image.

According to a tenth broad aspect of the current invention, there is provided a spatial light modulator comprising: a single-multi-primary storage, a non-single-multi-primary storage, and a reconstructor for displaying an image based on data in both the single-multi-primary storage and the non-single-multi-primary storage.

According to a eleventh broad aspect of the current invention, there is provided a device comprising a spatial light modulator (SLM) comprising: a pixel array, a SLM-partitioner for partitioning the pixel array into groups of pixels, and a boundary shifter for altering the partitioning of the groups between frames and/or fields displayed on a display device.

According to a twelfth broad aspect of the current invention, there is provided a device comprising a spatial light modulator comprising: a plurality of comparators, a mirror RAM (MRRAM) array comprising columns, and a plurality of switching elements for connecting the comparators to the MRRAM array, wherein the plurality of switching elements select which comparators connects to a column of the MRRAM array, and wherein the switching elements are block-boundary-shifting elements.

According to a thirteenth broad aspect of the current invention, there is provided a device comprising: a dummy cycle driving unit, and a mirror RAM (MRRAM) array with word line drivers of a spatial light modulator (SLM), wherein when the dummy cycle driving unit is activated, the dummy cycle driving unit drives a series of dummy cycles to control the MRRAM array to heat the SLM.

According to a fourteenth broad aspect of the current invention, there is provided a device comprising a bit-plane storage unit comprising: a plurality of circular buffers for storing image bit-plane data, wherein at least some of the respective bit planes of the bit-plane image data are stored in a respective circular buffer of the bit-plane storage unit.

According to a fifteenth broad aspect of the current invention, there is provided a device comprising a reconstructor for producing a reconstructed image from a base image and a sharpener image, wherein at least one bit position of the base image is a color-locking indicator.

According to a sixteenth broad aspect of the current invention, there is provided a device comprising an artifact detection module for controlling filtering or modification of a target image and/or a base-plus-sharpener converting process due to detecting a color combination and/or image content that would cause an undesirable artifact, wherein the device provides base-plus-sharpener compression.

According to a seventeenth broad aspect of the current invention, there is provided a device comprising adder-free processing elements for generating image using an implied addition.

According to a eighteenth broad aspect of the current invention, there is provided a device comprising a spatial light modulator comprising one or more members of the group consisting of: a masking-multi-operational-splitting comparator, an arithmetic splitting comparator, a masking arithmetic comparator and a masking loader.

BRIEF DESCRIPTION OF THE DRAWINGS

The accompanying drawings, which are incorporated herein and constitute part of this specification, illustrate exemplary embodiments of the invention and, together with the general description given above and the detailed description given below, serve to explain the features of the invention.

Figure 1:
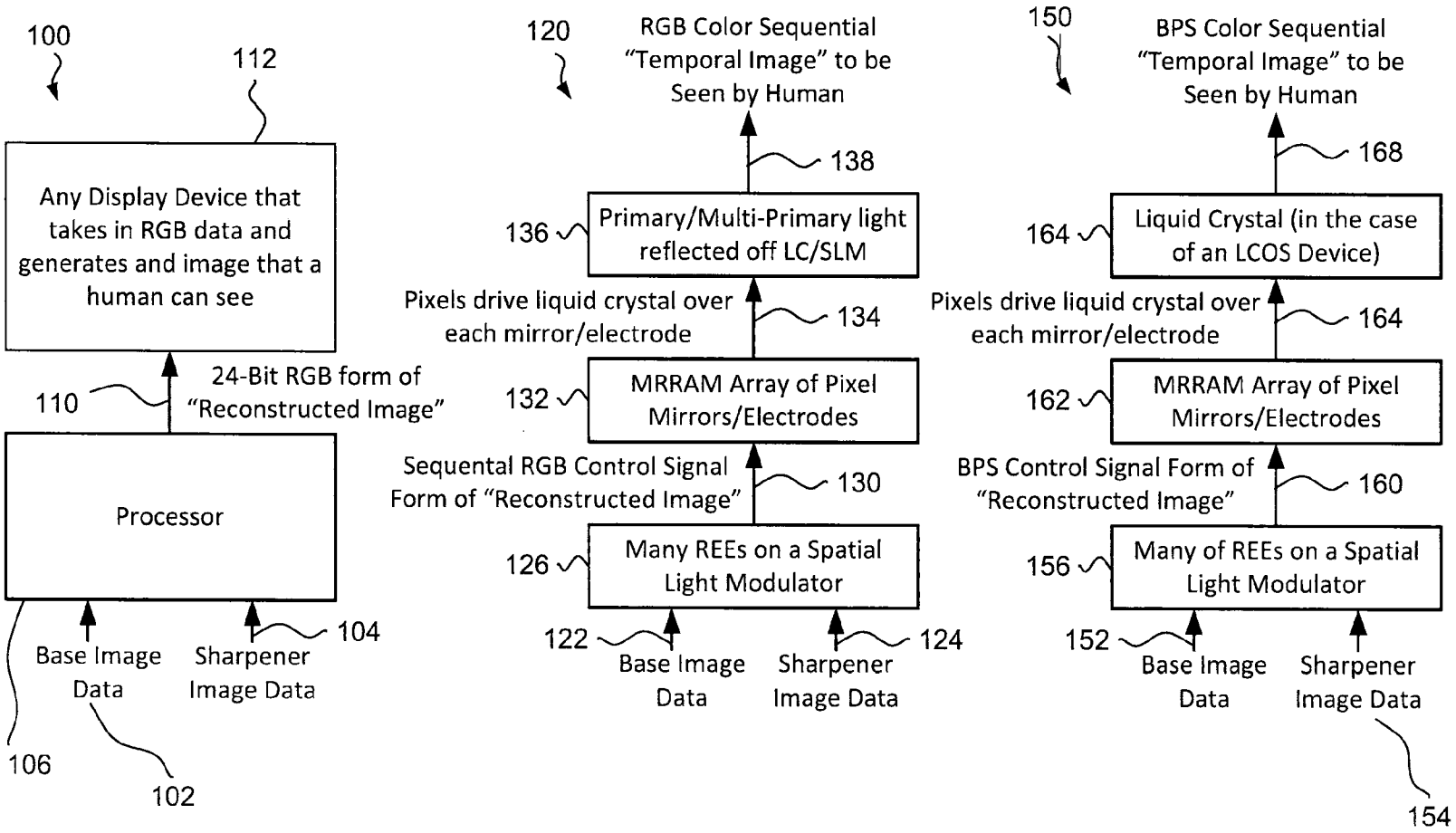
FIG. 1 shows flow charts diagramming several base-plus-sharpener reconstruction processes.

In the drawings nothing is meant to infer the size or scale of the various features, such as data blocks, relative to each other. Also, it should be noted that in some cases, various systems, processes, circuits, apparatuses, etc. have been shown in simplified form in the drawings to more clearly show particular features in the drawings.

DETAILED DESCRIPTION

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For purposes of the present invention, it should be noted that the singular forms, "a," "an," and "the" include reference to the plural unless the context as herein presented clearly indicates otherwise.

For purposes of the present invention, directional terms such as "top," "bottom," "upper," "lower," "above," "below," "left," "right," "horizontal," "vertical," "up," "down," etc. are merely used for convenience in describing the various embodiments of the present invention. The embodiments of the present invention may be oriented in various ways. For example, the diagrams, apparatuses, etc. shown in the drawing figures may be flipped over, rotated by 90° in any direction, reversed, etc.

For purposes of the present invention, a value or property is "based" on a particular value, property, the satisfaction of a condition, or other factor, if that value is derived by performing a mathematical calculation or logical decision using that value, property or other factor.

For purposes of the present invention, the term "adder-free processing elements" refers to arithmetic units which contain no adders.

For purposes of the present invention, the term "array" refers to a one dimension or two dimensional set of elements where each element has one or more bits of data. The array elements or even the bits within elements may or may not be stored physically next to each other. While a 2 dimensional array may imply some physical relationship in a 2 dimensional image or the like, it does not imply that the elements/bits are stored in a 2 dimensional array or if they are stored in a 2 dimensional array that it has the same dimensions.

For purposes of the present invention, the term "artifact detection module" refers to hardware and/or software for analyzing an image or a portion of an image to detect the presence of certain visually undesirable features or attributes that are present.

For purposes of the present invention, the term "available memory" refers to memory on a device that is not currently needed by some other process performed by the device.

For purposes of the present invention, the term "backplane" refers to a substrate that is used to build logic and control functions for a SLM. A backplane may be made of a semiconductor material, such as silicon, GaAs, etc. and it would include transistors that are deposited or grown on an insulating substrate such as glass.

For purposes of the present invention, the term "base image" or "color base image" is an image produced when compressing a target image, and/or used for producing a reconstructed image wherein said "base image" has the same multi-primary color components as a target image and/or reconstructed image, but having lower resolution than the target image and/or reconstructed image. The base image is typically determined in combination with a sharpener image such that a reconstructed image based on the base image and the sharpener image is close to a given target image.

For purposes of the present invention, the term "base value" or "color base value" or "base" is one value from a base image. Each base value is used to determine only one single multi-primary color of one or more pixels of a reconstructed image. For example, in at least one embodiment of the invention there is a base value for each multi-primary color for each 2 by 2 block of pixels in the reconstructed image.

For purposes of the present invention, the term "base-plus-sharpener representation" or "BPS representation" refers to data used to represent an image, wherein some of the values are color base values and some of the values are sharpener values.

For purposes of the present invention, the term "bit-depth reducer" refers to a device that takes as its input an image having an associated resolution and number of bits-per pixel, and produces an image as its output which has the same resolution as the input image but has fewer total bits per pixel than the input image.

For purposes of the present invention, the term "bit line" refers to data that is associated with a line (vertical or horizontal), but contains only 1 bit of data (1 or 0) for each pixel on said line. The combination of multiple bit lines of data may be used to control the output of each pixel.

For purposes of the present invention, the term "bit-plane buffer" refers to storing all or part of a bit plane in a physical memory location. A bit-plane buffer, may or may not store the bit plane in the same array order as it is seen in a visual display. In some embodiments of the present invention, the ERAM stores one or more bit-plane buffers. In some embodiments a series of bit-plane buffers may be stored as a series of circular buffers of varying sizes.

For purposes of the present invention, the term "bit-plane format" or "planar format" refers to storing pixel data in such a way that one bit from each consecutive pixel of one color are stored or sent together. For example, in a planer format, a 32-bit word of pixels would contain 1-bit position from 32 consecutive pixels whereas in pack pixel format 24 bits would have all the bits for 8-bits per color of red, green and blue. So in planar format, bits from adjacent pixels of, for example, bit 3 of red, may be stored together for easy retrieval.

For purposes of the present invention, the term "bit plane" refers to taking one bit position from an array of values to form a bit array that is of the same dimensions as the original array but with only one bit per element of the array. A "bit plane" may be either physically separated in the case of "bit-plane organized" data or it may be used to refer to the concept of a bit position within an array of values. A "bit plane" may also be an array of bits that correspond to an array of values and the bit value may be based on some computation of the original value. A common use of a "bit plane" in graphics is to refer to any array containing one bit position from an array of multiple bit pixel values, but the array does not have to be just of pixel values. For example, there may be an array of color base values or sharpener values that are multiple bit quantities that may be stored as a series of "bit planes."

For purposes of the present invention, the term "boundary-shifter" refers to a control unit which is part of a partitioner and which controls the partitioner to shift the boundaries of groups it creates between fields and/or between frames.

For purposes of the present invention, the term "boundary-shifting elements" refers to switching elements which are part of a boundary shifter.

For purposes of the present invention, the term "color channel reducer" refers to a device that receives as its input an image having an associated resolution and number of color channels, and produces an image as its output that has the same resolution as the input image but has fewer color channels than the input image.

For purposes of the present invention, the term "color field" refers to the time period in which a single color is displayed. For example, in field-sequential color, the red field is the time period in which the color red is displayed. There will generally be multiple fields (of different colors) per frame where a frame consists of all the color fields representing a single image in a sequence of images. There may also be more than one field of the same color in a frame. While it is common to have color fields associated with the primary colors of red, green and blue, as is well understood in the art, the subtractive primaries cyan, magenta, and yellow or a "white" field may also exist. Where the context is clear, "color field" may also refer not only to the time period itself, but also the information or components of the image which are displayed during that time period.

For purposes of the present invention, the term "color-locking indicator" refers to a bit position or set of bit positions of a base value or base image, which are used to determine if a color is locked. A color is "locked" if only the base value is used to reconstruct the pixels controlled by that base value, and the sharpener value or values are not used. For portions of the image that are not locked, both the base image and the sharpener image are typically used to determine the final reconstructed image For purposes of the present invention, the term "color space" refers to space in the sense of multidimensional vector space formed by taking each color component as one dimension of the space.

For purposes of the present invention, the term "color-weighted averager" is an arithmetic unit which calculates a weighted average of a group of pixels for each multi-primary color component. Each pixel in the group is first assigned a single weighting factor which is used for all multi-primary colors. The weighting factor is determined for each pixel based on that pixel's location in the color space.

For purposes of the present invention, the term "column" is used with respect to a memory array segment organized on bit lines. Often there are two bit lines per "column" of memory. Often there is a column decoder which functions to multiplex a plurality of columns to form a single output.

For purposes of the present invention, the term "common multi-primary base value" refers to a multi-primary base value which is shared by two or more pixels. In other words, the two or more pixels used the same base value in reconstructing the image.

For purposes of the present invention, the term "common sharpener value" refers to a sharpener value which is shared by two or more color components of a pixel. In other words, the two or more color components of a pixel may use the same sharpener value in reconstructing the image.

For purposes of the present invention, the term "comparing arithmetically" refers to a comparison that involves a carry ripple or simple carry operation. Greater-than, less-than, and greater-than-or-equal-to are some examples of "arithmetic comparisons."

For purposes of the present invention, the term "comparing logically" refers to an operation that takes two values as inputs and generates one or more results based on the bits in those values using Boolean operations without a carry ripple path. An equal-to compare commonly consists of an XNOR function between each pair of bits in the input values and then an AND of the results of all the XNOR outputs and is an example of "logical compare."

For purposes of the present invention, the term "compressed image data" refers to data used to represent an image where the number of bits of data is less than the number of bits present in the image it represents.

For purposes of the present invention, the term "compression engine" refers to hardware and/or software and/or a combination of hardware and software that takes the bits associated with an image and produces a compressed image with fewer bits. The compressed image would generally require decompression/reconstruction to be viewable, and ideally the resultant decompressed/reconstructed image from the compressed image looks to a human like the original image before compression. With any "lossy compression" where some fidelity is lost, artifacts may occur in the compressed image after it is decompressed/reconstructed.

For the purposes of the present invention, the term "computer" refers to any type of computer or other device that implements software including an individual computer such as a personal computer, laptop computer, tablet computer, mainframe computer, mini-computer, etc. A computer also refers to electronic devices such as a smartphone, an eBook reader, a cell phone, a television, a handheld electronic game console, a videogame console, a compressed audio or video player such as an MP3 player, a Blu-ray player, a DVD player, a microwave oven, etc. In addition, the term "computer" refers to any type of network of computers, such as a network of computers in a business, a computer bank, the Cloud, the Internet, etc.

For purposes of the present invention, the term "cross-correction" and the term "cross-correction architecture" refers to a particular arrangement of estimator units in a compression engine for compressing a target image into a base image and a sharpener image. With the cross-correction architecture, a first base estimator produces a first intermediate base image based on the target image. A first sharpener estimator produces a first intermediate sharpener image based on the first intermediate base image and the target image. A second base estimator then produces a second intermediate base image based on the first intermediate sharpener image and target image. A second sharpener estimator produces a second intermediate sharpener image based on the second intermediate base image and the target image. The cross-correction architecture may comprise more estimators or fewer estimators. For instance the cross-correction architecture may include a third, fourth, fifth and so on base estimator and third, fourth, fifth and so on sharpener estimator. The cross-correction architecture may have fewer estimators and at a minimum may only include one base estimator and one sharpener estimator, provided at least one sharpener estimator or base estimator determines its output based on a previous output.

For purposes of the present invention, the term "current color field" refers to the color that is currently being displayed by a field sequential color display device.

For purposes of the present invention, the term "display panel" and the term "panel" refer to a device that is or includes a spatial light modulator (SLM). For purposes of the present invention the terms "display panel" and "panel" may be used interchangeably with the terms "spatial light modulator" and "SLM."

For purposes of the present invention, the term "display" refers to either to the array of light modulating elements of the SLM that generates an image or, depending on the context, the image itself.

For purposes of the present invention, the term "double frame buffer" refers to a memory or region of memory in which at least part of two different frames/images are stored at the same time. The data stored may be compressed, sub-sampled or uncompressed versions of the original image.

For purposes of the present invention, the term "driving an electrode" refers to driving an electrode either directly or through other circuitry. The circuitry used in driving an electrode may include logic functions.

For purposes of the present invention, the term "dummy cycle" refers to a time period while an electronic device is being operated during which some functionality of the electronic device is disabled so that the operation being performed has no net effect on the device, except to use power.

For example, a memory write may be performed during a dummy cycle in such a way as to leave the contents of the memory unchanged. As an example, this may be accomplished by disabling the word line drivers for the memory.

For purposes of the present invention, the term "dummy cycle driving unit" refers to a set of electronics for driving (writing) to a memory such as a MRRAM array, which may be activated to drive dummy cycles. These dummy cycles use power but leave the contents of the memory unchanged.

For purposes of the present invention, the term "EPE" refers to the combination of the ERAM and processing elements (PEs) in an ERAM aligned architecture.

For purposes of the present invention, the term "ERAM aligned architecture" or "ERAM alignment" refers to a SLM architecture where the processing logic is optimized to fit the ERAM structure as opposed to the Mirror RAM.

For purposes of the present invention, the term "ERAM" or "Execution RAM" or "execution memory" refers to an array of memory bits that are on the spatial light modulator backplane that are at least in part used to compute the pixel drives of the SLM. The bits may also be used for other purposes as well. ERAM supports read and write operations like a normal RAM but may have special features to facility display control. Depending on the context, the word "ERAM" can refer to the entire ERAM or some subset of ERAM bits in the same way the work RAM may be used.

For purposes of the present invention, the term "field sequential color" refers to the situation where a spatial light modulator is illuminated with a sequence of colored light. This would be the case, for example, if the spatial light modulator is illuminated by a series of flashes from LEDs, lasers or other colored light sources. Generally, at a minimum there are the color light primaries of red, green and blue light, but there may additionally be light sources that are a combination of two or more colors by either turning more than one of the light sources on at a time or by having a different light source.

For purposes of the present invention, the term "field" refers both to a "color field" in the sense of field sequential color or may be the next field/frame in a non-field sequential color system. In either case, the next field is the next image to be displayed by the display device. While one embodiment of this invention is for field sequential color, embodiments of this invention may also be used to generate non-field sequential display images.

For purposes of the present invention, the term "frame buffer" refers to a memory or region of memory where at least part of the representation of an image/frame is stored. This representation may be compressed/subsampled or uncompressed. The frame buffer may or may not have the entire image at any one time. The frame buffer may store different aspects of the image for different lengths of time. The frame buffer may be implemented as one or more circular buffers.

For purposes of the present invention, the term "frame rate" in the context of field sequential color refers the rate at which the entire image may change. Commonly in U.S. standard television progressive scanned video, the frame rate is about 60 Hz. With field sequential color, there will typically be at least one each of the red, green and blue fields per frame and there may be more fields either repeating some of the primary colors and/or with other colors such as yellow, cyan, magenta and/or white.

For purposes of the present invention, the term "full resolution" refers to there being one value for each color of each pixel in an image.

For purposes of the present invention, the term "gamma correction" refers to mapping input pixel values to output pixel values. In display devices, it is common to not want a linear change in the input value to have a linear response on the display.

For purposes of the present invention, the term "group of EPEs" is more than one EPE and its associated memory that may share some common logic or driver circuitry. For example, a group of EPEs might share Row decode and drivers for the ERAM sub-arrays.

For purposes of the present invention, the term "group of pixels" and, where it is not ambiguous, the term "group" refer to a collection or group of more than one pixel. In some cases, a group may consist of a single pixel. The shape of a group of pixels may be arbitrary. Also, an image or a display may have groups which are overlapping. In other words, a pixel may be a member of more than one group.

For the purposes of the present invention, the term "hardware and/or software" refers to a device that may be implemented by digital software, digital hardware, or a combination of both digital hardware and digital software.

For purposes of the present invention, the term "image" refers a set of numerical values that defines or controls a set of pixels of a visual image. There may or may not be a one-for-one correspondence between elements or values in an "image" and the individual pixels in a visual image. For example, one value in a "base image" may control or affect multiple pixels in a visual image. Usually an "image," at least conceptually, has two or more dimensions.

For purposes of the present invention, the term "implied addition" refers to an addition that exists as a result of a process in which the two values involved are not directly added together using any logic. This is especially useful when the first value and the second value affect non-identical groups of pixels, and so performing the addition of the data itself would be undesirable from a computational or memory standpoint. In one embodiment of the current invention, this occurs when the base values are used to control one set of edges of a series of pulses and the sharpener values are used to control a different set of edges.

For purposes of the present invention, the term "input pixel value" refers the numerical value associated with a pixel before the value is corrected or adjusted to compensate for the various system and device response characteristics.

For purposes of the present invention, the term "light modulating element" refers to a means for controlling the properties of a light source. For example, a light modulating element may control a light emitting source such as a phosphor dot, LED, etc., may control the way light is reflected by a mirror device, may control the polarization of light such as in an LCD or LCOS device, etc.

For purposes of the present invention, the term "lines" refers to a horizontal or vertical display line of the Mirror RAM array. This typically represents an array of pixels in which one dimension of the array is 1, and the other is the full horizontal or vertical dimension of the Mirror RAM array. The term "line" may also be used to refer to a conducting path along which a signal is traveling. For example, an MRRAM enable signal may be carried by an MRRAM enable "line."

For purposes of the present invention, the term "liquid crystal display" or "LCD device" refers to the conventional meaning of the term LCD device such as a large direct-view LCD television, as well as to related devices such as liquid crystal on silicon (LCOS) devices.

For purposes of the present invention, the term "machine-readable medium" refers to any mechanism that stores information in a form accessible by a machine such as a computer, network device, personal digital assistant, manufacturing tool, any device with a set of one or more processors, etc. For example, a machine-readable medium may be a recordable/non-recordable media (e.g., read-only memory (ROM), random access memory (RAM), magnetic disk storage media, optical storage media, flash memory devices, etc.), a bar code, an RFID tag, etc.

Figure 9:
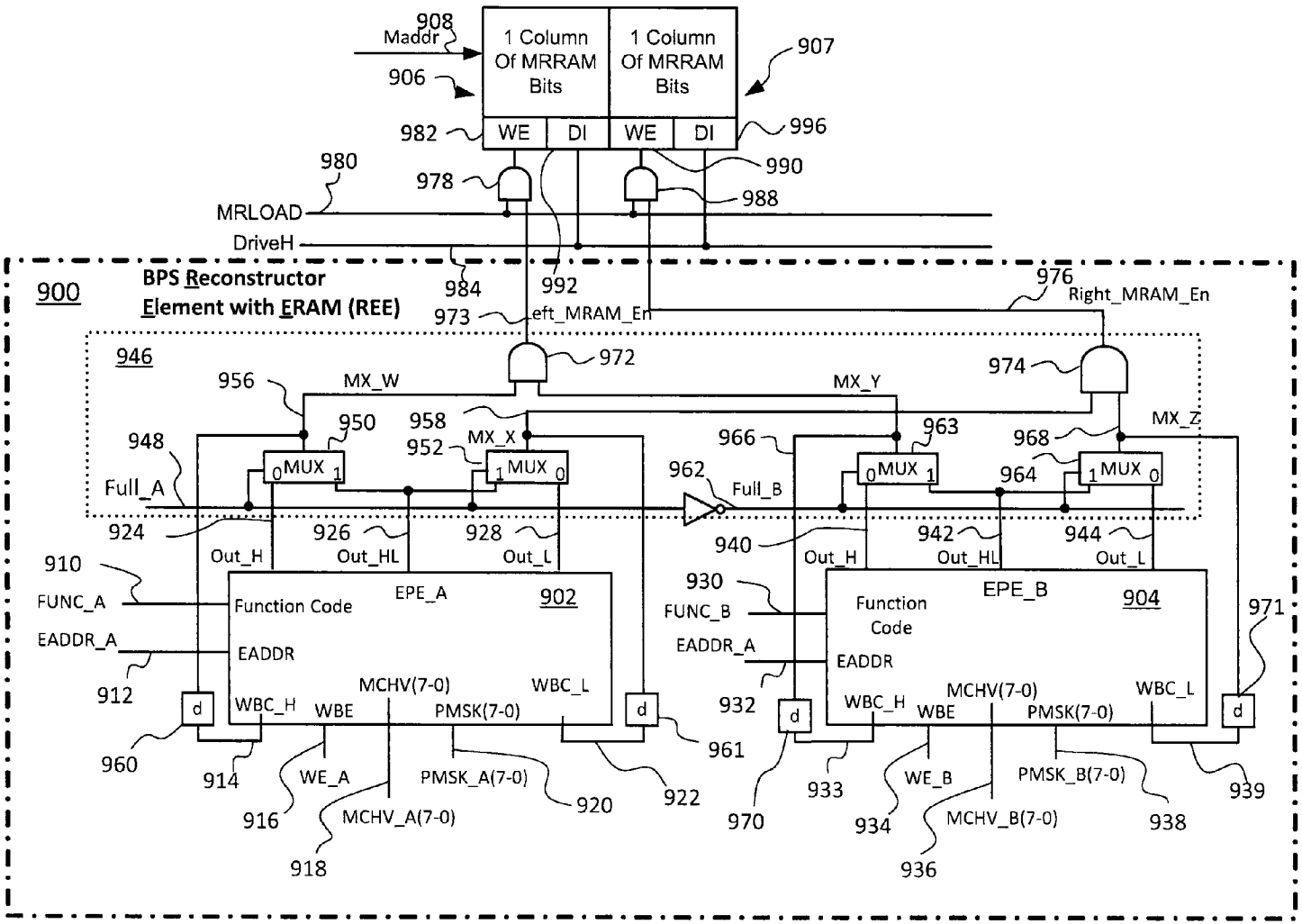
FIG. 9 shows a diagram of a reconstructor element with ERAM in accordance with one embodiment of the present invention.

For purposes of the present invention, the term "masked write" refers to a write operation in which some bit or group of bits is enabled or disabled from writing based on a separate mask value. In one embodiment of the present invention, the masking is supported on a bit-by-bit basis, but in other embodiments of the present invention a limited combination of bits may be masked. In one embodiment of the present invention, the data written is commonly broadcasted in some operations and the control of the outputs is based on whether various bits are enabled to be written. This in effect treats the storage bits as a "set reset" (SR) flip-flop that may be set, reset, or left unmodified. A masked write is one way to implement a conditional update. An example of a RAM with masked write capability is shown in FIG. 9 of U.S. Pat. No. 7,071,908 to Guttag et al., entitled "Digital Backplane," issued Jul. 4, 2006 (hereafter "U.S. Pat. No. 7,071,908 to Guttag et al."), the entire content and disclosure of which are incorporated herein by reference.

For purposes of the present invention, the term "masking loader" refers to a set of hardware which has the ability to prevent the writing, or "mask," of some or all bits when loading/writing a multiple-bit quantity into a multiple-bit memory location or register. In its most flexible form, there may be per bit write enable hardware that supports masking on a bit by bit basis, and in other forms one or more groups of bits may share a common write enable.

For purposes of the present invention, the term "masking-writer" refers to a writer that is able to perform masked writes.

For purposes of the present invention, the term "masking-control-value rewriter" or "MCVR" refers to a set of hardware that, based on the results of some processing, writes data back to ERAM or other memory on a spatial light modulator, wherein some or all of the bits may be protected or masked from being written back. For example, based on a comparison it may be desirable to write some bits back to the ERAM while protecting/masking/not changing other bits.

For purposes of the present invention, the term "match stage" and the term "stage" refer to a write or masked write to some or all active lines in the MRRAM plus any delay/wait that is specified before the next match stage can start. The number of cycles a match stage takes is a function of the number of bits written to the MRRAM in a cycle, the number of active pixel segments in the display, plus any programmed wait time. In the some embodiments, a match stage writes to all the pixel segments of the display, but it is possible that a match stage may write to only a subset of the pixel segments in a given match stage.

For purposes of the present invention, the term "match sub-stage" includes an ERAM read, compare and unconditional or conditional MRRAM write for all or part of a segment of pixels.

For purposes of the present invention, the term "match-value" or "MCHV" refers to a multiple bit quantity that is compared against the pixel value. The result of this comparison is then used as part of the control for turning a pixel's output on, off, or to be left in its current state. A match-value may come from a counter or it may come from a list of match-values, or it may be computed in some other way. A series of match-values that are not a simple count may be used to save memory and/or to generate pulses that are not simply a width based on a count.

For purposes of the present invention, the term "memory reallocation" or "reallocation" refers to storing a new value in a given memory location based on no longer needing that memory location for a previous value that was stored at that location. One object of some embodiments of the present invention is to support the reallocation of memory in order to require less total memory.

For purposes of the present invention, the term "microdisplays" refers to any of a class of display devices that are sufficiently small to require some form of magnification for human viewing for their intended use in a product. Microdisplays are one type of spatial light modulators.

For purposes of the present invention, the term "mirror RAM aligned architecture" or "mirror RAM alignment" refers to a SLM architecture where the processing logic and its associated memory are organized to roughly match the columns of the display Mirror RAM. Examples of this column structure display can be seen in U.S. Pat. No. 7,283,105 to Dallas et al., entitled "Microdisplay and interface on single chip," issued Oct. 16, 2007 (hereafter the "U.S. Pat. No. 7,283,105 to Dallas et al."); U.S. Pat. No. 7,113,195 to Willis et al., entitled "Generating Pulse Width Modulated Waveforms to Digitally Drive Pixels," issued Sep. 26, 2006 (hereafter "U.S. Pat. No. 7,113,195 to Willis et al."); U.S. Pat. No. 7,071,908 to Guttag et al.; and U.S. Patent Application No. 2004/0179155 to Willis et al., entitled "LCOS imaging device" published Sep. 16, 2004, the entire contents and disclosures of which are incorporated herein by reference.

For purposes of the present invention, the term "mirror RAM array" or "MRRAM array" is a collection of MRRAM bits organized into a memory array.

For purposes of the present invention, the term "mirror RAM bit" or "MRRAM bit" refers a storage bit that is used to drive an electrode that controls the output of a spatial light modulator. The MRRAM bit may drive an electrode through additional circuitry including logic circuitry for inverting the output of the storage bit and/or voltage level shifting so that the electrode is based on the drive output bit since it is well known for driving liquid crystal displays including LCOS displays.

For purposes of the present invention, the term "mirror RAM" or "MRRAM" refers to a memory array that has in it storage bits that are "drive bits" (see the definition of "drive bits") in it. In some cases the Mirror RAM may have a mixture of "drive bits" and storage bits that are not drive bits.

For purposes of the present invention, the term "multi-operational comparator" refers to a comparator that can perform more than one type of operation. For example, a multi-operational comparator may perform an equal-to (logical) compare and a less-than-or-equal-to compare and an arithmetic compare.

For purposes of the present invention, the term "multiplier-free processing elements" refers to arithmetic units which contain no multipliers. Typically these arithmetic units are smaller, lower-power or contain fewer transistors than arithmetic units which contain multipliers. In some cases arithmetic units contain fixed multipliers which are comprised of bit-shifters and/or adders. Such arithmetic units would not be considered multiplier-free processing units since the shifters and/or adders are equivalent to a multiplier.

For purposes of the present invention, the term "multi-primary color" refers to a single color component of a color image or color system. It is a generalization of the term "primary color," which traditionally refers only to red, green or blue. A multi-primary color may be one of red, green or blue, or some other color which is used to make up a color image such as white, yellow, cyan, magenta, amber, etc. For the purposes of the present invention, the term "multi-primary color" is a superset of the term "primary color" in that it may include a set of colors that includes only the primary colors such as red, green and blue, but it may also include other colors such as secondary colors such as yellow, cyan and magenta, as well as other colors such as white.

For purposes of the present invention, the term "multi-primary color component" and the term "color component" refer to the information or bits associated with a single color. For a full color image, it always takes at least 3 color components to define it. For example, the three components would be the data for red, green and blue. With multi-primary color representation there are additional colors, for example, yellow, cyan and white. This definition is the same as the common meaning of the term "color component," other than making it explicitly clear that it applies as well to the components of a multi-primary image.

For purposes of the present invention, the term "multi-primary image" or "multi-primary display" refers to an image or a display which comprises multi-primary color components. The term "multi-primary display" may include a red-green-blue display, but may include a display with greater or fewer multi-primary colors.

For purposes of the present invention, the term "non-single-multi-primary data" refers to data used in the representation of an image, or used in a display which is used to determine two or more of the multi-primary components.

For purposes of the present invention, the term "non-single-multi-primary storage" refers to storage which is used to store non-single-multi-primary data.

For purposes of the present invention, the term "original pixel value" or "original pixel color value" refers the "pixel value" or "pixel color value" associated with a pixel before the value is corrected or adjusted to compensate for the various system and device response characteristics.

For purposes of the present invention, the term "packed pixel" or "packed format" refers a way of storing or sending an "ordered group of bits" where in all the bits are grouped together. For example, it is common to use 24-bits of data to specify a pixel with 8-bits of data for each of the primary colors of red, green and blue. In a pack pixel representation, all the bits of the entire pixel are sent together or may be read from memory in one or a very few operations.

For purposes of the present invention, the term "parallel processing element" or "PPE" refers to a processing element that processes multiple bits in parallel and generally in what is considered a single clock period. The processing may be Boolean processing with multiple bits that produce either a single bit or multiple bits of output with no carry ripple, or may be arithmetic processing with a carry ripple such as an addition, or a single bit of output such as a greater-than or less-than signal. Multiple cycle operations may be performed by a "parallel processing element" by doing several parallel operations. These multiple cycle operation may be for a single pixel or a block of multiple pixels.

For purposes of the present invention, the term "partitioner" refers to a control unit which causes a pixel array and/or image to be divided into groups of pixels such that each group of pixels shares some common data. A partitioner may be implemented in hardware or software or a combination of both.

For purposes of the present invention, the term "pixel block" and, where it is not ambiguous, the term "block" refers to a collection or group of more than one pixel. In some cases, a block may consist of a single pixel. When an image is referred to as being partitioned into blocks, it is common that blocks do not overlap, and that every pixel in the image is a member of one block. Blocks may be rectangular or square, but may have arbitrary shape or even be non-contiguous.

For purposes of the present invention, the term "pixel color value" refers the numerical value associated with one color of a pixel. Generally it is the quantity of a color component for a single pixel of an image. For a color image, it is common to have 3 pixel color values, one for each color.

For purposes of the present invention, the term "pixel control form of reconstructed image" is a reconstructed image generated form base image data and sharpener image data that have been processed to produce pixel control signals that may, through some process, generate a human-visible image. In at least some embodiments, the human visual system may be relied on to finish the processing of the reconstructed image into what the human perceives.

For purposes of the present invention, the term "pixel value" refers to the numerical value associated with a pixel. When used without a pre-qualifier as "input or output," a pixel value refers to the current value of the pixel. It is a multiple bit number that controls the light output and/or reflectance and/or polarization change of a pixel. In some embodiments of the present invention, the "pixel value" may be modified to form a "modified pixel value." While generally 3 or more "pixel color values" are contained within a "pixel value," the term "pixel value" may also be used to refer to a "pixel color value" when it is not ambiguous.

For purposes of the present invention, the term "pixel" is a general term to describe a single element of a multidimensional display. As examples, this element may be a small mirror in the digital micro mirror (DMD) or DLP™ that tilts to redirect the light or in the case of LCOS, there is liquid crystal controlled by a mirror/electrode that changes the polarization of the light that will then pass through other optics to affect the amount of light in a pixel, or in the case of a light emitting diode (LED), light is emitted, or in the case of a printer, it controls the color of an element of the printout. To produce a two dimension image, an array of pixels must in some way be controlled.

For purposes of the present invention, the term "pixel control signal" refers to a signal that directly or indirectly through other hardware controls the output of one or more pixels. One or more outputs of a reconstructor element may produce a series of pixel control signals that control a series of pixels. A pixel control signal may differ from a "pixel drive signal" which sets the voltage on a pixel electrode; for example, the pixel control signal might drive the write enables, which in turn affect the pixel drive, but there may not be a direct one-for-one correspondence between a pixel control signal and the pixel drive itself.

For purposes of the present invention, the term "pixel drive" refers to the voltages that drive a pixel electrode. In the case of an MRRAM array, each pixel has a memory bit that drives the pixel. The MRRAM array may include features such as per-column write enables that are controlled by pixel control signals rather than the pixel control signals directly setting the value of the memory bit associated with each pixel.

For purposes of the present invention, the term "pixel drive waveform" refers to a picture or figure representing the voltage and/or current over time of a given pixel drive.

For purposes of the present invention, the term "pixel segment" and the term "segment" refer to a series of pixels that are either horizontally or vertically adjacent on the display that may be written simultaneously. In some embodiments, the segment may be exactly equal to the number of pixels in a horizontal or vertical line, but it may also be either part of a line or more than the number of pixels in one line.

For purposes of the present invention, the term "planarization or plane splitting" refers to the process whereby pixels in "pack pixel format" are converted into "bit-plane format." "Planarization hardware" takes in data in packed pixel format and output data in bit-plane format.

For purposes of the present invention, the term "plane splitting" refers to the process of taking a series of multi-bit pack data (such as a packed pixel) quantities and splitting off the bits of one or more bit position and repacking the split off bits into multi-bit data quantities that only have the bits of one bit position for a series of data quantities. Plane splitting is a way to take "packed pixel" arrays and convert them into "bit-plane organized" arrays. Plane splitting may be done on the whole array or only on some subset of the array. Plane splitting is one of many ways in which incoming pixel data may be reformatted (reorganized) for more efficient data processing or display manipulation.

For purposes of the present invention, the term "primary color" or "color" may refer to the usual notion of primary color, that is, one of red, green or blue. However, in systems which treat other colors as independent, they may be treated as primary colors for purposes of processing and display. For example, a system may for some reason have two green channels, both of which may be referred to as primary colors. A system may also treat a white, cyan, magenta or yellow channel as a primary color. There may also be cases where non-visible colors such as infrared or ultraviolet are treated as primary colors.

For purposes of the present invention, the term "processing element" or "PE" refers to a processing element that may be programmed or otherwise set such that bits of a pixel or pixels may be used to determine a match or no-match condition to a particular test or set of tests. The term "element," when referring to a processing datapath implies that there are multiple and in often large numbers of the processors in a device. In many scenarios the bit planes of pixels are sent to the many PEs to determine which pixels match a particular value, and if said pixels should be sent a command that may result in a change in a related Mirror RAM pixel. A PE may take the form of a bit-serial PE that takes multiple cycles to process multiple bits or a parallel processing element or "PPE" that may compute a result based on multiple bits in parallel. With pipelining, a PPE may also take multiple cycles, but generally the number of cycles is not dependent on the number of bits processed.

For purposes of the present invention, the term "programmable match-value sequencer" refers to is a unit which provides match-values as needed, and may be programmed with a predetermined sequence of values of may compute these values, and is capable of providing non-sequential match-values or sequential match-values as needed.

For purposes of the present invention, the term "quantized sharpener value" means a sharpener value has been "quantized" from a value with more bits to represent it into a number with fewer bits representing it. Generally quantization involves more than simply dropping the least significant bits and may use a mathematical equation or a lookup table to convert a value with a larger number of bits into a value with fewer bits. The quantization bins or quantization values may or may not be equally spaced.

For purposes of the present invention, the term "quantizer" refers to a device that receives as its input an image having an associated resolution and number of color channels and number of bits per pixel, and produces an image as its output which has the same resolution as the input image and the same number of color channels as the input image, but has fewer bits per pixel than the input image. A quantizer may also operate on a single value or a set of values, which may or may not represent an image. A quantizer reduces the number of bits needed to represent the value or set of values.

For purposes of the present invention, the term "reconstructor" is a set of hardware that takes sharpener image and a based image and generates a reconstructed image. A "reconstructed image" may be in one of many forms. For example, a reconstructed image may be in a common 24-bit per pixel with 8-bits each of red, green and blue form at the resolution of a target image. A "reconstructed image" may also be in a form that generates pixel drive signal. These pixel control signals may in turn may drive electrodes that in some way controls the intensity of the pixels or that modulate light that that illuminates pixel mirrors, which in turn is projected or directly viewed by a human. In at least some forms of the present invention, the reconstructed image is not in a simple common red, green and blue form, and rather relies, in part, on the human visual systems to process the image that the person sees.

For purposes of the present invention, the term "reconstructor element" and the term "RECEL" refer to a set of hardware that processes base data and sharpener data inputs, resulting in one or more signals that control the light output or the resultant reflectivity of one or more pixels in a reconstructed image. Often there may be many RECEL on a given spatial light modulator. In one embodiment of the present invention, there is one RECEL per two columns of pixels in an MRRAM array but there may be more RECELs or fewer per column of MRRAM based on the design requirements. The outputs of a RECEL may be either hardwired or connected via switches to the columns of an MRRAM to control the pixels.

For the purposes of the present invention, the term "reconstructor element with ERAM" and the term "REE" refer to the combination of the reconstructor element with the associated memory or ERAM that has the base and sharpener data.

For purposes of the present invention, the term "row" is used with respect to a memory array segment organized on word-lines "WLs." A "row" of memory bits typically shares a common word line.

For purposes of the present invention, the term "segment match" refers to one or more ERAM reads of pixel values for one vertical or horizontal segment of pixels and comparing each pixel value to a match value. A segment match may occur in a single cycle or may take multiple cycles. All or part of the bits of the pixel value may be used in the match. A mask may be used to choose which bits in the pixel and mask value are ignored.

For purposes of the present invention, the term "selectively masking one or more bits" means that there is parallel processing hardware that supports masking one or more bits of input and in doing so only a subset of the input bits affecting the result. For example, if there is an 8-bit wide equal comparison and 3 of the bits are "masked," then only the 5-bits that are not masked affect the equals compare. In effect, the masked bits of input become "don't cares" in terms of the result and are ignored.

For purposes of the present invention, the term "series of match stages" refers to a sequence in which multiple match stages are applied one after another. The end result of a series of match stages cause the individual MRRAM bits to apply or not apply a charge to a mirror or electrode that drives a pixel. The result of the changing charge on the mirror/electrodes causes an optical drive waveform that modulates the light for each of the pixels.

For purposes of the present invention, the term "sharpener image" is an image produced when compressing a target image, and/or used for producing a reconstructed image wherein said "sharpener image" has the same resolution as a target image and/or reconstructed image, but having fewer total bits per pixel than the target image and/or reconstructed image. The sharpener image is typically determined in combination with a base image such that a reconstructed image based on the base image and the sharpener image is as close as possible to a given target image. The sharpener image may have fewer multi-primary color components than the target image and/or the reconstructed image. Also, the values in the sharpener image may be represented with fewer bits than the values in the target image and/or the reconstructed image.

For purposes of the present invention, the term "sharpener value" or "sharpener" is one value from a sharpener image. Each sharpener value is used to determine one or more pixels, and may affect more than one color component of those pixels. The sharpener values usually represent a compensation or modification applied to a base-value-only version of an image in order to make it sharper or to increase the appearance of detailed features of the image.

For purposes of the present invention, the term "single-multi-primary data" refers to data used in the representation of an image, or used in a display which is used to determine only one of the multi-primary components. For example, in a RGB representation, the red data would be considered single-multi-primary data.

For purposes of the present invention, the term "single-multi-primary storage" refers to storage that is used to store single-multi-primary data, even if it stores single-multi-primary data for more than one multi-primary color.

For purposes of the present invention, the term "SLM device" refers to any device that includes an SLM or is an SLM. Examples of SLM devices include visual display devices, SLMS, etc.

For purposes of the present invention, the term "spatial light modulator" or "SLM" refers to a one, two or multi-dimensional array of light modulating elements that control or modify incoming or emitted light and the circuitry included to control those elements on a device and all the control circuitry and memory on the device that is performing the spatial light modulation. For example, each element of a spatial light modulator may change the direction of the incoming or emitted light, the intensity of the incoming or emitted light, the polarity of the incoming or emitted light, the wavelength of the incoming or emitted light, the focus of incoming or emitted light, etc. A spatial light modulator is a component in a display system that has an array of light modulating elements.

For purposes of the present invention, the term "splitable comparator" refers to a set of comparison logic that may generate one comparison with n-bits and a significant portion of the same logic hardware may be used to perform more than one comparison, with each comparison of less than n-bits.

For purposes of the present invention, the term "storage" and the term "storage medium" refers to any form of storage that may be used to store bits of information. Examples of storage include both volatile and non-volatile memories such as MRRAM, MRRAM, ERAM, flash memory, floppy disks, Zip™ disks, CD-ROM, CD-R, CD-RW, DVD, DVD-R, flash memory, hard disks, optical disks, etc.

For purposes of the present invention, the term "sub-sampled resolution" and the term "subsampled image" refer to there being less than one value for each pixel in the full resolution image. For example, a subsampled image might have 1 value for each of 4 pixels in a 2 by 2 "block" in the full resolution image. Each pixel in the subsampled image is often created as a function of multiple pixels in the "full resolution" image, as is well understood in the art.

For purposes of the present invention, the term "subset" refers to the conventional meaning of the term subset. A "subset" may include an improper subset of all elements. For example, a "subset" of an array of circuits may include all of the circuits of the array of circuits.

For purposes of the present invention, the term "summary bit" refers to a combination of one or more bit positions for a given pixel. The summary bit is computed by either a logic combination of the other bits and/or and arithmetic operation on the other bits such as a greater than or less than comparison. The summary bit is generally used in place of needing to send and/or store some or all of the bits that it summarizes.

For purposes of the present invention, the term "switching elements" refers to units for connecting a set of data lines to another set of data lines and which allow some level of control over which lines are connected to which.

For purposes of the present invention, the term "target image" refers to an image before it is converted into a "base-plus-sharpener" form. This image may be directly obtained from an input source, or it may have been processed by some other image processing functions, including but not limited to: keystone correction, image resizing, on-screen display or color-space manipulation. A target image generally has 3 or more color values per each pixel.

For purposes of the present invention, the term "temporal image" refers to the whole content of image that is not visible in any instant in time, but rather relies on the human visual system to combine a rapidly changing series of images into the final image that a human perceives. Field sequential color where various colors are presented in rapid succession is a form of "temporal image" since at any instant in time only one color is displayed, yet if the colors are changed rapidly enough, a human perceives a full color image. Some embodiments of this invention generate a "temporal image."

For purposes of the present invention, the term "total bits per pixel" refers to the sum of all bits used to represent a pixel. For example, a typical color pixel may have 8 bits per red, green and blue primary color for a "total bits per pixel" of 24 bits. In some embodiments of the present invention, a "sharpener" may have 8 bits per pixel and would have fewer "total bits per pixel" than a 24 bits per pixel, for example, with 8 bits per primary color.

For purposes of the present invention, the term "two-state color-weighted averager" is a color-weighted averager wherein the weighting factors which are determined are limited to only two possible values. For example, if the weighting factors are limited to either 0 or 1, then the color-weighted averager would be a two-state color-weighted averager.

For purposes of the present invention, the term "value" refers to a numerical quantity. The quantity may either be a conceptual infinite-precision number, or a member of a finite set of numbers. For example, the base value may be an integer in the range 0 to 255, and may be represented in a circuit as 8 bits, but in a mathematical description, the base value may be thought of as having arbitrary precision.

For purposes of the present invention, the term "visual display device" or "visual display apparatus" includes any type of visual display device or apparatus such as a CRT monitor, LCD screen, LEDs, a projected display, a printer for printing out an image such as a picture and/or text, etc. A visual display device may be a part of another device such as a computer monitor, television, projector, cell phone, smartphone, laptop computer, tablet computer, handheld music and/or video player, personal data assistant (PDA), handheld game player, head mounted display, a heads-up display (HUD), a water screen upon which an image is projected, a global positioning system (GPS) receiver, automotive navigation system, dashboard, watch, microwave oven, electronic organ, automated teller machine (ATM), etc.

For purposes of the present invention, the term "word-line-disable line" refers to a line carrying a signal for disabling the word line drivers for a memory such as a MRRAM array.

Description

A field sequential digitally driven pulse-width modulated display device generally has a controller for controlling pulse widths on the pixels of the display device. The controller has associated with it a frame buffer that holds the pixel data, hardware to convert incoming video data into a form that may be readily processed by the display device, and control information for the display device. The controller may be physically built on one or more substrates. For example, it may be more cost effective to use a separate DRAM device for the frame buffer. Also, some or all of the control logic may be on either the controller device, the display device or some split between them so the splitting of the functional blocks between the controller and the display is somewhat arbitrary.

Typical display panel architectures that have on-chip processing capability of multiple bit planes of data, have a commonality that various bit planes of a specified pixel are loaded into a comparator, processing element, or other logic unit to produce displayable actions that are generated on the display pixels. It is further common that the processing elements are vertically aligned in columns above/below the pixels they are intended to influence, as would be their natural location, and is defined herein as a "Mirror RAM aligned architecture." It is also usual that the supporting memory bits that supply data to the processing elements are generally aligned (if not strictly aligned) to the pixel column that they are intended to influence. This can be seen in U.S. Patent Application No. 2011/0150501 to Guttag et al., entitled "Spatial Light Modulator with Masking-Comparators," published Jun. 23, 2011; U.S. Pat. No. 7,283,105 to Dallas et al.; U.S. Pat. No. 7,317,464 to Willis et al., entitled "Pulse Width Modulated Spatial Light Modulators with Offset Pulses," issued Jan. 8, 2008; U.S. Pat. No. 7,071,908 to Guttag et al.; and U.S. Patent Application No. 2004/0179155 to Willis et al., entitled "LCOS Imaging Device" published Sep. 16, 2004, the entire contents and disclosures of which are incorporated herein by reference.

Incorporated into some spatial light modulator (SLM) display devices is a controller including memory and processing for controlling pulse widths on pixels. Associated with the controller are: (1) a frame buffer that holds pixel data, (2) hardware that converts incoming video data into a form that can be readily processed by the SLM display device, and (3) control logic for the SLM display device. The controller may be physically built on one or more substrates. For example, it may be more cost effective to use a separate DRAM device for the frame buffer. Also, some or all of the control logic may be located on the controller device, the display device or some combination of the controller and the display device. Therefore, the splitting of functional blocks between the controller and the display device may be somewhat arbitrary. If the frame buffer is located on a device which is separate from the SLM, there may additionally be a field buffer located on the SLM which stores data associated with one display field.

A counter may be used with a comparator to control pulse widths and this approach is used in U.S. Pat. No. 7,283,105 to Dallas et al.; U.S. Pat. No. 7,317,464 to Willis et al., entitled "Pulse Width Modulated Spatial Light Modulators with Offset Pulses," issued Jan. 8, 2008; and U.S. Patent Application No. 2004/0179155 to Willis et al., entitled "LCOS Imaging Device," published Sep. 16, 2004, the entire contents and disclosures of which are incorporated herein by reference. In contrast, the present invention provides a method that does not perform an unconditional compare to a counter, but rather uses logic that may mask various bits of a code that are checked against in order to reduce the need for storage on an SLM.

One method employing the concept of pulse width modulation that has been previously described is to compare the pulse width value to a counter. The pulse is initialized to 1 if the pulse width is none/zero (or alternatively the pulse is initialed to 1 unconditionally and then quickly set to zero if the value is zero). At some time interval the counter increments by one each time and the comparison is remade. When the value of the pulse width equals the value of the counter, then the pulse is driven low. This method for use in driving pulse widths on pixels is described in U.S. Pat. No. 7,113,195 to Willis et al. and U.S. Pat. No. 7,283,105 to Dallas et al., the entire contents and disclosures of which are incorporated herein by reference. It should be noted that both U.S. Pat. No. 7,113,195 to Willis et al. and U.S. Pat. No. 7,283,105 to Dallas et al. perform a full unconditional compare between all bits of the pixel/pulse value and a counter.

U.S. Pat. No. 7,071,908 to Guttag et al. shows how pulse widths on a spatial light modulator may be controlled with a series of partial comparisons. Guttag et al. '908 also shows how to do these comparisons with bit-serial processing. One of the objects of the present invention is to show how to use parallel data processing hardware with conditional per-bit masking support to accomplish a similar function.

All visual displays rely in one way or another on the human visual system to process and interpret the image generated by the display device. The display generates an "objective image" (say one taken by a camera or measured by an instrument) but the user sees a "subjective image" as seen through the human visual system. For example, in the case of a common LCD color flat panel, there are three (3) individual spots of red, green and blue light that typically form a "pixel" that, depending on the brightness of each spot, the eye interprets as being some color other than red, green or blue including white even though there is no "white pixel" in the physical display. In the case of a color CRT that uses flying-spot scanning, the CRT relies upon the persistence of vision so the human sees a single image and not the scanning beam itself. In the case of simple "field sequential color," for example, a red image is presented to the eye, then a green image, and then a blue image is presented to the eye at different points in time, but if the sequencing of the color images is fast enough, the human will see a single full color image. All display devices in one way or another create and illusion that is interpreted by the human visual system in to the subjective image that a human sees. In some embodiments of the present invention a new means of creating a display "illusion" is presented.

Some embodiments of the present invention use a novel "base-plus-sharpener" BPS representation that has advantages in field sequential color displays. Image compression is achieved, while only two values at a time are needed on the SLM to reconstruct each pixel of the image. Additionally fewer bits are sent to the spatial light modulator (SLM) between color fields. Additionally, the size of the frame buffer may be reduced.

Many common compression standards such as JPEG and MPEG use the well-known "chroma subsampling" to compress data. When chroma subsampling is performed, a color-space conversion, such as YUV or YCbCr, is done to obtain three components, one representing a luminance component (Y), and two chroma components (U and V, or Cb and Cr). The chroma components are then represented using some lower-resolution (subsampled) representation. Other prior art methods, such as described in U.S. Pat. No. 7,283,105 to Dallas et al., have employed a color space conversion to a custom luma-chroma format (which is similar to the widely used YUV) along with subsampling of the chroma components to reduce storage.

One problem with a luma-chroma format (such as YCbCr) is that it is inconvenient for use in field sequential color systems where the frame buffer is not on the SLM itself. To convert image data stored in a luma-chroma format into a single color generally requires reading the luma value and one or two chroma values and then doing some computations involving the components to produce a color pixel value (such as in the primary colors red, green or blue). U.S. Pat. No. 7,283,105 to Dallas et al. reduces the computations at some loss in image quality with its custom format, but still requires some computation to reconstruct the pixel values. In U.S. Pat. No. 7,283,105 to Dallas et al., both the luma and chroma values are stored on the SLM which avoids this problem, but requires more memory on the SLM, which is undesirable.

For a typical display system, the incoming image may be represented with 8 bits per pixel per color, or 24 total bits per pixel for a RGB display. In field sequential color systems it is common to use a frame buffer, which typically comprises a full double frame buffer. A first buffer is used to store the frame being displayed while a second buffer is used to store the subsequent frame, which is being received. This full double buffer may require 48-bits (two times 24-bits) or more of storage per pixel. One object of the present invention is to greatly reduce the size of this double frame buffer.

For field sequential display systems in which the frame buffer is not on the SLM, it is common to use a field buffer which is located on the SLM. In some cases, a full double field buffer is used; a first buffer is used to store the field being displayed and a second buffer is used to store the next field which is being received by the SLM. One object of the present invention is to reduce the size of the field buffer on the SLM. Yet another object of the present invention is to reduce the amount of data which is sent to the SLM between fields.

The present invention relates to a digital backplane and various methods, systems and devices for controlling a digital backplane, light modulating elements and spatial light modulators. Further present invention has features that are particularly useful for supporting field sequential color where a single microdisplay controls the pixel intensity for more than one color that illuminates the panel in sequence.

In some embodiments of the present invention an SLM device has incorporated into it memory and processing for controlling pulse widths for a plurality of pixels. The controller has associated with it a frame buffer that holds the pixel data, hardware to convert incoming video data into a form that may be readily processed by the SLM device, and control for the SLM device. In some embodiments, the controller of the present invention may be physically built on one or more substrates. For example, it may be more cost effective to use a separate DRAM device for the frame buffer. In some embodiments of the present invention, some or all of the control logic may be on either the controller device, the SLM device or some split between them so the splitting of the functional blocks between the controller and the SLM is somewhat arbitrary. In a sequential color display system, the panel is responsible for displaying individual color fields one after the other. The sequential colors at a minimum are the primary colors of Red, Green and Blue (RGB). A white field may be calculated based on the input RGB data and is displayed with all three light sources turned on at the same time. In this case, white would be considered a multi-primary color. Other multi-primary colors may also be used, such as Yellow, Cyan, Magenta, Amber or others.

In one embodiment, the present invention reduces the need for storage on a display panel, reduces the required bandwidth to a display panel, and/or increases light-on time for a display panel.

In one embodiment, the present invention provides a "base-plus-sharpener" representation that reduces the size of the frame buffer in the controller.

In one embodiment, the present invention provides a "base-plus-sharpener" representation that reduces the size of the field buffer on the SLM.

In one embodiment, the present invention provides a "base-plus-sharpener" representation which reduces the amount of data which is sent to the SLM, and thereby uses less power.

In at least one embodiment of the present invention, the electrode may be a mirror that both reflects light and creates an electric field that causes liquid crystal to modify the polarization of polarized light. Using a semiconductor CMOS substrate, such as silicon, GaAs, etc. to control the Liquid Crystal in this way is known as liquid crystal on silicon (LCoS). In other embodiments, this electric field may be used to control a micro-mirror as in the case of a Texas Instrument's DLP™ device.

FIG. 1 shows three different flow diagrams outlining three different embodiments of some aspects of this invention. This figure will aid in understanding the terms associated with various aspect of this invention.

Flow diagram 100 shows base image data 102 and sharpener image data 104 being sent to processor 106. Processor 106 has hardware and/or software that uses base image data 102 and sharpener image data 104 to create a common 24-bit per pixel form of reconstructed image 110 with 8 bits per pixel each of red, green and blue. Reconstructed image 110 may be of higher or lower resolution, or more or less bits per pixel than the original target image used in the creation of base image data 102 and sharpener. Image data 104. Processor 106 may include scaling or other image processing features to enhance or otherwise modify the image. A reconstructed image 110 that is 24 bits per pixel may be used by any traditional device that can accept 24 bit per pixel data. Note that there may be digital to analog conversions and signal interface conversions such as to HDMI that are not shown in FIG. 1 but that may be used in the present invention.

Flow diagram 100 depicts only one of many ways to use the concepts of the present invention. It will be understood by one skilled in the art that the 24-bit RGB form of reconstructed image 110 is only one of many common ways to reconstruct an image. There may be more or fewer bits per pixel than 24 for example, or the reconstructed image may be reconstructed as a different form such as luma and chroma vectors commonly known as YUV or Y, Cr, Cb.

In FIG. 1, base image data 102 and sharpener image data 104 are fully converted into another recognizable/well understood image form. However, because of limitations in a human's visual system, it is not necessary to fully convert base and sharpener data into RGB or other conventional forms. Instead it is only necessary to convert the data into a form that a human's visual system will recognize.

Flow diagram 120 shows a base image data 122 and sharpener image data 124 being processed in parallel by display processing hardware, i.e., reconstructor elements with ERAM (REEs) 126. In the process shown, there are many REEs on the spatial light modulator with each REE controlling perhaps one or more columns of pixels or in some embodiments one REE may control multiple columns of pixels. Control signals 130 are the output of set of REEs 126 and form a reconstructed image. Control signals 130 control pixels in MRRAM array 132 to generate a field sequential color image. In some embodiments control signals 130 may drive write enables of MRRAM array 132, which in turn conditionally write to the MRRAM bits which in turn drives/controls liquid crystal 134 of a liquid crystal display device, the various primary colors illuminate the display which reflects light 136 to generate a field sequential temporal image 138. An important difference between flow diagram 120 and 100 is that the field sequential form of reconstructed image of flow diagram 120 is only a series of control signals, i.e., control signals 130, and not a common form of image. Furthermore the image output, i.e., field sequential temporal image 138, is a "temporal image" that requires the human visual system to interpret it as a full color image.

Flow diagram 150 shows the generation of a temporal image that uses even more of the human's visual systems ability to process/interpret the image than that of flow diagram 120. In this case base image data 152 and sharpener image data 154 are processed by display processing hardware, i.e., REEs 156, to generate a BPS control signal form of a reconstructed image 160. BPS control signal form of reconstructed image 160 differs from field sequential form of reconstructed image 130 in that the control signals assume some level of base and sharpener combination/interpretation will be done by the human visual system which in turn can allow set of REEs 156 to be simpler/require less hardware than those of the set of REEs 126. BPS control signal form of reconstructed image 160 is then used to control, possibly via other hardware such as write enables, MRRAM array 162 which in turn writes to MRAM bits which in turn drives the liquid crystal 164, and is combined with primary/multi-primary illumination 166 to produce a BPS color sequential image 168. BPS color sequential image 168, while different than the more common field sequential image 138, is perceived by the human visual system similarly (the overall perceived image will be the same for most images while there might be some perceived differences in certain images).

An important point of flow diagrams 100, 120, and 150, is that the "reconstructed images," i.e., RGB form of reconstructed image 110, field sequential form of reconstructed image 130, and BPS control signal form of reconstructed image 160 may not be "fully" reconstructed back into a red, green and blue or other common format. The reconstruction processing may depend on the drive circuitry and the human visual system to finish the processing of the image into one that the human perceives as the final image.

It will be understood by those skilled in the art that while flow diagrams 120 and 150 show the control of a liquid crystal display device, the concepts of diagrams 120 and 150 may be applied to other displays devices such as a digital micromirror device (DMD), also known as a DLP.

Figure 2:
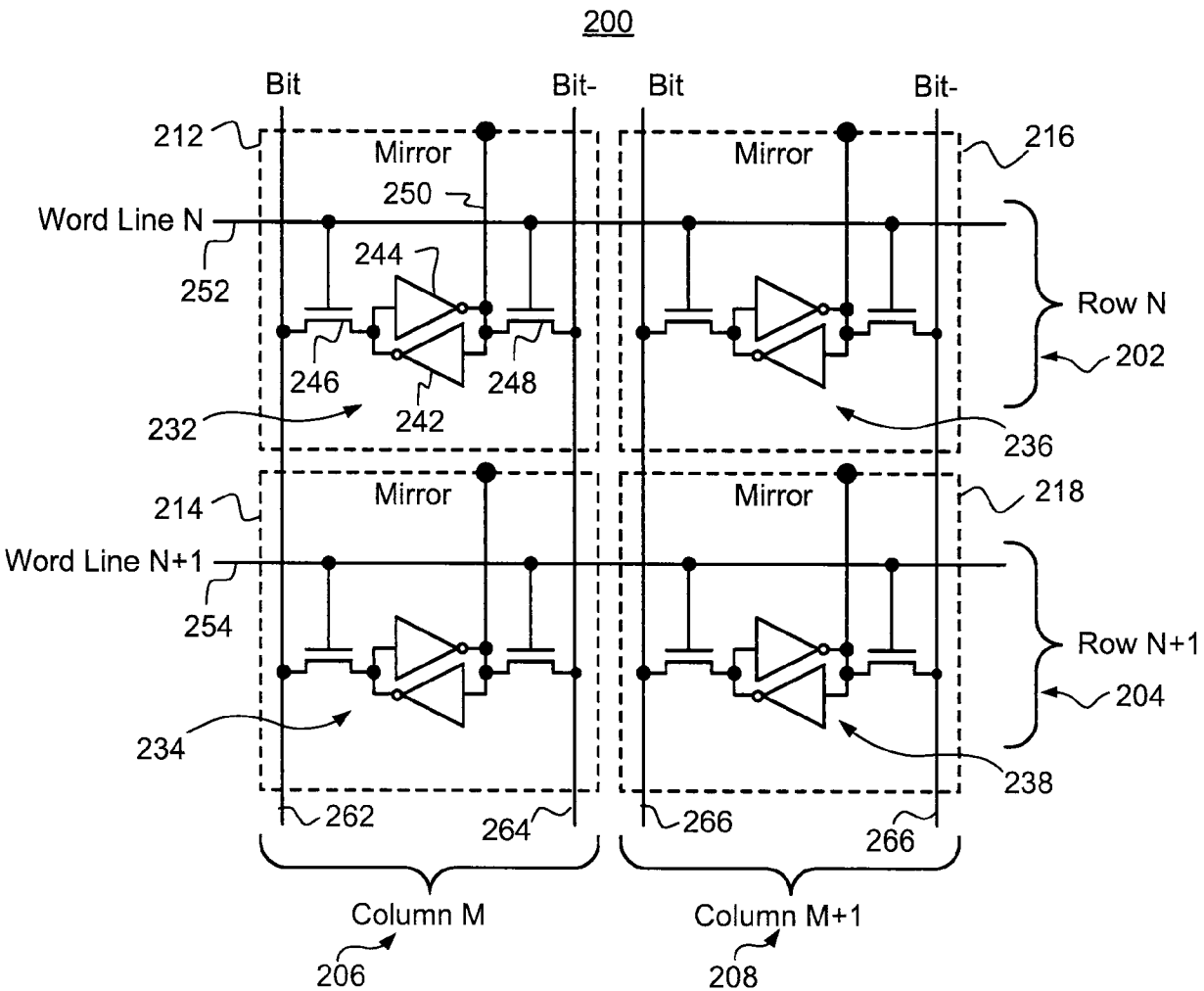
FIG. 2 is schematic diagram of part of an MRRAM.

FIG. 2 shows part of an MRRAM 200 having two (2) rows, rows 202 and 204, and two (2) columns, columns 206 and 208. An MRRAM bit is identical to any of a number of common memory bits with the addition that an MRRAM bit drives one or more electrodes that control a pixel. In this example there are four (4) mirror electrodes, i.e., mirror electrodes 212, 214, 216, 218 that are driven by four (4) SRAM bits, SRAM bits 232, 234, 236, and 238 respectively. Each SRAM bit is composed of two (2) inverters, inverters 242 and 244, and two bit input pass-transistors, input pass-transistors 246 and 248. An output of inverter 244 in MRRAM 200 connects via a line 250 to its respective mirror/electrode 212. MRRAM 200 includes two (2) word lines, word lines 252 and 254 and four (4) true and false bit lines, true and false bit lines 262, 264, 266, and 268, just like a common 6-T SRAM. In the case of an LCOS device, mirror electrodes 212, 214, 216, and 218 may comprise a reflective metal and/or a reflective coating and largely cover up circuitry underneath as indicated by the respective dotted lines for mirror electrodes 212, 214, 216, and 218 in FIG. 2.

In addition to normal SRAM operation the MRRAM in some embodiments of the present invention may include in the column drive circuitry to support "masked writes" as described in U.S. Pat. No. 7,071,908 to Guttag et al., the entire contents and disclosure of which are incorporated herein by reference.

It will be understood by those skilled in the art that there may be additional transistors for voltage "level shifting" hardware to obtain a different voltage other than the SRAM bit's voltage on the mirror as described in U.S. Pat. No. 7,071,908 to Guttag et al. One skilled in the art would recognize that this is only one of many ways to implement a memory bit that may be used as part of an MRRAM bit. Additionally, different display technologies might require both the true and false electrodes.

Figure 3:
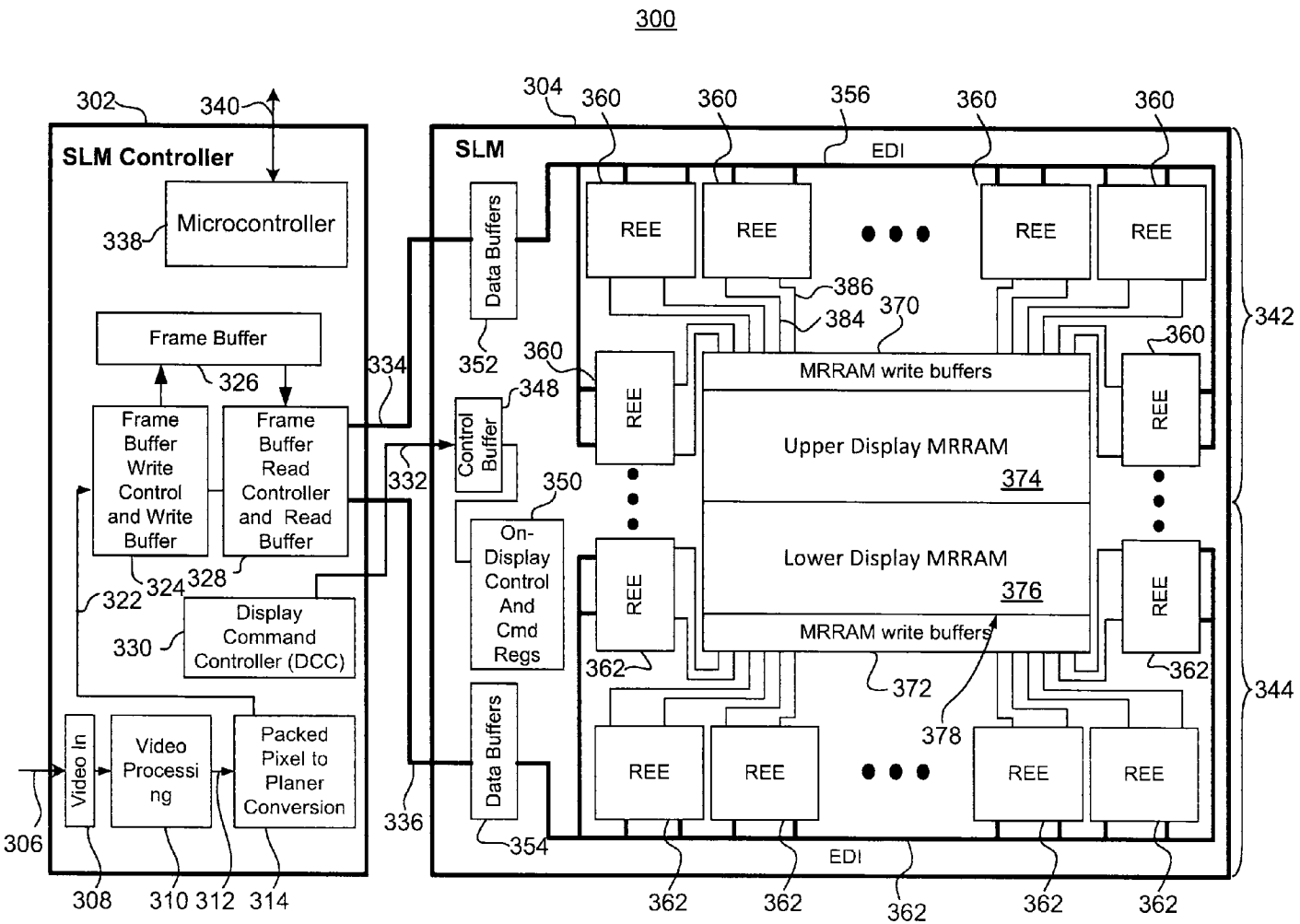
FIG. 3 is a block diagram showing an implementation of a display subsystem that includes a spatial light modulator (SLM) and a controller for the SLM in accordance with one embodiment of the present invention.

FIG. 3 shows one implementation of a display subsystem 300 according to one embodiment of the present invention that includes an SLM controller 302 and a SLM 304. For the embodiment shown in FIG. 3, there is an upper and lower set of data buffers. With the upper/lower split shown, the upper and lower halves of the device may be nearly identical.

Incoming video data 306 may be in any of a number of formats including but not limited to: digital red, green and blue (RGB); component video in Y, Cr, Cb format; composite video such as NTSC; cell phone oriented MIPI DSI; television video HDMI; or any other analog or digital video format. Incoming video data 306 may be compressed or uncompressed data. Incoming video data 306 enters SLM controller 302 through video input buffers 308.

Video processing 310 may perform any of a number of well-known video processing and/or enhancement operations. Video processing 310 may include processing the data in one format or color space into a format for displaying. Video processing 310 may include the decoding of compressed data. Video processing 310 may also include taking red, green and blue data, for example, and generating values for other multi-primary color fields such as yellow, magenta, cyan and/or white. Video processing 310 may also include any of a number of well-known adjustments of the incoming video data such gamma correction and color adjustment and correction, as well as adjustments related to characteristics of the liquid crystal and/or light sources. Output 312 of video processing 310 may be multiple bit values corresponding to a given color field.

In some embodiments video processing 310 may include converting the image data into a base-plus-sharpener (BPS) representation or any other format that may be used by the display device to generate the displayed image.

Output 312 of video processing 310 may be converted from a "packed pixel" representation by bit field planarizer 314 into a "planar" representation where bits are grouped by bit plane. It should be noted that while some embodiments of SLM 304 may require this "planarization," in some embodiments an SLM 304 may process "packed pixel" pixel data and thus not need bit field planarizer 314.

Processed incoming data 322 received by frame buffer write controller 324 from field planarizer 314 is stored by frame buffer write controller 324 in frame buffer 326. In one embodiment of the present invention, frame buffer 326 has at least enough memory to store two or more complete or partial frames. Note that while it is called a "frame buffer," in some embodiments it may or may not contain the contents of an entire frame of data at a given time.

In at least one embodiment of the present invention, frame buffer 326 comprises a plurality of circular buffers. One circular buffer is used for each bit plane, and/or for subsets of bit planes. The size of each of each circular buffer may be different, depending on how long a particular bit plane needs to be stored. The size of a particular buffer may be set so that, as the buffer is being filled with data from the next frame, the data for the current frame is freed up in time to allow the buffer to not overflow. The data for the current frame may be freed up once that particular bit plane is transmitted for the last time. This will happen at different times, depending on the bit plane.

As will be explained in more detail below, when using a base-plus-sharpener representation, the bit planes for the color base values may need to be sent more than once because there may be multiple fields for a color during a frame time. However, in some embodiments of the present invention, the sharpener bit planes may be sent once at the beginning of the frame. The circular buffers used for the sharpener bit planes may therefore be small compared to the circular buffers used for color base bit planes.

It will also be understood by one skill in the art, that while in the description below the base and sharpener are stored as a series of "bit planes," that other groupings that pack the data together may be used. For example, the base values may be packed as 8-bit values and stored one or more single circular buffers and 8-bit sharpeners may be stored, for example, in a separate circular buffer. In some embodiments, the use of bit planes facilitates addition buffer size savings due to the bit-plane-level granularity.

Frame buffer read controller 328 receives data from frame buffer 326 and sends the data to the SLM 304. Frame buffer read controller 328 keeps track of data that is needed from frame buffer 326 and generates the necessary addresses. Frame buffer read controller 328 may in some embodiments also generate the address of where the data is to be stored on SLM 304 or in other embodiments the address generation may be done on the SLM 304.

Display command controller (DCC) 330 generates display control information that is used by the SLM 304, as will be discussed below. The control information from the DCC 330 may be sent on a separate signal line 332. Although signal line 332 in FIG. 3 is shown as a single line for simplicity of illustrations, there may be multiple signal lines 332 from the DCC 330. Alternatively, the control information may be sent on data busses 334 and 336 intermixed with the data information or on some other set of signal lines.

Microcontroller 338 is a programmable microcontroller as is well understood in the art. It is capable of running programs stored in ROM, Flash, RAM or other memory ether inside the microcontroller itself or external to it (not shown). Microcontroller 338 may have various inputs and outputs both from functions within SLM controller 302 and external inputs and outputs via I/O lines 340, as well as analog to digital and/or digital to analog converters and other functionally as is well understood in the art. For example, video processing 310 may collect statistical data on the video data coming in and send that information to microcontroller 338, which in turn may process it to control an external I/O that would affect the drive of an LED. External light sensors may send a signal via I/O lines 340 to the microcontroller 338, and after processing the signal in turn may change some parameters that control SLM 304.

In some embodiments of the present invention, depending on the technology available, part or all of various functions of SLM controller 302 may be implemented (integrated) on the SLM 304. Although SLM controller 302 of FIG. 3 only shows the basic functionality, in some embodiments of the present invention, other functionality may be incorporated onto the controller including but not limited to digital to analog converters, analog to digital converters, and voltage level changing hardware.

Data busses 334 and 336 are used to send the data that has been read from frame buffer 326 by frame buffer read controller 328 to SLM 304. The display process in display subsystem 300 is split in half into upper half 342 and lower half 344 of SLM 304. A control buffer 348 acts as the interface to bring control information into SLM 304. The control information is sent to the part of on-display controller 350. The type of control information sent is discussed in more detail below. Data lines/busses 334 and 336 connect to data buffers 352 and 354, respectively, in SLM 304. SLM 304 also includes upper and lower ERAM Data In (EDI) busses 356 and 358, respectively; upper and lower reconstructor element with ERAM (REE) 360 and 362, respectively; upper and lower MRRAM write buffers 370 and 372, respectively; and upper and lower display pixel mirrors 374 and 376, respectively, of an active display 378. Each REE 360 or 362 includes an ERAM that acts as scratch memory and processing hardware, and will be described in more detail below. Signal lines 384 and 386 connect each upper REE 360 to upper MRRAM write buffers 370 and each lower REE 362 to lower MRRAM write buffers 372. Results from REEs 360 are sent to the upper MRRAM write buffers 370, which in turn drive upper display pixel mirror 374. Results from REEs 362 are sent to lower MRRAM write buffers 372, which in turn drive lower MRRAM array 376.

Although in the embodiment of the present invention shown in FIG. 3 various features of the SLM such as the data lines/busses, display pixel mirrors, MRRAM write buffers, etc., are shown as being oriented as upper and lower, other orientations of these features are also possible. For example, these features of the SLM may be oriented as being left and right.

Shown in the FIG. 3 are signal lines 384 and 386 between each REE and the upper or lower MRRAM buffers, but this is only for simplicity of illustration. For example, in some embodiments, there may be fewer signal lines that are time multiplexed. As will be explained later, while the drawing shows each REE individually, in various physical embodiments, multiple REEs 360 and 362 may be grouped together.

An example operation of display system 300 will now be explained. Video data 306 enters SLM controller 302 and various types of processing of the data may be optionally performed by video processing 310. This processing may include but is not limited to conversion from one display format to another, decompression if the video data is in a compressed format, color correction, image scaling, generating "white" fields and other multi-primary color fields, and image enhancement.

In the embodiment of the present invention shown in FIG. 3, the output of video processing 310 is in a "packed" pixel format. Bit field planarizer 314 converts packed pixel data into a series of bit planes wherein multiple bits for a single bit of a single color are put into groups of bits. It should be noted that in some embodiments, the SLM may be capable of using "pack" data and so the packed pixel to field planarizer 314 may not be necessary.

For a field sequential color system, video data 306 is generally received by video processing 310 in packed pixel format at the frame rate. Generally this data is being received at a rate that is slower than the "field rate," and the format of the data is not well suited to being displayed on a field sequential color system. Frame buffer write control 324 stores the output of bit field planarizer 314 in frame buffer 326. While frame buffer 326 is called a "frame buffer," it may be able to store more than or less than what is required for a single frame.

Frame buffer read controller 328 reads data from frame buffer 326 for sending to SLM 304 and (2) sending control information on lines 332 to SLM 304. In some embodiments it may be advantageous to read the data out of frame buffer 326 in an order that helps reduce the total storage required for ERAMs inside REEs 360 and 362.

DCC 330 generates and sends pixel control codes (PCC) to on-display controller 346. While a dedicated DCC may be used, the PCCs may be computed by a processor or other means.

DCC 330 also controls the overall coordination and control of frame buffer write control 324 and frame buffer read control 328. It also may exchange data and control information with other controllers within the SLM controller 302 including but not limited to microcontroller 338, frame buffer write controller 324 and frame buffer read controller 328.

Frame buffer read controller 328 has associated with it data buffers that store data from frame buffer 326. Data is sent via data bus 334 and data buffers 352 EDI (line) bus 356 to REEs 360. Data is also sent via data bus 336 and buffer 354 on EDI line (bus) 358 to REEs 362. Pixel data information is loaded into the ERAM inside associated REEs 360 or 362 and then REEs 360 or 362 conducts a series of operations on the data to control the pulse width(s). Each REE 360 or 362 or a group of REEs 360 or 362 computes results that may be used to turn one or more pixels in one line of active display 378 on or off either conditionally or unconditionally. These results are sent via signal lines 386 that connect REEs 360 to upper MRRAM write buffers 370 or connect REEs 362 to lower MRRAM write buffers 372.

Although the frame buffer is shown on the same semiconductor substrate as the rest of the controller in FIG. 3 in some embodiments of the present invention, it may be more economical to use a separate high density memory device for the frame buffer.

In some embodiments of the present invention, part or all of various functions of the frame buffer read controller may be implemented on the SLM, depending on the technology available. In some embodiments of the present invention, all the control logic other than the frame buffer may be part of the SLM, which would result in there being two physical devices; the frame buffer RAM and the SLM. In some embodiments all the control and frame buffer RAM may be integrated into the SLM. It should also be understood that the controller of FIG. 3 only shows the basic functionality and it would be possible to incorporate more or less functionality onto the controller.

In some embodiments of the present invention, the MRRAM write buffers may support conditional/masked writing where signal lines 386 act to send what are in effect write enable signals rather than data per say. These Mirror RAM buffers may act as described in U.S. Pat. No. 7,071,908 to Guttag et al., the entire contents and disclosure of which is incorporated herein by reference. The MRRAM differs from a common RAM (SRAM, DRAM, or other RAM) in that the output of the RAM directly or indirectly drives a pixel output. In the case of liquid crystal on silicon (LCOS), the pixel output consists of a mirror that acts as an electrode to control liquid crystal.

In FIG. 3 the MRRAM is shown as being split into two halves/sections, however in some embodiments of the present invention the MRRAM may be split into thirds, quarters, etc., either from top to bottom, left to right, or a combination of top to bottom and left to right. For simplicity, the remaining discussion will primarily discuss embodiments where the MRRAM is either split into two halves top and bottom or not split, but it should be understood that the MRRAM of the present invention may be split into other arrangements and that the processes described below may be adapted to be used with these other arrangements of the MRRAM. With any type of split, the split parts of the MRRAM may share common control signals or work independently of each other with independent control from controller. The on-display controller of the SLM may be tightly controlled by the frame buffer wherein the on-display controller is constantly given control information by the frame buffer read controller or the on-display controller may have more functionality that allows the on-display controller to run largely independently.

Figure 4:
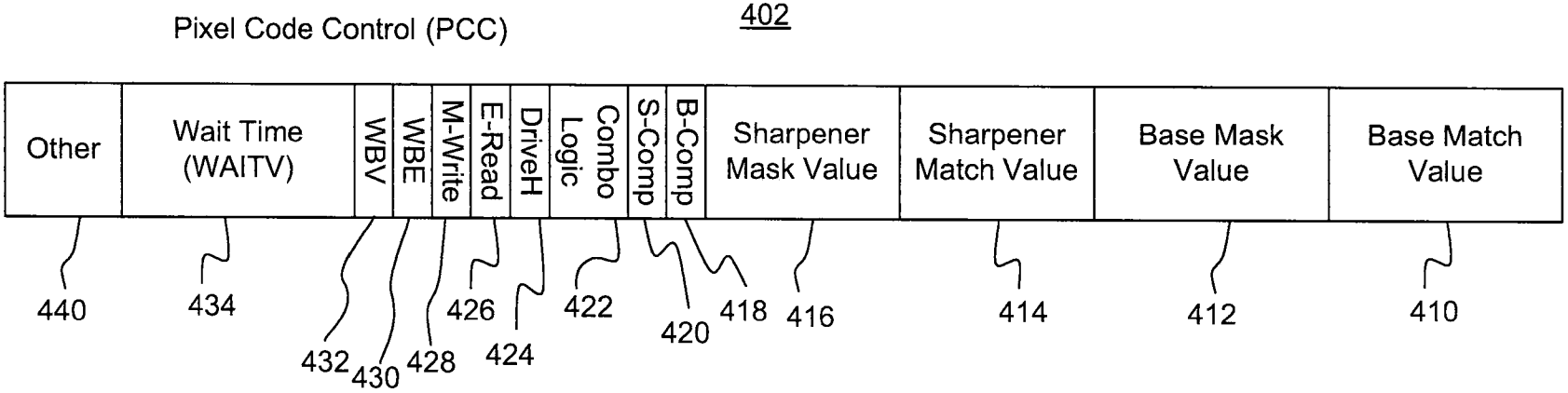
FIG. 4 is a diagram showing a pixel control code word held by a command register in accordance with one embodiment of the present invention.

FIG. 4 shows a simple pixel control code (PCC) word 402 according to at least one embodiment of the present invention. It should be understood that this is only illustrative of one possible example of a PCC word and there may be more or fewer fields than shown in FIG. 4. PCC word 402 shown in FIG. 4 includes bits for a base match value (BMCHV) 410, a base mask (BMSK) 412, a sharpener match value (SMCHV) 414, and a sharpener mask (SMSK) 416.

PCC word 402 also includes base comparison selection (B-COMP) 418, sharpener comparison selection (S-COMP) 420, and combination logic selection 422, which determines how the result of the base comparison and the sharpener comparison are combined to control the respective MRRAM pixel.

Base match value 410 and sharpener match value 414 are used to compare against the base value and sharpener value associated with each pixel, stored in ERAM. These match values may be broadcast to the many PPEs to have them compare the match values against many pixels at a time and if there is a match, to control the corresponding pixels.

BMSK 412 and SMSK 416 are used to selectively ignore some of the bits when performing the comparisons.

B-Comp 418 and S-Comp 420 are used to determine what kind of comparison is performed. Based on the particular embodiment, various types of comparisons may be needed, such as equal-to, not-equal-to, less-than, less-than-or-equal-to, greater-than, greater-than-or-equal-to, or other type of comparison. The PCC also includes combination logic selection 422, for determining how the result of the base match and the result of the sharpener match are combined to produce the final match result.

A feature of the PPE that will be discussed below is that PPE supports matches between variable numbers of bits. The PMSK may be an encoded value that gets turned into a mask, or it may have an individual bit for every bit position in a pixel value and/or match value.

PCC word 402 may also include signals such as drive high (DRIVEH) 424, which indicates whether a pixel will be driven high (DRIVEH=1) or low (DRIVEH=0) if the final match result is true. E-READ 426 indicates whether the ERAM needs to be read for the given operation. M-Write 428 indicates whether the MRRAM is to be written to as a result of the given operation. Write back enable (WBE) bit 430 indicates whether the ERAM is to be re-written, for example, based on the result of the match operation. Write back value (WBV) bit 432 gives the value that is written back if WBE bit 430 is active and other conditions are met.

It will be understood by those skilled in the art that liquid crystal displays often require what is known as "DC Balancing." With digital drive of LCOS there is an ITO electrical coating on the cover glass that forms a field plate. DC balancing may be achieved by inverting the voltage on the ITO and coincidentally inverting the voltage on the mirror/electrode for each pixel. The inversion on the pixel may be accomplished by hardware inside the pixel or it may be accomplished by writing an inverted value to a pixel. Because of this need for DC balancing and ITO changing, DRIVEH signal being a logical 1 would cause the pixel to go high, or being a logical 0 would cause the pixel to drive low. In some embodiments of the present invention there may be logic that will cause the DRIVEH to be inverted in coordination with the state of the ITO voltage.

Wait time value (WAITV) 434 is a value related to the amount of time to the next command. This may be used to space apart compare operations in time and thus affect the time weighting of a given pulse width. WAITV 434 has enough bits to provide the desired precision of the pulse widths. In some embodiments, the wait value is a "differential" timing indicating the amount of time to wait, as will be understood by one skilled in the art that this is only one of many ways to specify control timing. The wait values may be used to variably/programmably space out the execution of events/controls by the SLM.

PCC word 402 also includes other control bits 440 for other control functions. There may be many other functions or controls that are used to determine the drive waveforms for each pixel.

It will be understood by those skilled in the art that there are many equivalent ways to specify the values in the command fields. Putting these values in a single command is just one way to implement the desired functionality.

Wait time value (WAITV) 434 is a value related to the amount of time to the next command WAITV 434 is used to space apart compare operations in time and thus affect the time weighting of a given pulse width. WAITV 434 has enough bits to provide the desired precision of the pulse widths. The wait value is a "differential" timing indicating the amount of time to wait, and this is only one of many ways to specify control timing in the present invention. The wait values may be used to variably/programmably space out the execution of events/controls by the SLM.

PCC word 402, as an example, is sent from DCC 330 from FIG. 3 to on-display control command registers 350 of FIG. 3.

PCC word 402 also includes other control bits 440 for other control functions. There may be many other functions or controls as well as multiple match values and multiple PE Mask values, as will be described in more detail below.

There are many equivalent ways to specify the values in the command fields. Putting these values in a single command is just one way to implement the desired functionality.

Figure 5:
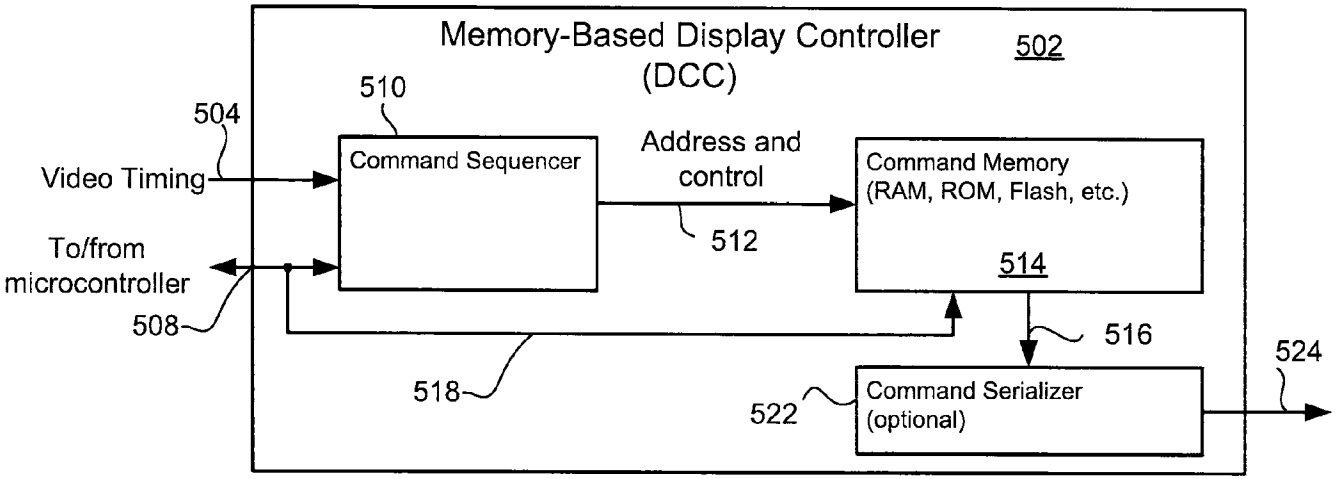
FIG. 5 is a diagram showing the operation of a memory-based display controller in accordance with one embodiment of the present invention.

FIG. 5 shows an example of a memory-based display command controller (DCC) 502 according to one embodiment of the present invention that may be used as DCC 330 of FIG. 3. Memory-based DCC 502 may be used to generate all or some of the control signals of PCC word 402 of FIG. 4 sent to on-display control command registers 350 of FIG. 3.

In memory-based DCC 502, inputs and outputs, such as video timing on line 504 and microcontroller inputs/output on line 508, send timing and other control information to command sequencer 510. The purpose of DCC 502 is to generate the controls in a sequence that controls the SLM (not shown in FIG. 5). Command sequencer 510 in turn sends addresses and control on a line(s) 512 to a command memory 514 that may be RAM, ROM, flash memory, or some other memory type used to hold programmable control codes that are fetched from said memory and output on signal line(s) 516. Command memory 514 may be loaded directly by the microcontroller via line(s) 518 or indirectly via inputs/output line(s) 508, command sequencer 510 and line(s) 512. The use of a command memory 514 results in very flexible/programmable control codes and the fields within the control codes being output on signal lines 516. The control codes on signal lines 516 along with other information may be optionally serialized by a command serializer 522 and sent out of DCC 502 on line(s) 524.

Figure 6:
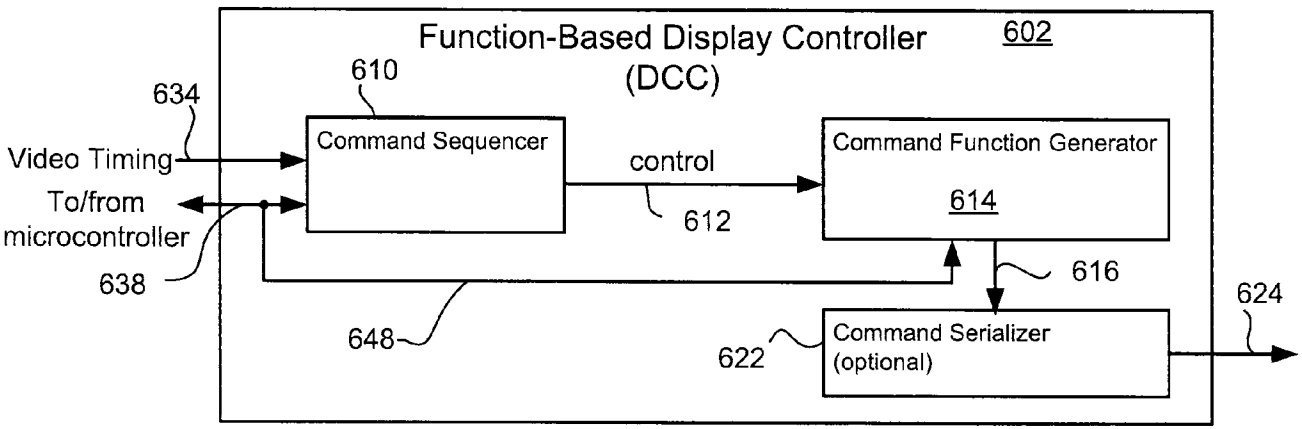
FIG. 6 is a diagram showing the operation of a function-based display controller in accordance with one embodiment of the present invention.

FIG. 6 shows an example of a function-based display command controller (DCC) 602 according to one embodiment of the present invention that may be used as DCC 330 of FIG. 3. Function-based DCC 602 may be used to generate all or some of the control signals which make up the PCC 402 of FIG. 4. Function-based DCC 602 differs slightly from memory-based DCC 502 in that instead of using a loadable memory to generate the control signals sent to on-display control command registers 350, DCC 602 has a command sequencer 610 that generates controls on line(s) 612 to drive a function generator 614. Function generator 614 uses a set of parameters that may be loaded or hardwired to generate control codes on lines 616. The control codes may optionally be serialized by a command serializer 622 or by some other hardware and/or software to be output on lines 624. Inputs and outputs, such as video timing on line 634 and microcontroller inputs/output on line 638, send timing and other control information to command sequencer 610. Function generator 614 may be loaded directly by the microcontroller via line(s) 648 or indirectly via inputs/output line(s) 638, command sequencer 610 and line(s) 612.

DCC 502 and DCC 602 are only examples of implementations of a DCC of the present invention. The functionality shown in FIGS. 5 and 6 may be distributed in various physical places in the system.

A DCC may also have some of the parameters generated by table lookups and other parts generated by function generators. Some parts of the control codes may be used as inputs to the sequencer. For example, the "wait value" may be used to delay the generation of the next control code.

Both DCCs 502 and 602 support generating control codes including but not limited to match values that are not simple counts or fixed values but rather are in some way "programmable."

The pixel control signals are created, with masked comparisons being performed at match stages. Memory on the SLM is freed up and reallocated. This is enabled by the use of an enhanced PPE as will be described in more detail below.

Figure 7:
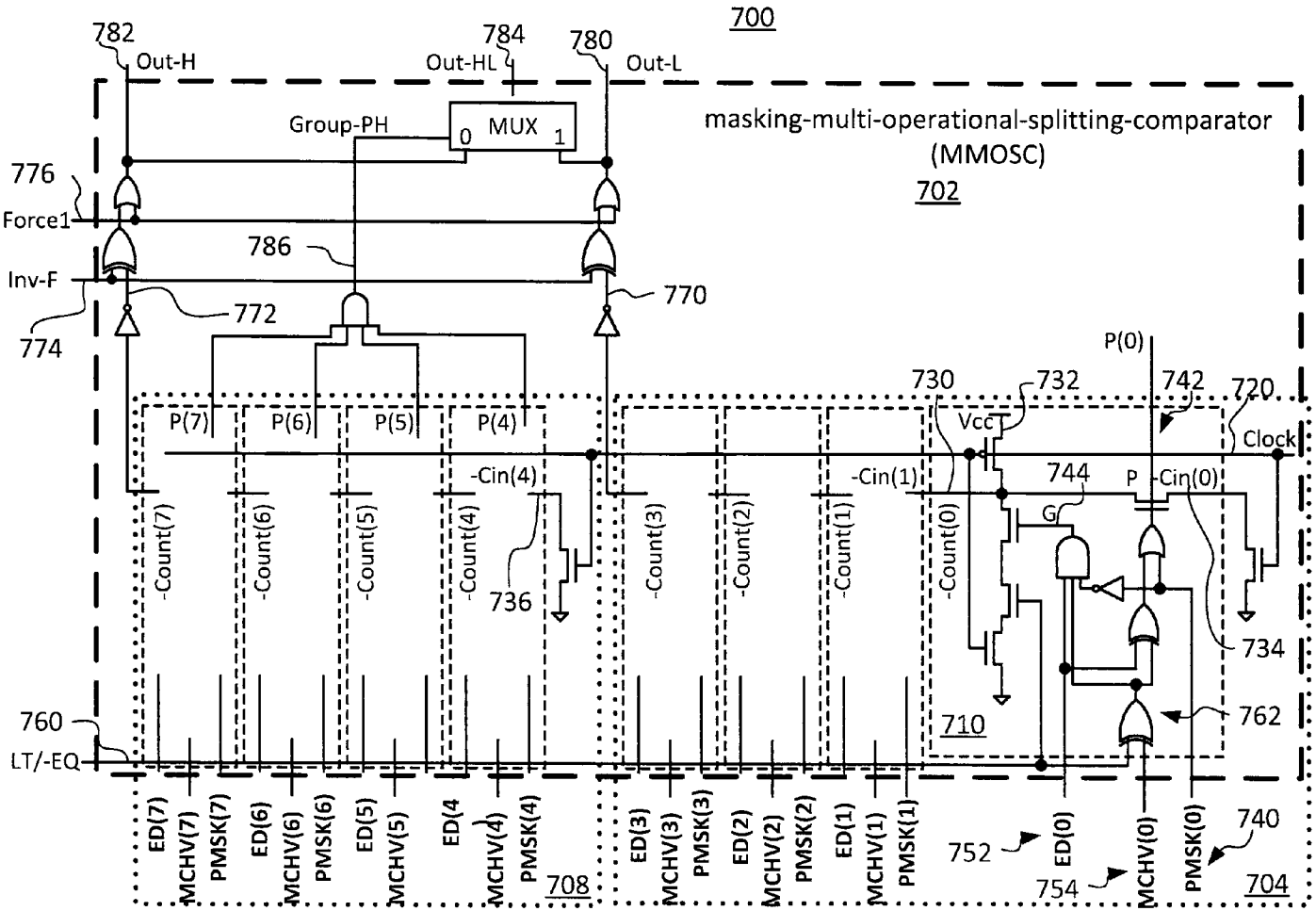
FIG. 7 shows a diagram of a masking-multi-operational-splitting comparator in accordance with one embodiment of the present invention.

FIG. 7 shows an enhanced parallel processing element (PPE) 700. PPE 700 comprises a "masking-multi-operational-splitting comparator" (MMOSC) 702. MMOSC 702 is a "masking-comparator," a "multi-operational comparator," and a "spitting-comparator," in a single piece of hardware. It is designed to perform both logical and arithmetic operations. The MMOSC 702 is a "splitting comparator" with a lower unit 704 and upper unit 708. This spitting as shown in this embodiment facilitates processing two 4-bit values or a single 8-bit value in a single cycle. It will be understood by one skilled in the art that splitting the comparator in a different fashion may accommodate quantities with different bit-widths.

Logic 710 of bit 0 of the comparator uses a clock 720 that when low causes the carry path including count (0) 730 (which is also the carry-in for bit 1) to be precharged via pull-up 732. When the clock 720 goes high, a carry in (active low) is injected at –cin(0) 734 and –cin(4) 736, which causes the lower unit 704 and upper unit 708 to start the comparison. A PMSK input 740 causes the corresponding propagate signal 742 to go to logical 1=on, and the corresponding generate signals 744 to go to logical 0=off. Therefore if a given PMSK 740 is applied, that bit will not cause a "carry generate" and will propagate any carry-in to its carry out 730, which is the next most significant bit's carry in, and in doing so masks the two input bits, i.e., ERAM Data (ED) input bit 752 and input match value bit (MCHV) 754. Each ED input bit 752 may be a "pixel-control-value" and come from the stored value in the ERAM (not shown). In the case of BPS, described below, this may be either a bit of the sharpener or the base. The input match value of MCHV 754 is a value that is being compared against and would be the base or sharpener match value, depending on which operation the unit is performing The value of the PMSK input 740 affects the operation of the comparator for the corresponding bit position, whether an arithmetic (less-than) compare or a logical (equal-to) compare is performed. Any bit position that is "masked" will not affect the outcome, regardless of the state of MCHV 754 or ED 752.

The LT/-EQ (less than if high and equal to if low) signal 760 selects whether the comparator 702 does a less-than compare or an equal-to compare. This ability to perform different operations using a single comparator 702 is what makes it a "multi-operational comparator."

For a less-than compare, the LT/-EQ signal 760 causes the XOR gates 762 to invert the MCHV 754 inputs and also enables the "generate" signals 744 to control count 730. For an equal-to compare, the LT/-EQ signal 760 is low, which disables the "generate" signal 744 and causes the MCHV to not be inverted, which will in turn cause an equal-to comparison to be performed.

The carry ripple paths are "active low" and final carry out of 704 is inverted to give lower output 770, and the final carry out of 708 is inverted to give the upper output 772. Invert function signal 774 inverts the output to allow a greater-than-or-equal-to compare or a not-equal-to compare based on the state of signal 760. Forcel signal 776 forces both output low line 780 and output high line 782 and output high-low line 784 to one/active regardless of any other logic. The four propagate outputs are logically ANDed together to form group propagate signal 786. If group propagate 786 is high then high-low output 784 will be the output of lower unit 704. If the group propagate is low, then high-low output 784 will be the output of high unit 704.

Taking the signals 760, 774 and 776 together, they control the function performed by PPE 700 and will call the "function code" hereafter. This function code is determined based on the B-Comp 418 and S-Comp 420 signals from the PCC word 402.

MMOSC 702 may generate two 4-bit compare results on output low line 780 and output high line 782 or optionally a single 8-bit compare on line 784. This ability to split the 8-bit comparator into two 4-bit comparators makes it a "splitable comparator." The multi-operational compare functions include less-than, equal-to, greater-than-or-equal-to, not-equal-to and 1/true. The comparison is made between the ED 752 and match values 754. Any of the bits of the input may be masked/ignored under control of PMSK input 740.

As will be well understood by those skilled in the art, FIG. 7 is only one of many ways to design a comparator unit 702. Also, other functions may be added that include other types of comparisons or arithmetic operations which calculate different results without departing from the scope of the present invention.

Figure 8:
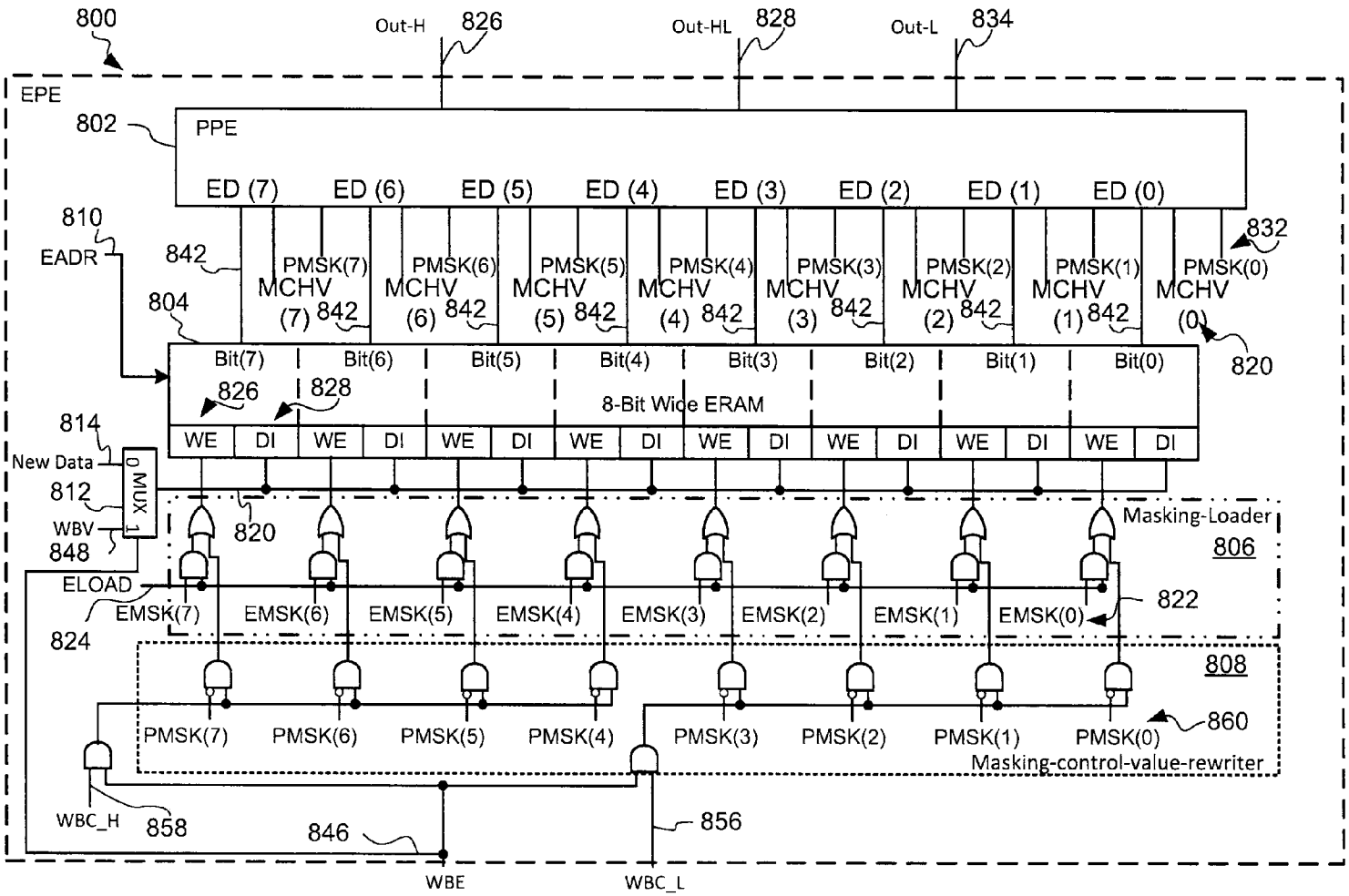
FIG. 8 shows a diagram of ERAM with masking loader and masking-control-value rewriter in accordance with one embodiment of the present invention.

FIG. 8 show an "ERAM Parallel Processing Element" (EPE) 800, which connects a PPE 802 (such as PPE 700 in FIG. 7) to the ERAM 804 and has ERAM masking loader 806 and masking-control-value rewriter (MCVR) 808.

In operation, ERAM 804 is provided an ERAM address (EADR) 810 to address the ERAM for both read and write operations. In typical operation, the read data will go to the PPE 802.

The hardware shown in FIG. 8 supports two types of write operations, each with their own masking capability. In the case of new data coming into the panel to be saved in ERAM, multiplexer (MUX) 812 selects the new data input 814 to be in the data line 820. The ERAM mask 822 generally only has one like active/high/on at a time and in combination with the ERAM load signal 824 turns on a corresponding bit's write enable 826 to cause the data on line 820 to be written to one of the ERAM data inputs 828.

Bits read out of the ERAM 804 are sent of PPE 802 for comparison with MCHV 830 for bits not masked by PMSK bits 832. The result of the comparison generates a low order bit output 834, a high order bits output 836, and an output that combines high and lower order bits output 838 as with PPE 700 (FIG. 7).

ERAM 804 has per bit write enables 826 and data inputs 828. Masking loader 806 allows for a single selected bit position in the ERAM to be loaded with new incoming data as described above with respect to FIG. 7.

Masking-control-value rewriter (MCVR) 808 supports writing to the ERAM based on the results of a previous compare operation. Write back enable (WBE) 846 selects the write back value (WBV) 848 instead of new data in 814 to be sent out of MUX 812 to be sent to all the ERAM data in lines 842. Additionally WBE 846 is logically ANDed with write back control low 856 and write back control high 858, which controls whether a set of ERAM locations selected by EADR 810 are to be written over with the new value of the WBV 848. The P-Mask bits 860, which are in this embodiment, identical to the P-Mask bits 832 or a delayed version thereof, control which bits are enabled for writing back. The masking logic is such that if P-Mask bits 832 are the same as P-Mask bits 860, any bit is masked in the comparison; it will also be masked (not written) if a write back is called for by write back enable 846.

While FIG. 8 shows MCVR 808 combined with a single write-back-value 848, it will be understood by those skilled in the art that this logic may be used to support writing back other values, including but not limited to some value that may be computed by a PPE with other arithmetic capability.

FIG. 9 shows REE 900, which comprises two of the EPEs 902 and 904 (for example, each may be EPE 800 of FIG. 8) and logic to combine their results to control a pair of MRRAM columns 906 and 907. MRRAM columns 906 and 907 in this embodiment are one of many pairs of columns of MRRAM. In this embodiment, all MRRAM columns share a common MRRAM address 908 Although in FIG. 9 EPE 902 is labeled as the "A" EPE and EPE 904 is labeled as the "B" EPE, these labels are only for ease of description and illustration. EPE 902 and EPE 904 are functionally equivalent. Similarly, MRRAM column 906 is labeled as the "left" MRRAM column and MRRAM column 907 is labeled is the "right" MRRAM column, but these labels are only to aid in the description and illustration and do not necessarily have physical significance.

Full_A signal 948, when high, causes EPE 902 to operate in full-width mode and EPE 904 to operate in split mode, and if 948 is low, EPE 902 operates in split mode and EPE 904 operates in full-width mode. In some embodiments of the present invention, the "full-width" mode correspond to 8-bit compares and in the "split" mode corresponds to two 4-bit compares.

The inputs to EPE 902 comprise a function code 910, ERAM address 912, write back control high side 914, write back enable 916, match value 918, PPE mask 920 and write back control low side 922. EPE 902 has high output 924, combined high and low output 926, and low output 928.

The inputs to EPE 904 comprise a function code 930, ERAM address 932, write back control high side 933, write back enable 934, match value 936, PPE mask 938 and write back control low side 939. EPE 904 has high output 940, combined high and low output 942, and low output 944.

Left-right logic 946 takes outputs 924, 926, 928, 940, 942, and 944 and combines them in such a way as to control left MRRAM column 906 and right MRRAM column 907.

If signal Full_A 948 is high, MUX 950 and MUX 952 will pass combined high and low output 926 to both MUX outputs 956 and 958. Alternately, if the signal Full_A 948 is low, then MUX output 956 will be set to Out_H 924 and MUX output 958 will be set to Out_L 928. MUX output 956 is fed to a latch 960 that stores it and drives write back control high side 914. MUX output 958 is fed to a latch 961 that stores it and drives write back control low side 922.

Full_B signal 962 is generated by inverting Full_A signal 948. If signal Full_B 962 is high, MUX 963 and MUX 964 will pass combined high and low output 942 to the both MUX outputs 966 and 968. Alternately, if the signal Full_B 962 is low then MUX output 966 will be set to high output 940 and MUX output 968 will be set to low output 944. MUX output 966 is fed to a latch 970 that stores it and drives write back control high side 933. MUX output 968 is fed to a latch 971 that stores it and drives write back control low side 939.

Since Full_B 962 is the inverse of Full_A 948, one of either EPE 902 or EPE 904 will be configured in "full-width" mode and the other in "split" mode. In this embodiment, one 8-bit result from one EPE will be combined with two 4-bit results from the other EPE to form signals to control left MRRAM column 906 and right MRRAM column 907.

AND Gate 972 logically combines output 956 from EPE 902 with output 966 of EPE 904 to generate left MRRAM enable 973. Similarly AND gate 974 logically combines output 958 and output 968 to form right MRRAM enable 976.

Left MRRAM enable 973 is ANDed via AND gate 978 with MRRAM LOAD 980 to control the write enable (WE) 982 for left MRRAM column 906. This causes the common data value on drive high signal 984 to be written at the MRRAM address given by MRRAM address 908. Similarly right MRRAM enable 976 and MRRAM load 980 via AND gate 988 control the write enable 990 for right MRRAM column 907. Left data input 992 is driven by DriveH 984. Right. data input 996 is also driven by DriveH 984.

While EPE 902 and EPE 904 may be identical in terms of hardware, they may be performing different operations with different splits on different data. Left/Right logic 946 takes the outputs of EPEs 902 and 904 and combines them to control the left and right columns of a pair of MRRAM columns.

It will be understood by those skilled in the art that the functionality of FIG. 9 may be implemented in different ways. It is also anticipated that as transistors continue to become less expensive, the functionality of EPEs 902 and 904 may become more complex and support more functions and output multiple bit results and the Left/Right logic may support more complex operations such as additions and subtraction.

While FIG. 9 shows a pair of MRAM columns 906 and 907 being controlled by a pair of EPEs 902 and 904, it will be understood by those skilled in the art that the concepts presented here may be used to support more than a pair of columns. The number of EPEs required does not have to necessarily equal the number of columns that are grouped. It will be understood by one skilled in the art that it would be possible to control two adjacent columns with more or less EPEs depending on the relative speed of the operation required and the amount of logic used. For example, only a single EPE running twice may perform the tasks of the two EPEs shown in FIG. 9.

Other embodiments of this invention may support switching elements to allow REE 900 to connect to different columns of MRRAM as opposed to connecting to a specific column as shown in FIG. 9. This switching arrangement may facilitate using a single REE 900 to control more than two columns of MRRAM and/or to facilitate having redundancy to switch in a spare "good" REE 900 for a "bad" REE 900 to improve the device yield.

EPEs may be arranged in groups or blocks that share a common set of address controls for the ERAM. FIG. 9 is meant to convey the functionality and not how the hardware will necessarily be configured physically on the device. It will be understood by one skilled in the art that since the ERAMs within many EPEs share a common address, that may be more efficient in terms of the device layout to have a single physical memory array that in effect acts as multiple ERAMs 804 that share common address and control decodes.

Figure 10:
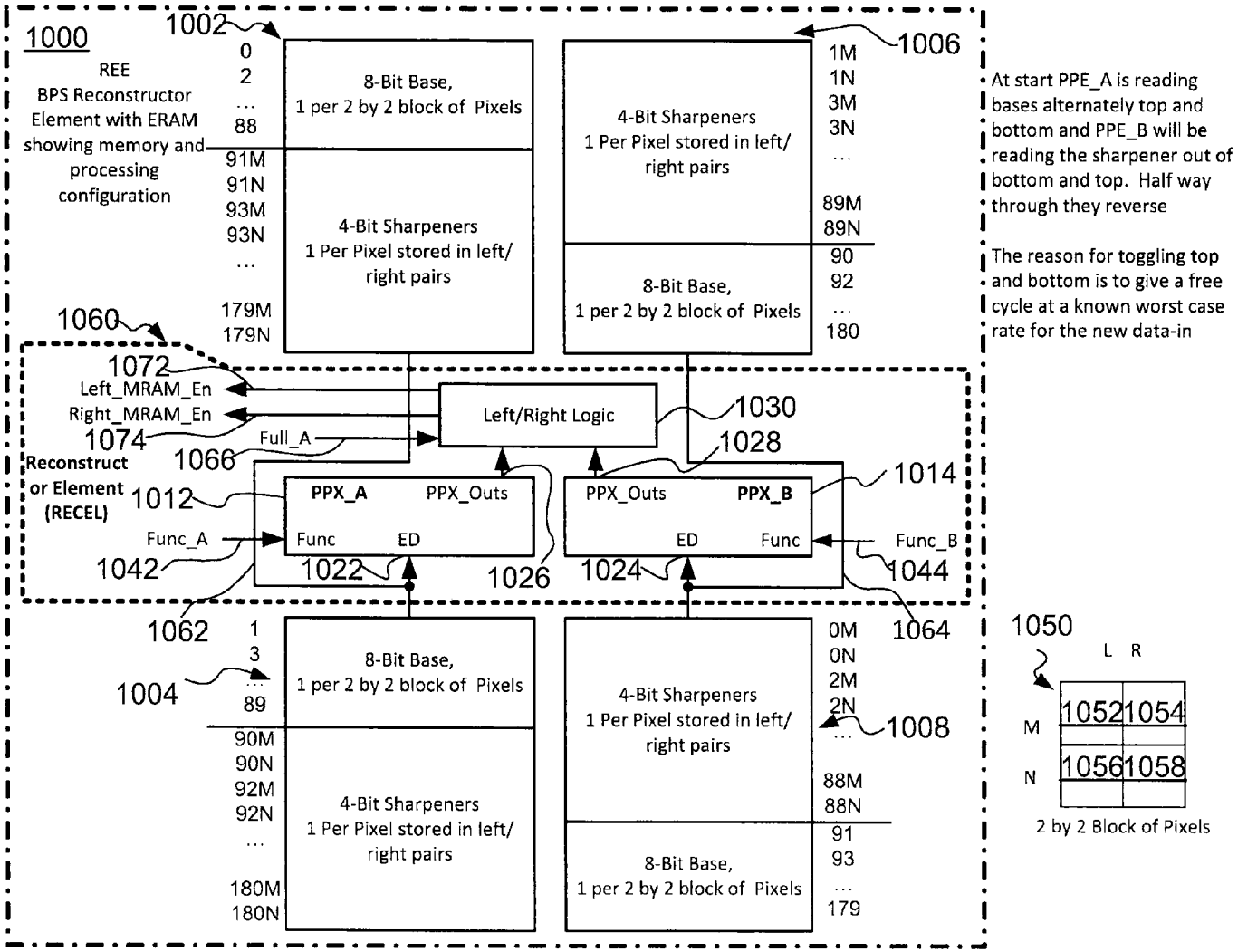
FIG. 10 shows more detail of an REE used in a base-plus-sharpener (BPS)-based display in accordance with one embodiment of the present invention.

FIG. 10 shows an embodiment that has an alternative configuration of essentially the same hardware functionality of FIG. 9 but where the ERAM is explicitly broken out of the EPEs. There are four banks of ERAM, i.e., ERAM bank 1002, ERAM bank 1004, ERAM bank 1006, and ERAM bank 1008. Shown are two EPEs such as EPEs 902 and 904 (FIG. 9) except that the ERAM is external to the EPEs and therefore these will be referred to as "PPX" or PPE without ERAM. Shown are PPX_A 1012 and PPX_B 1014, which are functionally the same as EPEs 902 and 904 respectively except for not having ERAM. The ERAM are broken out to show how they are configured relative to the rest of the functionality of the EPEs. ERAM bank 1002 and ERAM bank 1004 may be connected to ERAM data input 1022 of PPX_A 1012 and ERAM bank 1006 and ERAM bank 1008 may be connected to ERAM data input 1024 of PPX_B 1014. PPX_A 1012 has outputs 1026 which may be the Out_H 924, Out HL 926 and Out_L 928 of FIG. 9. Similarly PPX_B 1014 has outputs 1028 which may be high output 940, combined high and low output 942 and low output 944 of FIG. 9. PPX outputs 1026 and 1028 go to left/right logic 1030 (as in FIG. 9 logic 946). Left/right Logic 1030, such as left/right logic 946 (FIG. 9) has an input Full_A 1066 that controls whether the PPX_A 1012 works in "full" or dual 4-bit "split" mode. If PPX_1012 is in full mode and PPXB 1014 is treated as being in "split mode" in this embodiment. If Full_A 1066 is low, then PPX_A 1012 is in "split" mode and PPX_B is in "full" mode. Function codes 1042 and 1044 control the functions performed by PPXs 1012 and 1014 respectively. Not shown in FIG. 10 is the write back paths and many other details that were shown in FIG. 8 and FIG. 9.

FIG. 10 includes a diagram 1050 which shows one way to treat groups of physical pixel locations 1052, 1054, 1056, and 1058 for use in some embodiments of the current invention. In the embodiment shown there is one 8-bit "base" per 2 by 2 group of pixels and there is one 4-bit "sharpener" per each pixel or four 4-bit sharpeners per 2 by 2 group of pixels. Thus for each 2 by 2 block of pixels there are 1×8 bits of "base" and 4×4=16 bits of sharpeners. There are two "left" pixels and two "right pixels and two pixels in row M and two pixels in Row N of each block of pixels. The net result is that there are twice as many bits of sharpener than there are bases. For simplification of in using the memory, two 4-bit sharpeners are packed into an 8-bit byte so that the access of each bank is simply 8 bits. Packing the sharpeners in this manner may also facilitate operating on them by the PPXs 1012 or 1014 when in "split" mode. In the memory organization shown, the base values are shown grouped in one section of a bank and the sharpeners grouped a different part of the bank, but as will be understood by one skilled in the art, this is only one of many ways to organize the data in the memory.

Assuming that the display array is split top/bottom then ERAM banks 1002, 1004, 1006 and 1008 combined contain the base and sharpener values for half (either top or bottom) for two columns of pixels. In the embodiment shown, there is one set of two PPXs for every two columns in the top and bottom of the image. In this way a whole line of pixels is being computed at a time.

ERAM banks 1002 and 1006 share a set of "word" lines along with other ERAM banks that are not shown. Similarly ERAM banks 1004 and 1008 share a set of word lines along with other memory. There is a column wise bank select that determines whether ERAM bank 1002 or ERAM bank 1004 is selected onto data bus 1062. Similarly ERAM bank 1006 or ERAM bank 1008 may be selected onto ERAM data bus 1064.

Either ERAM bank 1002 and ERAM bank 1008 or ERAM bank 1004 and ERAM bank 1006 will be enabled at the same time. Based on the address sent to the ERAM banks either the 8-bit bases or two 4-bit sharpeners will be sent to a given PPX. Full_A signal 1066 will be high/active if PPX_A 1012 is sent 8-bit wide data and if Full_A signal 1066 is low, then PPX_A 1012 will be processing two 4-bit numbers. For example, the row address to ERAM bank 1002 may select an 8-bit base to go to PPX_A 1012 while at the same time two 4-bit sharpeners may be sent from ERAM bank 1008 to PPX_B 1014.

In the embodiment shown ERAM bank 1002 has the upper half of the image's even bases for each block of pixels in a given column of the image and the lower half of the odd blocks 4-bit sharpeners for each 2 by 2 row. The 4-bit sharpeners are stored with a left and right sharpener in each 8-bit byte and then there is a subrows "M" and "N" stored so that there are two sharpener bytes for each base byte per block of pixels. Similarly the other blocks store about half of the bases and half of the sharpeners.

At the start of a series of operations an 8-bit base will come from ERAM bank 1002 and sent to PPX_A 1012 and two sharpeners for sub-rows M will be sent from ERAM bank 1008 to PPX_B 1014. PPX_A 1012 will not be split and PPX_B 1014 will be split to process two sharpeners. The outputs of PPX_A 1012 and PPX_B 1014 will go to left/right logic 1030 which will generate signals 1072 and 1074 that will control two pixels in the MRRAM on a given row of the display. Additionally, as shown in FIG. 9 (but not shown in FIG. 10), on the next cycle one of the two PPX outputs may be used to control a conditional write to the corresponding ERAM. On the following cycle while the same base data from ERAM bank 1002 is going to PPX_A 1012, the sharpeners for line "N" of the pixel block are sent to PPX_B_1014.

Within the REE 1000 is BPS reconstructor element (RECEL) 1060 which comprises the PPX_A 1012, PPX_B 1014, and left/right logic 1030 as well as other hardware not shown in the block diagram. RECEL 1060 has the processing hardware necessary to turn Base and Sharpener data from ERAM banks 1002, 1004, 1006 and 1008 into a "pixel control signal form of reconstructed image." In the embodied implementation RECEL 1060 generates two control signals 1072 and 1074 for two adjacent columns of pixels in the MRRAM (not shown in FIG. 10). It will be understood by one skilled in the art that this configuration is only one of many ways to implement concepts shown in this embodiment. Given RECEL 1060 might control a single column or more than two columns depending on the speed and relative cost of the hardware as well as other designed requirements and/or limitations.

Figure 11:
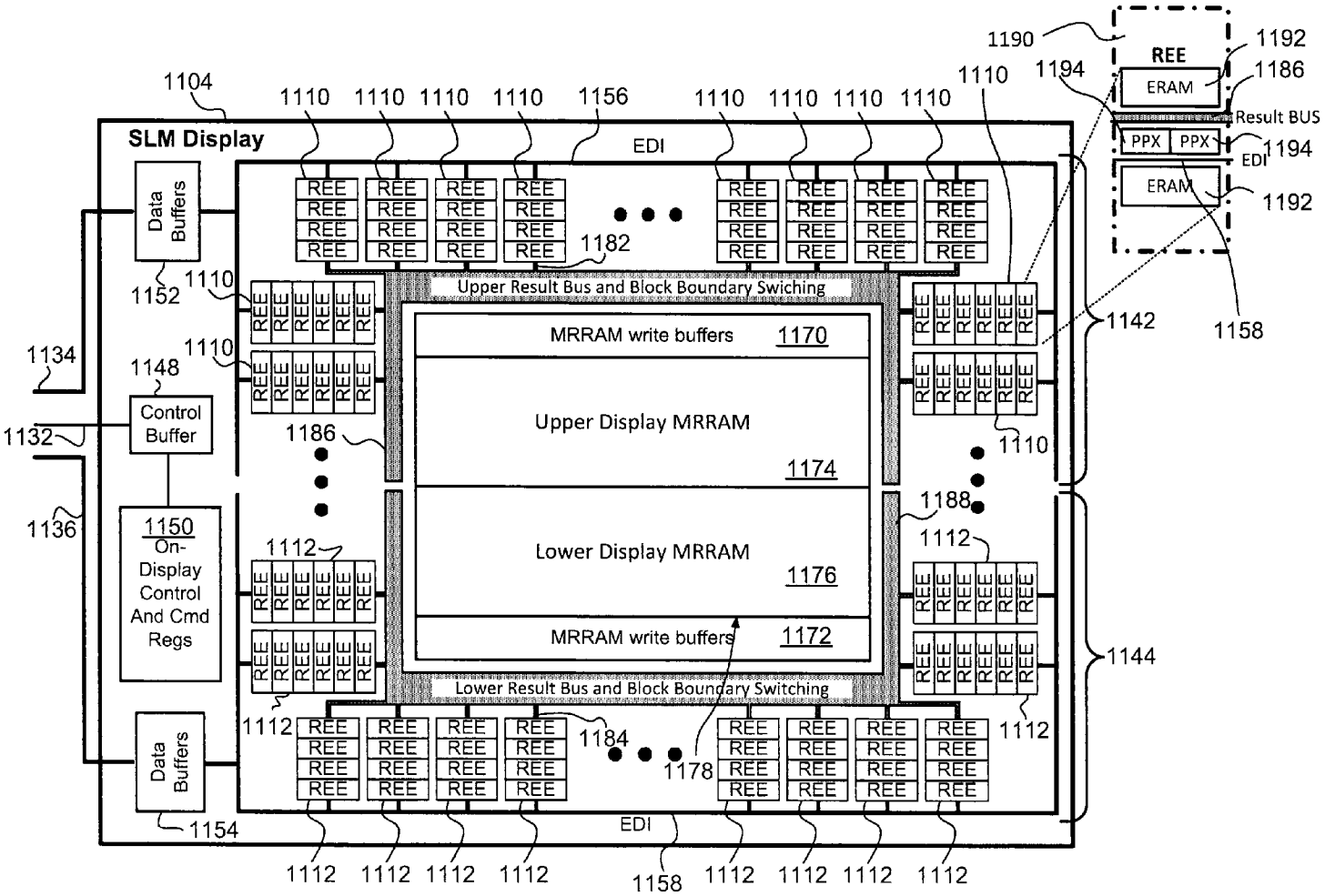
FIG. 11 shows more detail of an SLM in accordance with one embodiment of the present invention.

FIG. 11 shows an SLM 1104 according to one embodiment of the present invention that is similar to SLM 304 of FIG. 3. SLM 1104 has upper REEs 1110 and lower REEs 1112 with each REE corresponding to REE 1000 of FIG. 10. The amount of associated ERAM per REE may vary according to various design considerations. Multiple ERAMs maybe "stacked" such shown. Note that FIG. 11 is simplified for the purposes of illustration, because as there will necessarily to be many more REEs in an actual device. For example, for a 1280×720 display, there are 640 REEs driving the top half of the array because in this exemplary embodiment, each REE will drive two columns of MRRAM. There are also 640 REEs driving the bottom half, for a total of 1280 REEs.

Control information from a DCC such as DCC 330 (not shown) may be sent on a separate signal line 332. Although signal line 1132 in FIG. 11 is shown as a single line for simplicity of illustrations, there may be multiple signal lines 1132 from the DCC. Alternatively, the control information may be sent on data lines 1134 and 1136 intermixed with the data information or on some other set of signal lines. ERAM data in data lines 1134 and 1136 feed incoming ERAM data to upper REEs 1110 and lower REEs 1112, respectively.

The display process in SLM 1104 is split in half into upper half 1142 and lower half 1144 of SLM 1104. A control buffer 1148 acts as the interface to bring control information into SLM 1104. The control information is sent to the part of on-display controller 1150. The type of control information sent is discussed in more detail below. Data (busses) lines 1134 and 1136 connect to data buffers 1152 and 1154, respectively, in SLM 1104. SLM 1104 also includes upper and lower ERAM Data In (EDI) busses 1156 and 1158, respectively; upper and lower MRRAM write buffers 1170 and 1172, respectively; and upper and lower MRRAM arrays 1174 and 1176, respectively, of an active display 1178. Each REE 1110 or REE 1112 includes an ERAM that acts as scratch memory and processing hardware and will be described in more detail below. Signal lines 1184 and 1186 connect each upper REE 1110 to upper MRRAM write buffers 1170 and each lower REE 1162 to lower MRRAM write buffers 1172. Results from REEs 1160 are sent to the upper MRRAM write buffers 1170 which in turn drive upper display pixel mirror 1174. Results from REEs 1162 are sent to lower MRRAM write buffers 1172 which in turn drive lower MRRAM array 1176.

A large number of lines 1182 and 1184 are part of upper result bus 1186 and lower result bus 1188 that connect upper REEs 1110 and lower REEs 1112 to the upper MRRAM 1174 and lower MRRAM 1176 respectively. There may be switches (not shown) on lines 1182 and 1184 of upper result bus 1186 and lower result bus 1188, respectively, that enable different REEs to connect to different columns of the MRRAM. Details of an REE 1110 (or 1112) is shown in dashed box 1190. REE 1110 in dashed box 1190 is shown including two ERAM 1192, two PPX 1194, EDI bus 1156, and an upper result bus 1186. Dashed box 1190 generally corresponds to FIG. 10.

In some applications it is desirable to make the device as short as possible in one direction, as it may help make the end device thinner. These REEs may be placed essentially anywhere on the device which means that smaller and/or fewer REEs may be placed on say the top and bottom of the SLM and more placed on the sides to help make the device be less tall in one direction.

Figure 12:
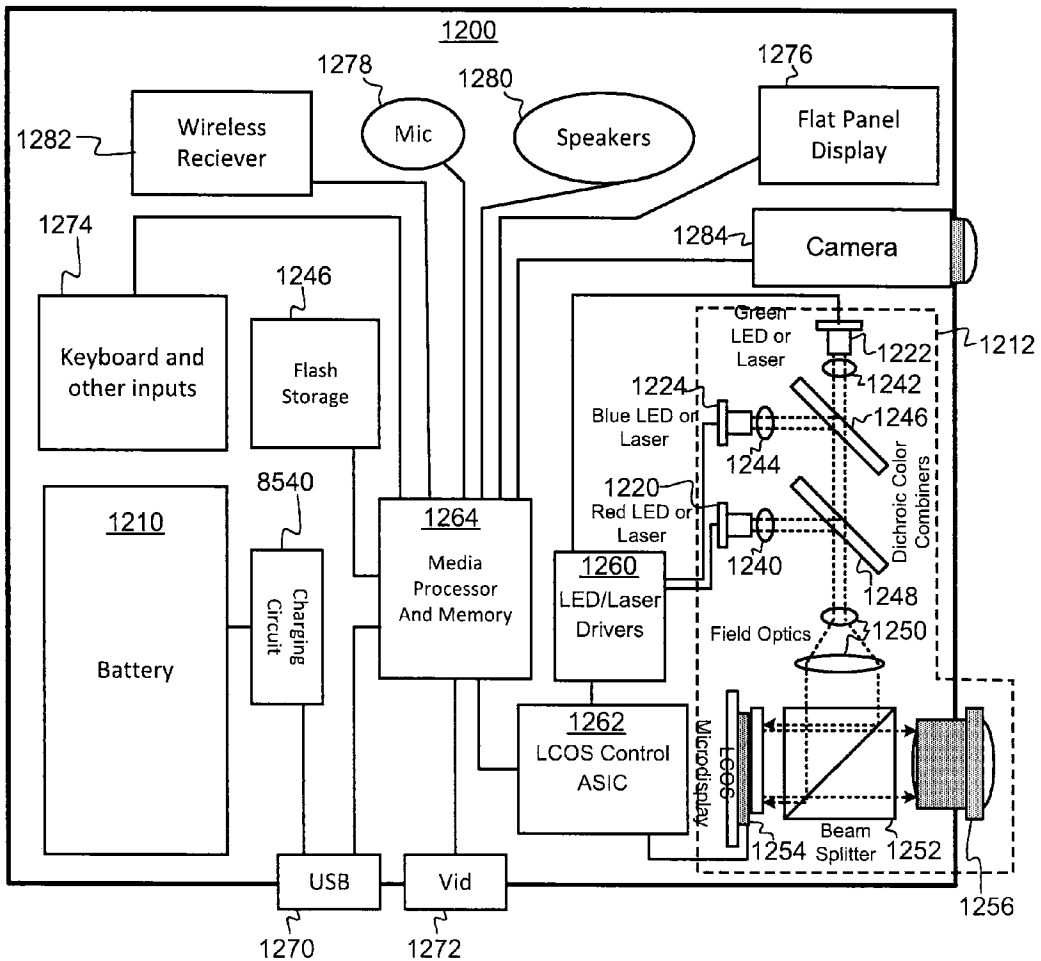
FIG. 12 shows a projecting device which comprises an SLM in accordance with one embodiment of the present invention.

FIG. 12 shows a block diagram of one way how the concepts of the current invention may be used in a multimedia projection system 1200. In this example, the system is powered by a battery 1210. The block diagram shows a generic optical engine 1212 for a microdisplay based projector. In a simple pure field sequential color system a red light source 1220, green light source 1222 or blue light source 1224, each of which may be an LED or a laser, will be sequentially turned on, but it also possible that two or all three of the light sources may be on at the same time for some mixed color, for multi-primary fields. Optical elements 1240, 1242 and 1244 that are used to shape light from the red, green and blue light sources respectively. It is also possible that colors other than red, green and blue may be used for the LEDs or lasers. Additionally colors that are invisible to a human, such as infrared may be used for various applications including putting out a "structured light" image to help with image recognition.

Combining of the red, green and blue light is show using simple dichroic filters 1246 and 1248 as it well understood in the art but other methods may be used. In the case of lasers, there is generally some form of despeckle and beam shaping optics although this varies in each design and is not shown. In some designs, the light might also go through some "pre-polarization" optics (not shown). Next, the combined light passes through field optics 1250 that will shape the light for illuminating the microdisplay In the case of LCOS there is often a beam splitter 1252 that directs the polarized light from the lasers to microdisplay 1254. Microdisplay 1254 is an SLM is one embodiment of SLM 304 (FIG. 3) or SLM 304 (FIG. 3). A polarizing beam splitter 1252 will reflect one polarization of light and pass the other polarization. The beam splitter has the effect of only passing highly polarized light to the LCOS microdisplay. Each pixel/mirror/electrode of the LCOS microdisplay controls the Liquid Crystal over that pixel to rotate the light for each pixel that is non-black so that it will pass through the beam splitter after it reflects off a given pixel's mirror. The light out of the beam splitter then goes to projection lens 1256 that then expands the resultant image for viewing. It will be understood by those skilled in the art that this is a simplified optical diagram and there may be many different ways to implement a small optical engine.

LED or laser drivers 1260 provide the high current electrical signals to the LED and are controlled by an ASIC 1262 that also controls the LCOS microdisplay. ASIC 1262 may have a frame buffer on the same silicon as ASIC 1262 itself or the frame buffer may be part of a "system on package" (SOP) where more than one device in mounted in the same package. Media processor 1264, which may include a memory device or subsystem, is used to take various data types and convert them into images for display that it sends to LCOS Control ASIC 1262. Flash storage 1266 is used to hold data and display content which may include compressed or decompress still pictures and/or video, documents, presentation graphics material, or any other type of audio-visual material that may be presented using this device. Also shown is USB input 1270 that may be used both the charge the battery and download data and programs to media processor 1264. Video input 1272 may accept standard analog and digital, compressed or uncompressed video information that may go to media processor 1264. Keyboard or other inputs 1274 may be used for human inputs and control and there may be any number of other inputs and outputs to the system as are common on portable devices like cell phones, cameras and media players today. In addition to the projector, there may be other display devices such as an LCD flat panel 1276. Also shown is a wireless transceiver and when combined with speakers and a microphone, the device may among other applications be used as a cell phone. In other applications a camera may be included. Microphone 1278 may be used for voice or music input and speakers 1280 may be used for audio playback or as part of a phone or the like. Wireless receiver 1282 may be used receive either local input such as a remote control and/or it may be used for wireless communication including cell phone and/or wireless internet.

A camera 1284 may also be included that may work independently or in conjunction with the projector. For example, camera 1284 or other visual input or distance measuring device may be used to control a focus mechanism on the projector's output lens. Camera 1284 may be used as an input device to input hand and finger motions via image recognition by media processor 1264. Additionally the camera may detect visible or human invisible images projected by optical engine 1212. There may also be position sensitive sensor incorporated to detect movement and thereby affect the image that is projected.

It will be understood by one skilled in the art that there are many various, additions and changes that may be made to the system of FIG. 12. Additionally, as will be understood by one skilled in the art, some of the blocks shown in FIG. 12 may be combined or split apart in different implementations.

Figure 13:
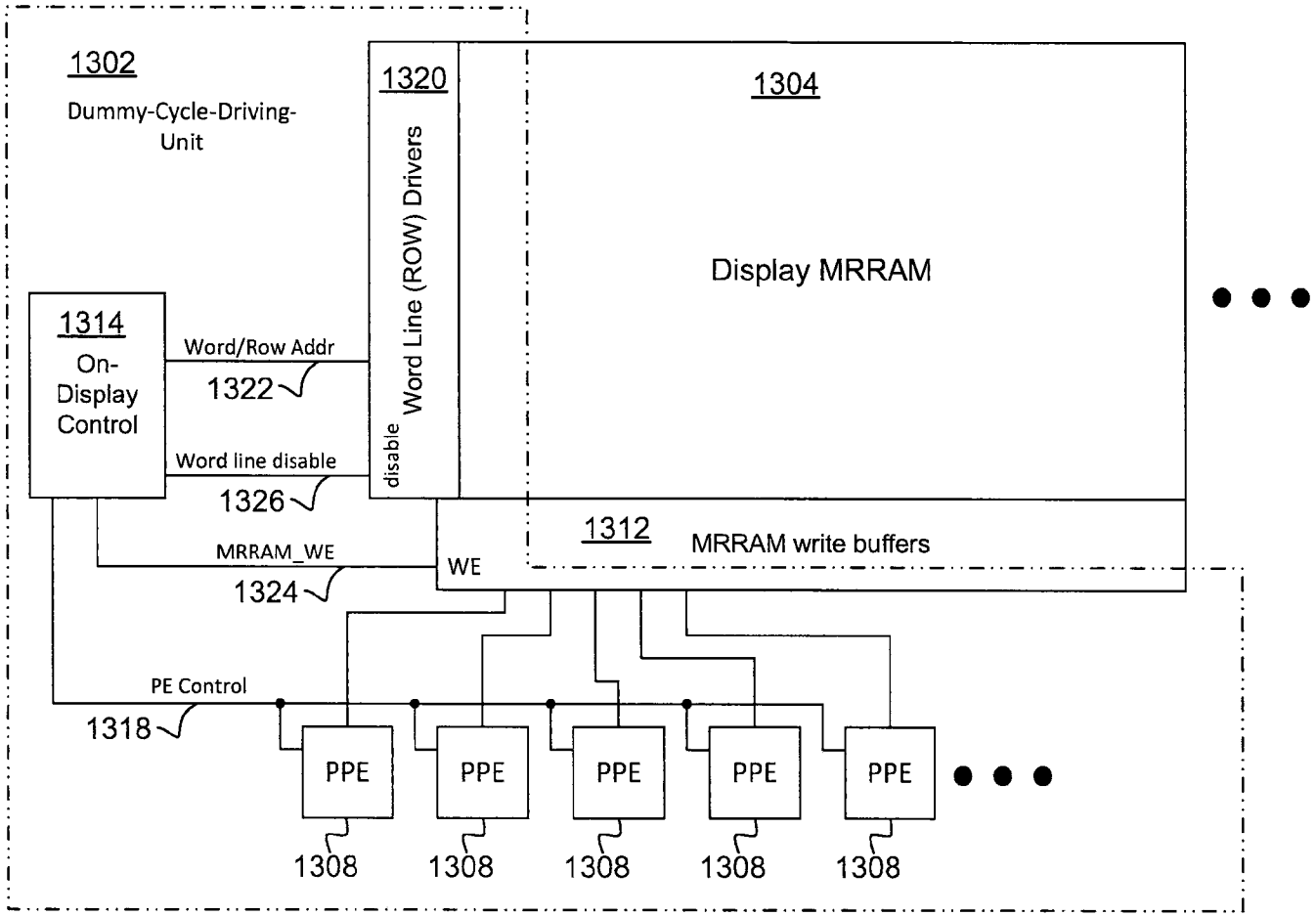
FIG. 13 shows a diagram of a dummy cycle driving unit in accordance with one embodiment of the present invention.

FIG. 13 shows a dummy cycle driving unit 1302 that controls MRRAM 1304 to execute a series of dummy cycles. These dummy cycles do not affect the contents of the MRRAM, but cause power to be dissipated. This dissipated power has the effect of heating the liquid crystal. In one embodiment of the present invention, a temperature sensor or other sensor is used to infer the temperature of the liquid crystal. If the inferred temperature is too low, the dummy cycle driving unit may be activated in order to heat the liquid crystal. Dummy cycle driving unit 1302 comprises much of the same hardware for writing to MRRAM 1304 under normal (non-dummy cycle) operation. This hardware includes PPEs 1308 that produce values to be written to MRRAM 1304 via MRRAM write buffers 1312. PPEs 1308 are controlled by on-display controller 1314 via PE control line 1318. On-display controller 1314 provides the word/row address to word line (row) drivers 1320 via word/row address line 1322. On-display controller 1314 simultaneously enables MRRAM write buffers 1312 to write to MRRAM 1304 via MRRAM write enable (WE) line 1324. Dummy cycle driving unit 1302 controls this hardware to modify the contents of MRRAM 1304 in accordance with at least one embodiment of the present invention to produce an image displayed on an SLM. Dummy cycle driving unit also comprises a word-line-disable line 1326 that instructs word line drivers 1320 to be disabled when dummy cycles are being performed. In this example, MRRAM buffers 1312 still transmit data to MRRAM 1304, during dummy cycles, but will not modify the contents of MRRAM because the word line drivers 1320 is disabled via word-line-disable line 1326.

These concepts described above may be used to support more complex operations. One such representation, to be discussed in more detail below, will be referred to as the base-plus-sharpener (BPS) representation. The BPS representation lends itself to a particular pulse waveform scheme which will be discussed in detail below, including some of the benefits of using this representation in terms of the reduction in memory needed to store an image.

Figure 14:
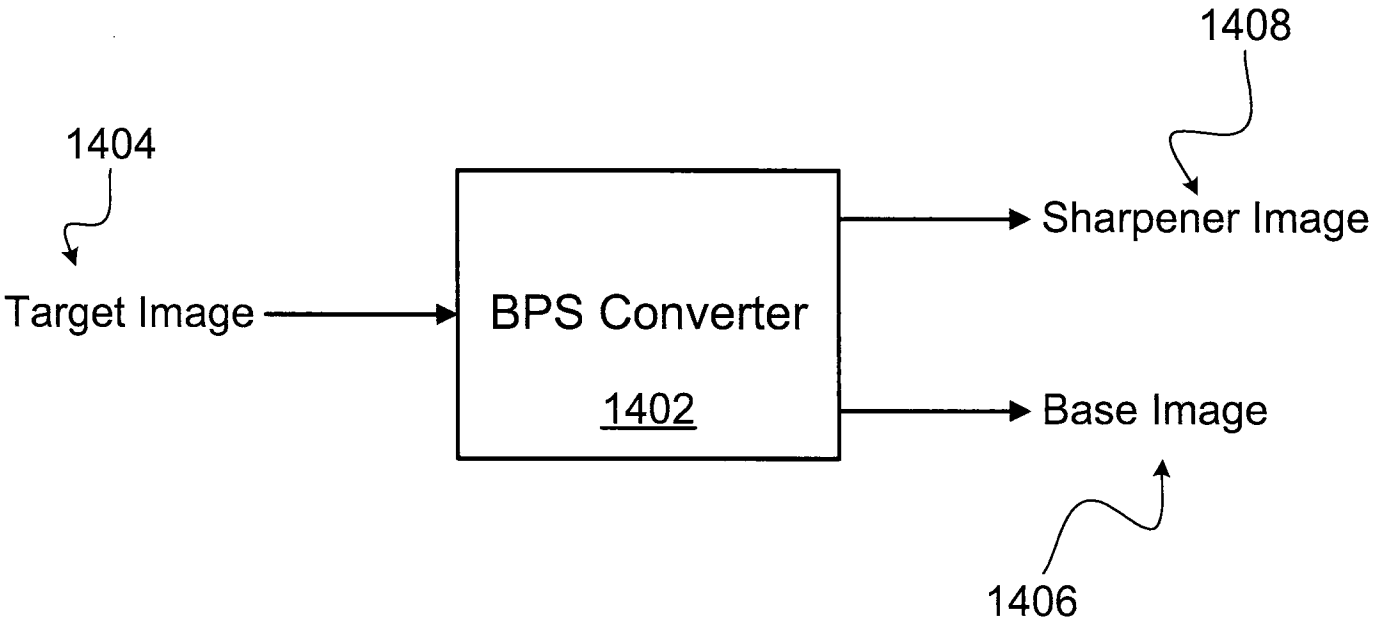
FIG. 14 shows a "BPS converter" comprising a compression engine for compressing a target image in accordance with one embodiment of the present invention.

FIG. 14 shows an example of a compression engine 1402 according to one embodiment of the present invention that may be used to create BPS representation. Such a system may be referred as a "BPS converter system" or as a "BPS converter." This system is described in more detail below. Compression engine 1402 receives a target image 1404 and produces a base image 1406 and a sharpener image 1408. Base image 1406 and sharpener image 1408 would be considered compressed image data, because the total number of bits of base image 1406 and sharpener image 1408 combined is less than that of target image 1404. Target image 1404 is represented using less storage, but may be reconstructed to form an image which is visually close to target image 1404. Reducing the storage required has multiple advantages, including reducing the size of the frame buffer needed as well as reducing the amount of data which needs to be transmitted to the display device, which in turn reduces the power consumption of the overall system.

Figure 15:
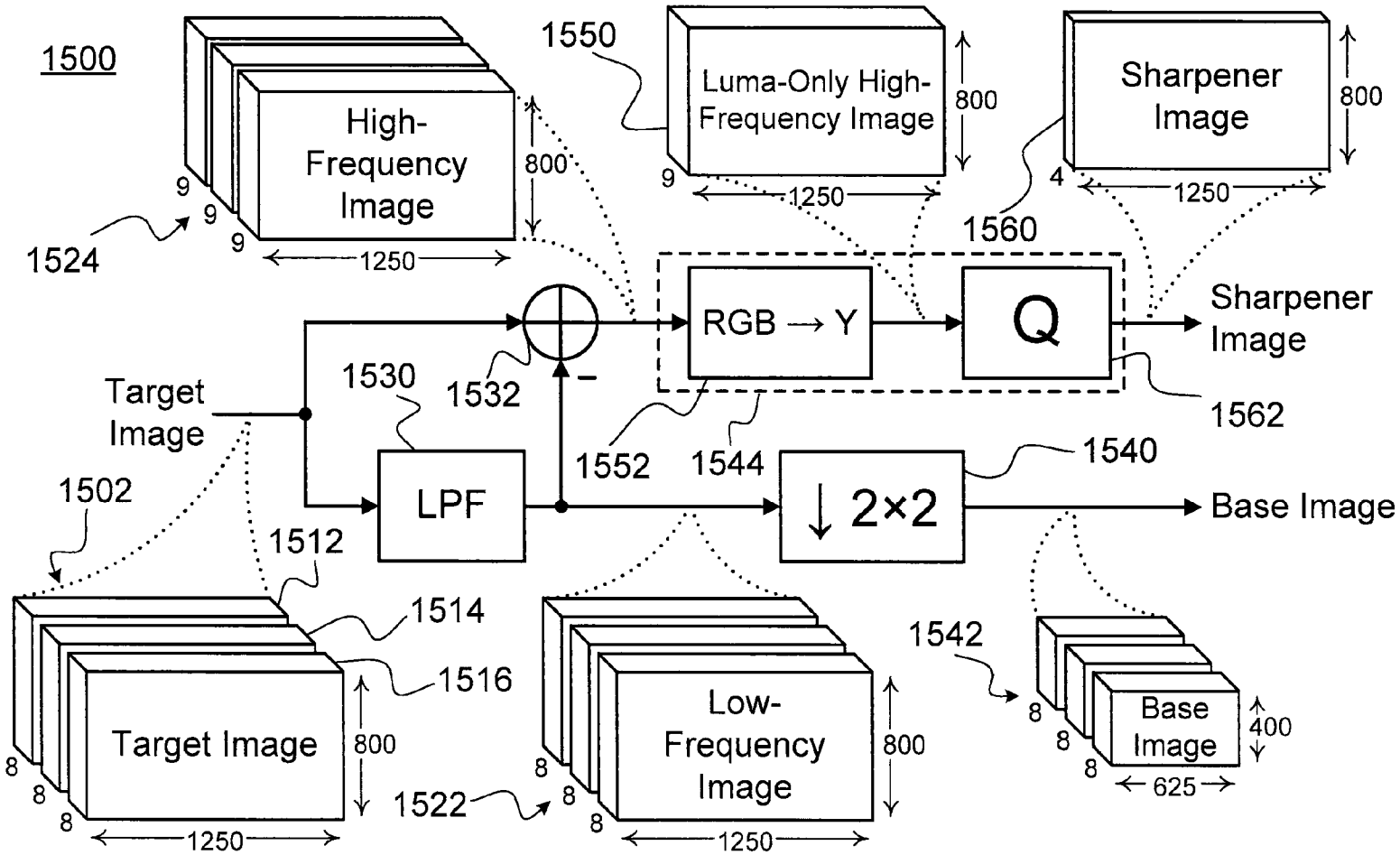
FIG. 15 shows a more detailed diagram of a BPS converter in accordance with one embodiment of the present invention.

FIG. 15 shows a detailed example of a BPS converter 1500 according to one embodiment of the present invention. In this example, target image 1502 has a resolution of 1250 by 800 pixels, or 1 million pixels. It will be understood by one skilled in the art that the concepts presented here are independent of resolution; the resolution of this example was picked so as to start with a round number of exactly 1 million pixels. A target image 1502 has three color components, a red component 1512, a green component 1514 and a blue component 1516. Color components 1512, 1514 and 1516 each use 8 bits per pixel (bpp), so 24 million bits of storage are required for target image 1502. Therefore target image 1502 has 24 bpp. As shown in FIG. 15, target image 1502 is first separated into two complimentary images, a low-frequency image 1522 and a high frequency image 1524. Low-frequency image 1522 is created by passing target image 1502 through low-pass filter (LPF) 1530. As an example, the impulse response of LPF 1530 may be such that the cutoff frequency is nominally 0.25 cycles per pixel horizontally and vertically, which will facilitate subsequent decimation (reduction in the number of pixels). It should be understood by one skilled in the art that this is only one of many ways to low pass filter and decimate an image. In this example, prior to decimation, low-frequency image 1522 is the same size as target image 1502, and thus requires the same 24 million bits of storage.

High-frequency image 1524 may be created by passing target image 1502 through a high-pass filter or, as is shown in this example, by using subtractor 1532 to subtract low-frequency image 1522 from target image 1502, the difference being high frequency image 1524. High-frequency image 1524 may therefore contain negative values, and so requires 8 bits plus a sign bit, or 9 bpp for each color, giving a total of 27 bpp, or 27 million bits of storage. This operation in this example is theoretically lossless because target image 1502 may be perfectly reconstructed by taking the sum of low-frequency image 1522 and high-frequency image 1524. High frequency image 1524 created by subtractor 1532 is a form of "difference image."

As shown in FIG. 15, the required storage maybe reduced by passing low-frequency image 1522 through a decimator 1540. In this example, decimator 1540 will decimate low-frequency image 1522 by a factor of two in the horizontal direction and two in the vertical direction (2×2), giving a reduction in storage by a factor of 4. Decimator 1540 discards every other row, and every other column, and therefore retains only one pixel in every 2 by 2 region. This corresponds to a square sampling grid, however, it should also be noted that in general the sampling grid used need not be square. A rectangular grid, obtained by using a different decimation factor for horizontal and vertical directions, or some other sampling grid, such as a diamond grid or hexagonal grid, or even an irregular grid may be used.

Base image 1542 appears at the output of decimator 1540. FIG. 15 shows an example system, and it will be understood by one skilled in the art that the process of low pass filtering followed by decimation is often performed in a single step without generating intermediate full-resolution low-frequency image 1522.

In FIG. 15 the resolution of base image 1542 has been reduced to 625 pixels by 400 pixels, or 250,000 pixels. There are still three primary colors at 8 bpp each, giving storage requirement of 2 million bits for each color, or 6 million bits in total for base image 1542. Note that each of the color components of base image 1542 is calculated independently from the corresponding color component of target image 1502 which is different from prior art methods such as YUV/YCbCr with chroma sub-sampling which perform a color space conversion. For reasons described below, this is beneficial for field-sequential color displays.

In order to reduce the storage requirements of high-frequency image 1524, two techniques are used. The first technique involves exploiting the fact that the human visual system is insensitive to chrominance information at high spatial frequencies. In order to reduce the storage requirements of high-frequency image 1524, high-frequency image 1524 is passed through a bit-depth reducer 1544 that reduces the total bits per pixel. In this example the bit-depth reducer 1544 consists of two block which use two different techniques to reduce the total bits per pixel. A luma-only high-frequency image 1550 is obtained by passing high-frequency image 1524 through a color-channel reducer, which in this example is luma calculating unit 1552, to produce, Y, from the RGB color components of the input using the well-known formula: $Y=0.299\ R+0.587\ G+0.114\ B$. It will be understood by one skilled in the art that this is only one way to compute the "luma" value. The coefficients of this formula may be chosen to be different from those given depending on the system design parameters, such as the chromaticity measurements of the actual color primaries being used in the system. Keeping only the luma reduces the storage requirement for high-frequency image 1524 by a factor of 3, from 27 bpp to 9 bpp for luma-only high-frequency image 1550.

The present invention differs from the well-known "chroma sub-sampling" technique used by existing compression schemes such as JPEG, MPEG or JPEG2000, despite the fact that the same properties of the human visual system are being exploited. The well-known approach in the prior art uses chroma sub-sampling to first convert the RGB target image to an alternate color space, such as YUV or YCbCr. The luma component, Y, is retained at full resolution, while the chroma components, UV or CbCr, are sub-sampled (filtered and decimated) before further compression is performed. If the video signals are digital, and the decimation is done by a factor of 2 in each direction or 2×2, then the representation is referred to as "YCbCr 4:2:0" using the common video processing terminology. The method described by the current invention has several advantages over "chroma sub-sampling." For instance, no chroma components are ever calculated so less computation is required. It should also be noted that even though the luma-only high-frequency image 1550 has been calculated above, this does not represent the luma of target image 1502, rather it is the luma of only high frequencies of target image 1502. Also, as FIG. 15 demonstrates it is not necessary to ever calculate the luma of the target image as part of the BPS converter, whereas computing the luma of the target image is essential for prior art chroma subsampling techniques such as YCbCr 4:2:0. Luma calculating unit 1552 is an example of a color-channel reducer, because it reduces the number of color channels of the image passing through it from three (R, G and B) to one (Y).

The storage requirements may be reduced further using quantization. In FIG. 15, a final sharpener image 1560 is created by passing luma-only high-frequency image 1550 through quantizer 1562. The quantization which is proposed is different than that performed by well-known JPEG and MPEG compression, because it is performed on pixels values in the spatial domain, whereas JPEG performs quantization on coefficients in the frequency transform domain. Furthermore, there may be advantages if the quantization is done on a non-linear scale, such as a log or similar scale, whereas commonly used image quantization techniques, including JPEG, typically quantize on a linear scale. A non-linear scale is used because of the following observable characteristics of luma-only high-frequency image 1550, and its relationship to target image 1502. Flat or smooth (slowly varying) regions of target image 1502 will produce values of luma-only high-frequency image 1550 which are small or zero in magnitude, while edges or textured regions of target image 1502 will produce values of the luma-only high-frequency image 1550 which are larger in magnitude. This observation means that in general, larger quantization errors are allowed for larger values of the luma-only high-frequency image 1550, since those errors are more easily hidden by edges or textures in the reconstructed image. For this reason, quantizer 1562 may use a non-linear scale to perform the quantization which may use smaller steps between quantization levels near zero and larger steps between quantization levels of higher absolute magnitude. It was empirically determined that very good visual performance may be achieved with only 16 non-linear quantization levels. This means that only 4 bpp, or 4 million bits, are needed to represent final sharpener image 1560.

The ability to quantize the sharpener while maintaining a visually pleasing image highlights one of the differences between the current invention and the prior art chroma subsampling. In prior art chroma subsampling, quantizing the luma, Y, term would have a significant detrimental impact on the quality of the reconstructed image, since the luma is generally considered to be the most important component and essentially represents a "black and white" or gray scale version of the target image.

Table 1 shows one example of the quantization levels used by quantizer 1562 on a nonlinear scale, where a 4-bit value is used to represent the sharpener. It should be noted, that using 4 bits to represent the sharpener is part of this example only, and a different number of bits may be chosen with some choices having advantages over others, such as fewer image artifacts or lower computational requirements. Table 1 shows an example set of quantization levels used by quantizer 1562. In some embodiments, input values are quantized to the closest quantization level, and so for each quantization level, there are quantization thresholds which describe a range of values of the input which would be quantized to that level. Each input is therefore encoded as a 4-bit quantized sharpener value according to which range the input fell within. Both decimal and binary representations of the quantized sharpener value are shown in Table 1. During reconstruction, this quantized sharpener value is decoded to the decoded sharpener value given in Table 1. In this example, the decoded sharpener value has been chosen to be equal to the quantization level, but may be chosen differently.

TABLE 1

| Quantization Level | Input Range | Quantized Sharpener Value (decimal) | Quantized Sharpener Value (binary) | Decoded Sharpener Value |
|---|---|---|---|---|
| −215 | −255 to −151 | 0 | 'b0000 | −215 |
| −85 | −150 to −69 | 1 | 'b0001 | −85 |
| −51 | −68 to −45 | 2 | 'b0010 | −51 |
| −27 | −44 to −22 | 3 | 'b0011 | −27 |
| −15 | −21 to −11 | 4 | 'b0100 | −15 |
| −5 | −10 to −5 | 5 | 'b0101 | −5 |
| −3 | −4 to −3 | 6 | 'b0110 | −3 |
| −1 | −2 to −1 | 7 | 'b0111 | −1 |
| 0 | 0 to 1 | 8 | 'b1000 | 0 |
| 2 | 2 to 3 | 9 | 'b1001 | 2 |
| 5 | 4 to 7 | 10 | 'b1010 | 5 |
| 10 | 8 to 15 | 11 | 'b1011 | 10 |
| 21 | 16 to 27 | 12 | 'b1100 | 21 |
| 35 | 28 to 49 | 13 | 'b1101 | 35 |
| 65 | 50 to 109 | 14 | 'b1110 | 65 |
| 155 | 110 to 255 | 15 | 'b1111 | 155 |

Note that more error in the sharpener signal is tolerable when its magnitude is greater, thus values close to 0 are usually more closely spaced than values further from 0. If arbitrary values are required for representing the sharpener, then a look up table (LUT) may be used to recover the decoded value from the stored bit-reduced value. However, hard-coded logic may be used to reduce the complexity and increase the speed of the decode operation. There are various techniques which one skilled in the art would be familiar with for determining logic hardware for converting the 4-bit representation of the sharpener image into its 9-bit value. Note also that in at least one embodiment of the present invention, it is not necessary to decode the 4-bit value to its original 9-bit value. The decode operation happens implicitly by creating pixel drive waveforms using a series of match instructions.

For the example as shown in FIG. 15, the storage requirements for the given target image 1502 have been reduced from 24 million bits to a total of 10 million bits; 6 million for base image 1542, and 4 million for sharpener image 1560. It should be noted, that this example is meant to convey the concept behind the base-plus-sharpener (BPS) representation; additional processing or alternative processing may be done to improve the quality of the reconstructed image, or to reduce the computational or storage requirements. There may be various embodiments which possess relative advantages with respect to each other and may or may not be explicitly described in this disclosure.

One advantage of the BPS representation is that two very different techniques are used to reduce the storage of the low-frequency versus the high-frequency components. This allows the errors or imperfections introduced into one of the components to be compensated for or corrected for using the other component. For example, the well-known artifact of aliasing which may be introduced by using decimator 1540 to create base image 1542 may be corrected to a certain extent by modifying sharpener image 1560. Similarly, the potentially visible errors introduced by using quantizer 1562 to create sharpener image 1560 may be hidden or reduced by modifying base image 1542 in a suitable fashion. The result is a reconstructed image which is perceived by the human visual system to be closer to target image 1502. A system which takes advantage of this will be said to use a cross-correction architecture.

Figure 16:
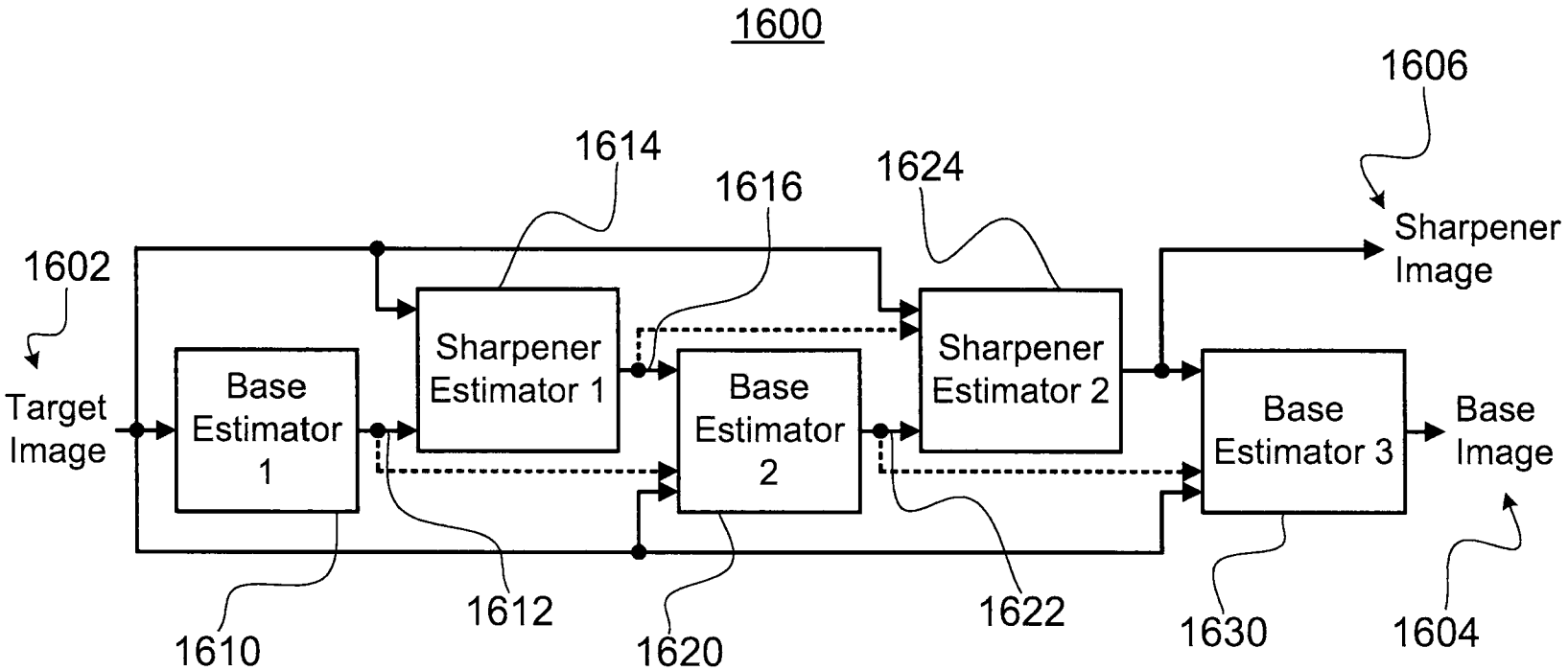
FIG. 16 shows a BPS converter using a cross-correction architecture in accordance with one embodiment of the present invention.

FIG. 16 shows more detail of a BPS converter 1600 according to one embodiment of the present invention that uses a cross-correction architecture. BPS converter 1600 receives a target image 1602 as input and produces a base image 1604 and a sharpener image 1606 as outputs. A first base estimator 1610 produces a first intermediate base image 1612 based on a target image 1602. Then a first sharpener estimator 1614 computes a first intermediate sharpener image 1616 based on target image 1602 and on first intermediate base image 1612. Then a second base estimator 1620 computes a second intermediate base image 1622 based on target image 1602 and on first intermediate sharpener image 1616. Then a second sharpener estimator 1624 computes output sharpener image 1606 based on target image 1602 and on second intermediate base image 1622. Then a third base estimator 1630 computes base image 1604 based on target image 1602 and on sharpener image 1606. In this example, there are three base estimators and two sharpener estimators, but there may be more or fewer estimators depending on the computational requirements and the desired level of image quality. This BPS converter may be said to use a cross-correction architecture since at least one of the sharpener estimators uses a previous estimate of the base as an input and/or at least one of the base estimators uses a previous estimate of the sharpener as an input. A BPS converter using cross-correction architecture will have at a minimum one base estimator and one sharpener estimator, and at least one of these will use the output of the other as an input. It should also be noted that the estimators are pictured in the figure as being separate units, however, they may be implemented by reusing some estimators iteratively. It should also be noted that in some embodiments of the cross-correction architecture, each estimator may optionally use the previous estimate as in input, as indicated by the dashed lines.

The image quality of the reconstructed image may be improved by iterative techniques or by implementing several different algorithms and selecting the output that is closest to the original target image by some metric. This may be done globally for the whole image, or locally with an output selection being made for each block of pixels.

Figure 17:
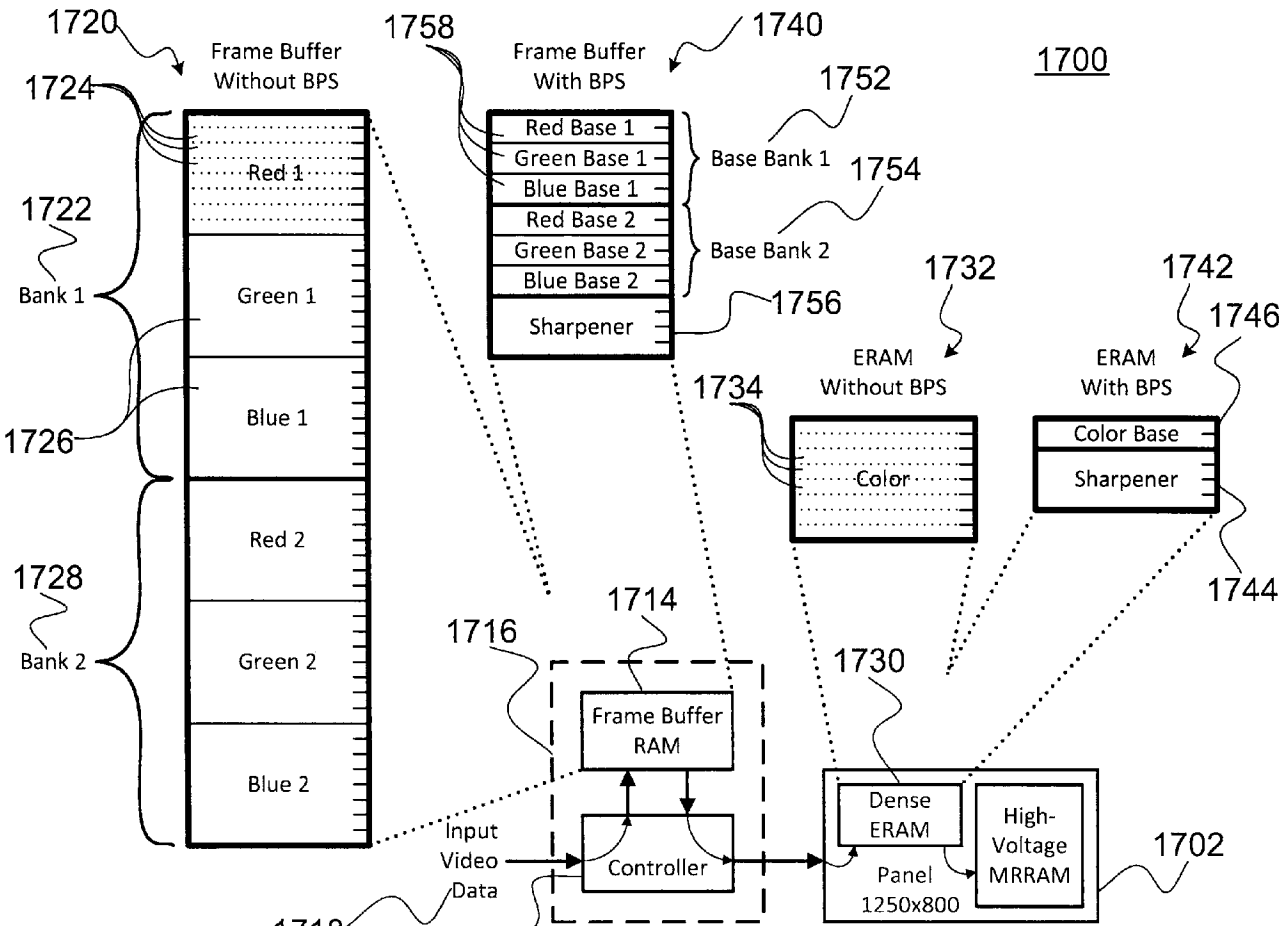
FIG. 17 shows two system configurations, one of which assumes direct storage of a 24 b.p.p. image, and the other of which assumes a BPS representation using 2×2 blocks, 8-bit base values and 4-bit sharpener values in accordance with one embodiment of the present invention.

FIG. 17 shows an exemplary field-sequential display system 1700 according to one embodiment of the present invention that highlights some of the advantages of using the BPS representation (with BPS) over the conventional 24 bpp representation (without BPS). For the sake of clarity, this example follows the system design parameters shown in FIG. 15, including using a display resolution of 1250 by 800, or 1 million pixels. In FIG. 17 the basic components of field-sequential display system 1700 are display device, or panel 1702, controller 1712 and frame buffer 1714. Controller 1712 and frame buffer 1714 may or may not be built on a common substrate 1716. In this example two fields of each color are displayed for every frame in sequential fashion, using color-field order RGBRGB. For the sake of simplicity, in field-sequential display system 1700 shown FIG. 17 it will be assumed that the two fields of a particular color are identical, and thus will each require that all bits needed for that color will be stored on panel 1702 while that field is being displayed. In this example, it is assumed panel 1702 is synchronized with incoming video data 1718 so that while one frame (the current frame) is being displayed by panel 1702, the subsequent frame (the incoming frame) is being received by controller 1712.

Controller 1712 accepts incoming video data 1718, and performs processing on the data before passing it to be stored in frame buffer 1714. Two cases will now be compared: one that uses the conventional 24 bpp representation without using the BPS representation and the second case in which the BPS representation is used. Without BPS, frame buffer 1714 uses memory allocation 1720, and requires 48 million bits of storage. This is because 2 banks of data are used. A first bank 1722 stores the video data for the current frame (the frame being displayed). First bank 1722 requires 1 million bits per bit plane 1724, or 8 million bits per color 1726, or 24 million bits of storage. A second bank 1728 is used to store the data for the incoming frame. The data for the current frame in first bank 1722 is being sent to panel 1702 since all data for that frame has already been received. This data is sent from first bank 1722 to panel 1702, one bit plane 1724 at a time, where it is received and stored on panel 1702 in ERAM 1730. Eight bit planes 1724 are sent to panel 1702 for each color field, in this example.

Without BPS, ERAM 1730 uses memory allocation 1732 which has storage for 8 bit planes 1734, or one full color. In order to minimize the size of the ERAM 1730, only data related to the color field being displayed is stored at any given time. The size of the ERAM 1730 without BPS is 1 million bits for each bit plane 1734, or 8 million bits total. The color fields of the current frame are displayed on panel 1702 while controller 1712 is receiving data for the incoming frame. The data being received is stored in a second bank 1728 of frame buffer 1714. The first bank 1722 cannot be used to store data for the incoming frame because it is being used to store the color field data for the current frame, some of which needs to be sent or resent to panel 1702 while the incoming frame is being received. Controller 1712 may be designed so that it always uses one bank to store a frame that it is receiving and the other bank to pass data to panel 1702 for the frame that it is displaying. It is then able to alternate or "ping-pong" between the two banks. This technique of using two full banks is referred to as "full double buffering."

In an alternative embodiment, frame buffer 1714 may instead be implemented as a plurality of circular buffers, one circular buffer per bit plane. This may be done because the memory in frame buffer 1714 which is being used for a particular bit plane can be freed up once that bit plane is sent to panel 1702 for the last time during a frame time. For example, if the display showing color fields RGBRGB for each frame, then the red bit planes are sent to the panel twice, once at the very start of the frame time before the first red field is displayed, and once again about halfway through the frame time before the second red field is displayed.

When, the red bit planes are sent for the second time, they no longer need to be stored in frame buffer 1714 and so the memory for these bit planes can be freed up about halfway through the frame time. In that case, a red bit plane of the current frame and the incoming frame may share a circular buffer with an approximate size of 1.5 million bits, or one and a half bit planes. Since bit planes are sent to panel 1702 one at a time, each bit plane will free up at a different point during the frame time. Having a separate circular buffer for each bit plane allows them to be sized independently, in order to minimize the total size of frame buffer 1714 needed. This technique of using circular buffers allows the size of frame buffer 1714 to be smaller than would be needed for a full double buffer, but larger than a single buffer, and is referred to as a "partial double buffer." It should be noted that there are several ways to implement a partial double buffer, at least some of which do not use circular buffers. Any buffer that frees up and reuses memory that is no longer needed and is smaller than a full double buffer would be considered a partial double buffer.

The 8-million-bit ERAM memory in both the "full" and "partial" double buffer methods above assumes there is sufficient bandwidth or a long enough field-blanking time that the full 8 bits per pixel may be sent for each color field. For the purpose of improving brightness, it is usually desirable to have short blanking times. However, if the bandwidth is insufficient to support a desirable blanking time, then additional ERAM or other buffer memory will be required. The deductive counting techniques described earlier may be able to reduce the amount of additional buffering that would be required.

So far, frame buffer 1714 and ERAM 1730 have described as would be required without the use of the BPS representation. However, with BPS, the size of frame buffer 1714 may be reduced to 16 million bits using memory allocation 1740. Controller 1712 converts video data from the 24 bpp representation to the BPS representation using a BPS converter such as the one shown in FIG. 15. In order to display one color field of the current frame, the color base data for that color and the sharpener data are required. So ERAM 1730 may use memory allocation 1742 which shows a sharpener partition 1744 and a base partition 1746. Base partition 1746 stores the color base data for the color field being displayed, and is overwritten with color data sent by controller 1712 for each color field. The sharpener data for the frame being displayed (the current frame) is stored on panel 1702 in ERAM 1730 in sharpener partition 1744 and is common to all colors. Thus the sharpener data is sent only once per frame, at the very beginning of the frame time. So it can be seen with BPS, ERAM 1730 requires 4 million bits of storage for sharpener partition 1744, and 2 million bits of storage for base partition 1746, or 6 million total bits of storage. This provides a reduction of 25% compared with the size of the ERAM 1730 without BPS. This reduction is significant because memory located on panel 1702 may be relatively more expensive than memory not located on panel 1702.

With BPS, frame buffer 1714 requires two banks for the color base data for the same reasons that two banks are required for the color data without BPS. Frame buffer 1714 uses memory allocation 1740, which shows a first base bank 1752, which stores data for the current frame, and sends this data to panel 1702 for each color field as necessary. A second base bank 1754 stores color base data for the incoming frame. As the base and sharpener data are being generated for the incoming frame, the base data is stored in second base bank 1754 and the sharpener data is stored in sharpener partition 1756 of frame buffer 1714. Note that the color base data uses two banks, i.e., first base bank 1752 and second base bank 1754, that comprise a full double buffer for the base data. However, the sharpener data uses only a single buffer, because once the sharpener data is transferred to sharpener partition 1744 of ERAM 1730, then it is no longer needed in frame buffer 1714. Thus sharpener partition 1756 of frame buffer 1714 may be used to store sharpener data for the next frame. Controller 1712 ping-pongs between first base bank 1752 and second base bank 1754 in order to store the color base data, but is uses only sharpener partition 1756 to store the sharpener data. The total size required for frame buffer 1714 with BPS is 16 million bits of storage, 2 million bits for each of three colors 1758 for each of two base banks, i.e., first base bank 1752 and second base bank 1754, and 4 million for sharpener partition 1756. Thus by using the BPS representation, frame buffer 1714 has been reduced from 48 million bits to 16 million bits. It should be noted that a further reduction in the size of frame buffer 1714 may be achieved as described before by using only a partial double buffer for the base data. This partial double buffer may be implemented as mentioned earlier using a plurality of circular buffers.

In the example shown in FIG. 17, the display shows color fields RGBRGB, or 6 color fields per frame. Without BPS, 8 million bits need to be sent to panel 1702 for each color field, or in this example, 48 million bits need to be sent for each frame. However, with BPS, 4 million bits are sent to panel 1702 at the beginning of the frame for the sharpener data, and only 2 million bits are sent for the color base data for each color field. Thus only 16 million bits need to be sent to panel 1702 for each frame. This represents a reduction by a factor of three in the amount of information sent to panel 1702, which results in a savings in power consumption, which is crucial for embedded battery powered applications. Additionally, it means that much less data needs to be sent between two color fields which reduced the bandwidth required and/or reduces the necessary minimum blanking time required.

Figure 18:
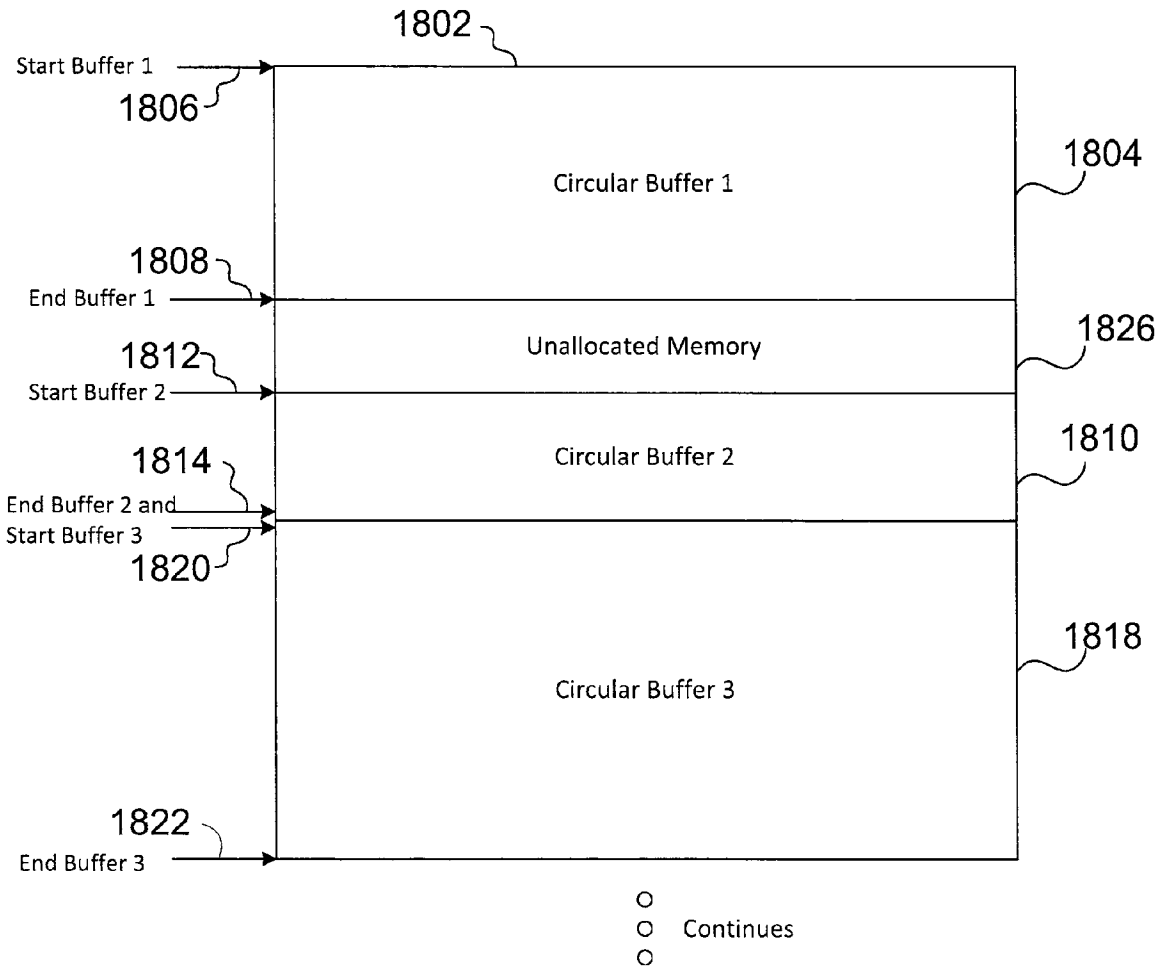
FIG. 18 shows an example memory configured as a plurality of circular buffers in accordance with one embodiment of the present invention.

As mentioned before, either or both of the frame buffers, i.e., memory allocation 1720 or memory allocation 1740, may be implemented as partial double buffers in order to reduce the size of the memory required. FIG. 18 shows a memory 1802 with an example set of circular buffers which may be used to implement the partial double buffer. Each bit position may be assigned to a circular buffer, of the appropriate size. For example, bit 0 of the red channel may be stored in a first circular buffer 1804 that has a start pointer 1806 and an end pointer 1808. Bit 1 of red may then be stored in a second circular buffer 1810, with a start pointer 1812 and an end pointer 1814. Bit 2 of red may then be stored in a third circular buffer 1818 with a start pointer 1820 and an end pointer 1822. In like manner, the other red bit positions and the blue and green bit positions may each be stored in their own circular buffer, with start and end pointers chosen so that the size of each buffer will be large enough for the respective bit position. Bit positions which free up later in the frame time will require larger circular buffers than bit positions which free up earlier in the frame time. It should be noted that circular buffers may not necessarily be adjacent in memory, and there may be unallocated memory 1826 located between one or more pairs of circular buffers.

In order to simplify the implementation of the BPS converter, consider an example in which a low-pass filter is used whose impulse response is a 2 by 2 square with equal coefficients. One advantage of using this filter is that the target image may be partitioned into 2 by 2 blocks, each of which may be processed independently. Unless otherwise stated, it is assumed that the implementation is done using this block-based partitioning, but it should be understood that a different filter may be used which may have various advantages over the 2 by 2 square filter, and should be included within the scope of the present invention. Using block-based partitioning localizes the problem and greatly simplifies the implementation. Each 2 by 2 block on the display is influenced by only one 2 by 2 block in the target image. There is, however, one drawback to using block-based partitioning; blocking artifacts may sometimes be seen in the resulting image. This is because the blocks themselves are independent from each other, while pixels within a block are not. Thus in certain images, the block boundaries may become visible. In at least one embodiment of the present invention, in order to mitigate this blocking artifact, the alignment of the block boundaries may be moved or shifted relative to the pixel array between frames and/or fields. This technique may be referred to as block-boundary shifting (BBS). In some embodiments of the current invention, the block boundaries are shifted between two alignments which are offset horizontally and vertically relative to each other by one pixel.

Figure 19:
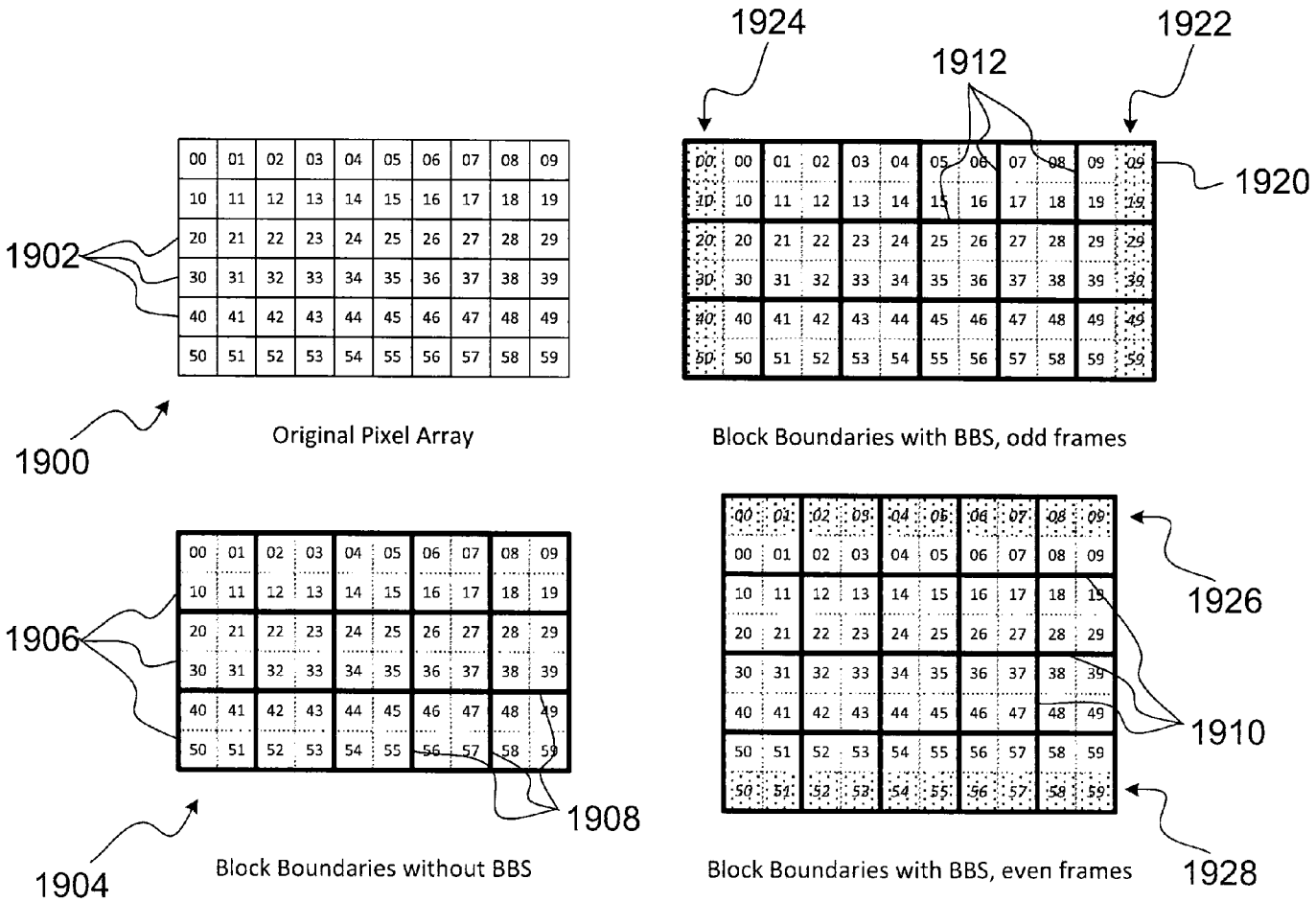
FIG. 19 shows an exemplary use of block boundary shifting in accordance with one embodiment of the present invention.

FIG. 19 shows block boundary shifting for a very small example assuming only a 10 by 6 pixel array 1900, with individual pixels 1902. Each pixel 1902 is labeled with a 2 digit number with the first digit giving the row 0 to 5 and the second digit giving the column 0 to 9. Pixel array 1900 may be partitioned into blocks to provide a block array 1904 comprised of individual 2 by 2 blocks 1906. The resolution of block array 1904 is five (5) blocks by three (3) blocks in this example. Block boundaries 1908, shown as dark lines, are used for all frames in the case that BBS is not being implemented.

Alternately, when using the BBS architecture, even and odd frames may use different alignments for the block boundaries. As an example, for even frames, even-frame boundaries 1910 may be used, and for odd frames odd-frame boundaries 1912 may be used. These alignments are shifted by one pixel horizontally and vertically relative to each other so that even-frame boundaries 1910 do not have any boundaries in common with odd-frame boundaries 1912. For even frames, the resolution of the block array is 5 blocks by 4 blocks, and for odd frames, the resolution of the block array is 6 blocks by 3 blocks. Note that when BBS is being used, some blocks near the edge of the array may be shifted such that they do not contain 4 pixels of the original pixel array, i.e., pixel array 1900. For example, block 1920 would have pixel 09 as the upper-left pixel and pixel 19 as the lower-left pixel, but the upper-right and lower right pixel would be empty. In order to prevent this, an extra column 1922 may be created that replicates pixels along the edge of pixel array 1900. Thus block 1920 may be treated as if its upper-right pixel was the same as its upper left pixel, and its lower-right pixel was the same as its lower-left pixel. Similarly, an extra column of pixels 1924 is introduced at the left of the array. For even frames, an extra row of pixels 1926 is added at the top of the array and an extra row of pixels 1928 is added at the bottom of the array. This example shows a technique referred to as pixel replication to fill in the pixels that would normally be missing from the blocks along the edge of the array. One of ordinary skill in the art will be familiar with other techniques which may be used such as mirror-image replication or zero padding in which the missing pixels are replaced with zero values or "black" pixels.

Figure 20:
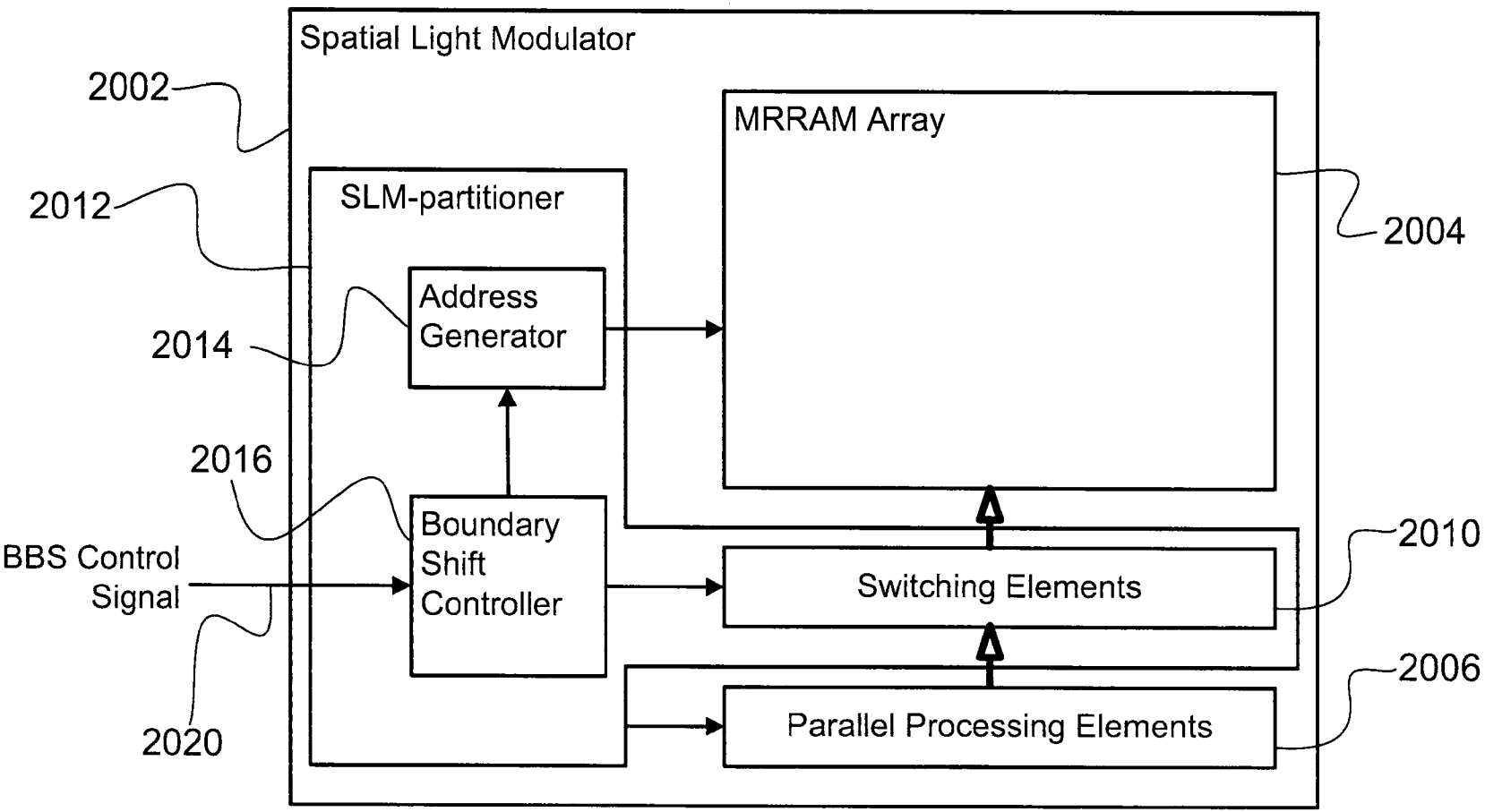
FIG. 20 shows a diagram of a spatial light modulator with a partitioner and a boundary shift controller in accordance with one embodiment of the present invention.

If the image is being processed in blocks, and block boundary shifting is being used, then the display device will also be displayed in blocks. FIG. 20 shows an example of how BBS may be implemented on the display device (not shown) comprising a spatial light modulator 2002 with an MRRAM array 2004 and a plurality of parallel processing elements 2006. Parallel processing elements 2006 are connected to the columns of MRRAM array 2004 via switching elements 2010. As an example, each parallel processing element of the plurality of parallel processing elements 2006 drives two columns of MRRAM array 2004. SLM partitioner 2012 determines how MRRAM array 2004 is partitioned into groups. As an example, MRRAM array 2004 may be partitioned into 2 pixel by 2 pixel blocks arranged as shown in FIG. 19. In this case, SLM partitioner 2012 will control switching elements 2010 and address generator 2014 so that a block of pixels will be driven by a respective processing element using the data for that block. Boundary shift controller 2016 shifts the block boundaries vertically by using address generator 2014 to control which rows of MRRAM array 2004 are being driven by processing elements 2006. Boundary shift controller 2016 also shifts the block boundaries horizontally by controlling switching elements 2010. In the example shown in FIG. 19, boundary shift controller will shift the 2 pixel by 2 pixel blocks both horizontally and vertically by one pixel between frames and/or fields, based on BBS control signal 2020 which was produced by the controller.

Experiments have shown that while block boundary shifting and other features of various embodiments produce generally good results with most images, there are certain color combinations and/or certain patterns with certain colors that may cause noticeable image artifacts. One way to reduce these artifacts is to recognize that many of the problems occur when there is a high rate of change (high frequency) in the chroma (color) of the image. Generally, these high rate of change chroma images only occur in computer generated content.

Figure 21:
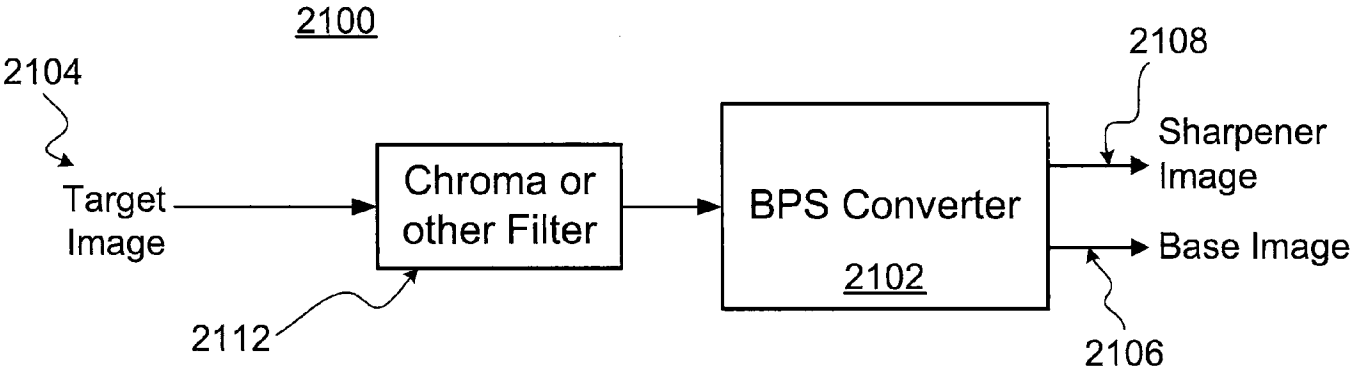
FIG. 21 shows an artifact reducing system employing BPS converter according to one embodiment of the present invention.

FIG. 21 shows an artifact reducing system 2100 with a BPS converter 2102 which converts a target image 2104 into a base image 2106 and a sharpener image 2108. In this case before going to BPS converter 2102, target image 2104 first passes through a low pass chroma filter 2112 which reduces the frequency of the color/chroma changes in the target image. By low pass filtering the chroma part of the target image, the severity of the artifacts cause by the BPS image and/or the block boundary shifting may be reduced.

Figure 22:
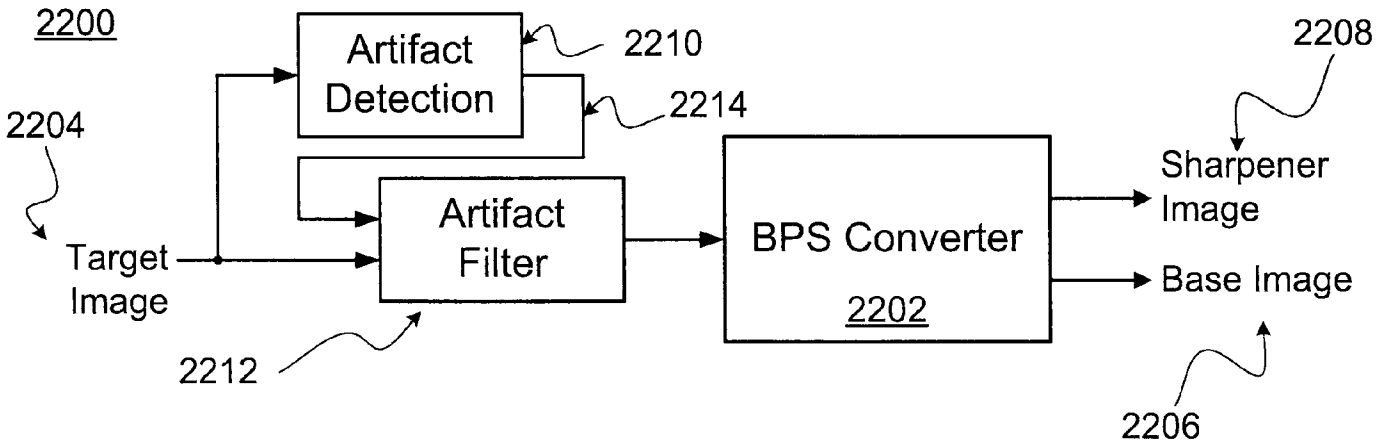
FIG. 22 shows an artifact reducing system employing BPS converter according to one embodiment of the present invention.

FIG. 22 shows a more sophisticated artifact reducing system 2200 for reducing artifacts with BPS and/or block boundary shifting. In system 2200 BPS converter 2202 converts an target image 2204 into base 2206 and sharpener 2208 images, but before doing so, target image 2204 goes to artifact detection module 2210 that controls an artifact filter 2212 that filters target image 2204. Artifact detection module 2210 may be looking for certain combination of colors and/or one or two dimensional patterns and/or both certain combinations of colors and patterns that may cause image artifacts including flickering. Artifact detection module 2210 then sends control signals 2214 to artifact filter 2212 to filter the image only in the cases where an image artifact might occur. There may be different filtering functions performed by filter 2212 based on the type of artifact detected by artifact detection module 2210.

Figure 23:
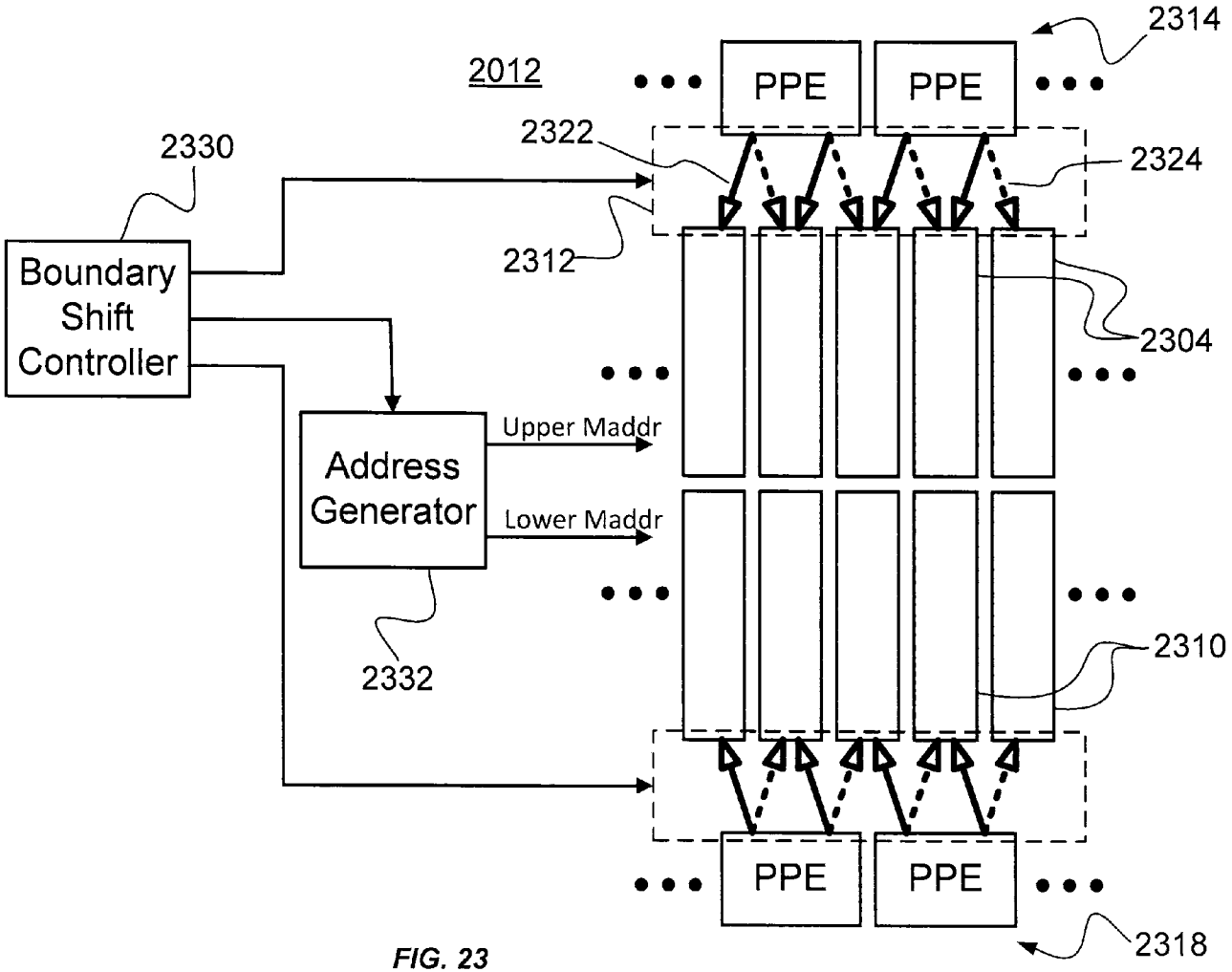
FIG. 23 shows more detail of the operation of a boundary shift controller in accordance with one embodiment of the present invention.

FIG. 23 shows SLM partitioner 2012 in greater detail. As shown in this example, MRRAM array 2004 has columns which are split into upper MRRAM columns 2304, and lower MRRAM columns 2310. Upper switching elements 2312 connect upper PPEs 2314 to upper MRRAM columns 2304, and lower switching elements 2316 connect lower PPEs 2318 to lower MRRAM columns 2310. As an example, upper switching elements 2312 and lower switching elements 2316 will connect the columns as shown with the solid arrows 2322 or as shown with the dashed arrows 2324. Boundary shift controller 2330 will control the upper switching elements 2312 and lower switching elements 2316 to switch between these two possible states as required. As an example, boundary shift controller 2330 may switch the switching elements between each frame being displayed. Boundary shift controller 2330 may also control address generator 2332 to shift the block boundaries vertically by applying an address offset of 1 or negative 1 for the frames in which the block boundaries are to be shifted. If the blocks are shifted as shown in FIG. 19, there may be frames in which some of the blocks will be split between the upper MRRAM and the lower MRRAM. In this case, the data for those blocks may be replicated and sent to both upper and lower halves. This replication may happen either on the controller or on the panel. In FIG. 20 and FIG. 23, one example of an SLM partitioner with a boundary shift controller has been shown, but it will be apparent to one skilled in the art that there may be other implementations of an SLM partitioner and/or a boundary shift controller.

Figure 24:
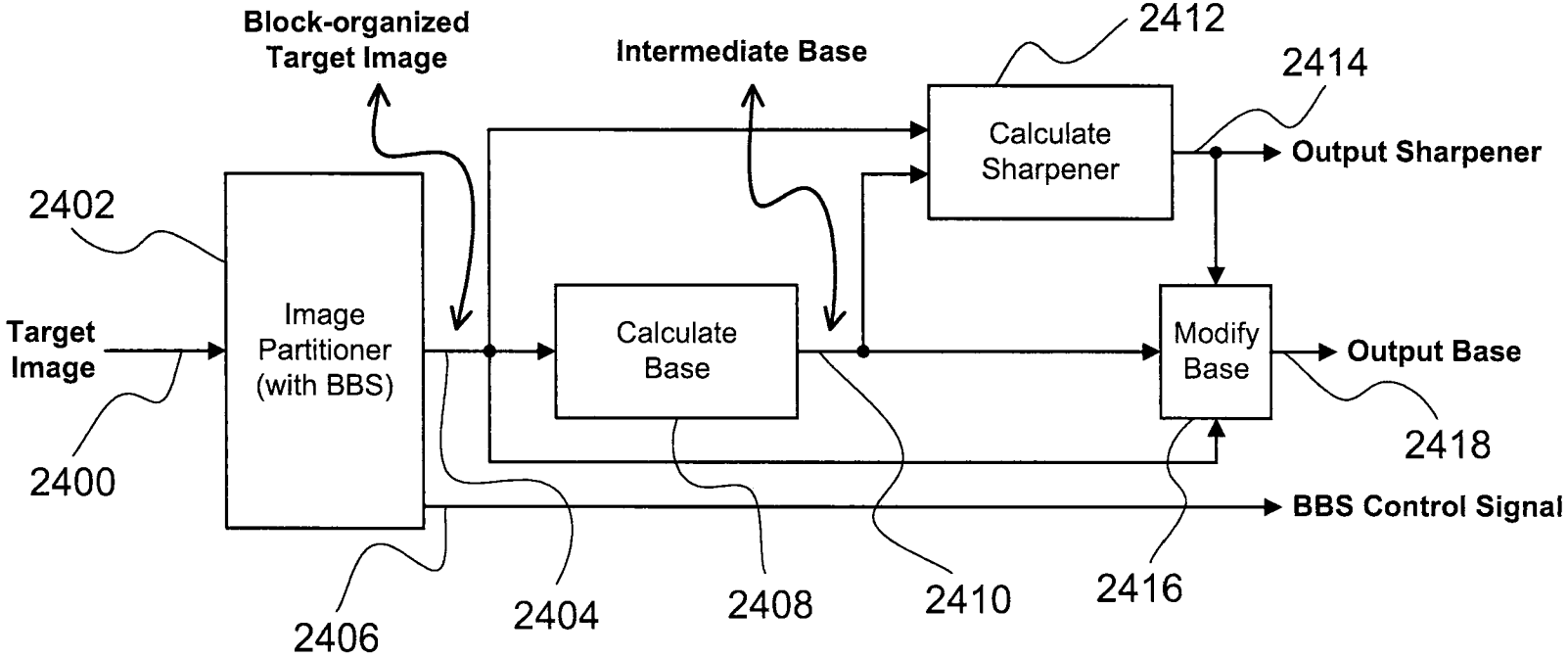
FIG. 24 shows more detail of a BPS converter with an image partitioner in accordance with one embodiment of the present invention.

FIG. 24 shows an example BPS converter which operates on an input target image 2400 and adds functionality beyond the basic BPS converter shown in FIG. 15. Image partitioner 2402 takes target image 2400, which is normally arranged in pixel-organized format and produces block-organized target image data 2404. The blocks in this example are 2 pixels by 2 pixels, thus only one line buffer and some control logic are needed to implement image partitioner 2402. Image partitioner 2402 may also perform block boundary shifting (BBS), and will output a BBS control signal 2406 to the display device (not shown). The display device will use this BBS control signal 2406 to determine how the 2 by 2 blocks will map to pixels in the display (not shown). In this example, the boundaries of the 2 by 2 blocks are shifted horizontally and vertically by one pixel every frame. Calculate base module 2408 takes block-organized target image data 2404 and calculates intermediate base values 2410, one numerical value for each color for each block. Calculate base module 2408 is an example of a first base estimator as described by the cross-correction architecture shown in FIG. 16. Calculate sharpener module 2412 takes intermediate base values 2410 and block-organized target image data 2404 and calculates output sharpener values 2414. Calculate sharpener module 2412 is an example of a first sharpener estimator as described by the cross-correction architecture shown in FIG. 16. Modify base module 2416 takes intermediate base values 2410 and block-organized target image data 2404 and output sharpener values 2414 and uses these to calculate output base values 2418. Modify base module 2416 is an example of a second base estimator as described by the cross-correction architecture shown in FIG. 16.

Figure 25:
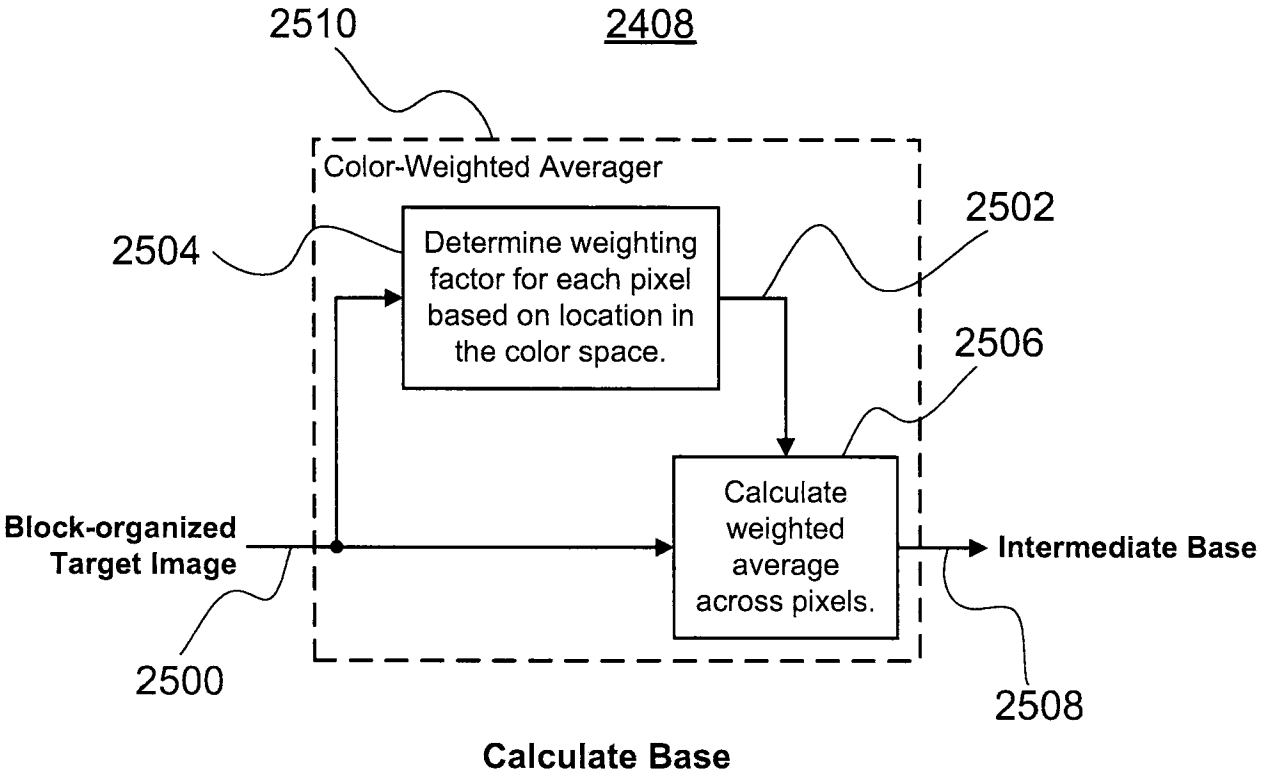
FIG. 25 shows a diagram of a color-weighted averager in accordance with one embodiment of the present invention.

FIG. 25 shows calculate base module 2408 of FIG. 24 in greater detail. In this example, each 2 by 2 block in a block-organized target image 2500 is treated the same, and processed independently. Each of the four pixels in a block is assigned a weighting factor 2502 by weighting calculation module 2504. Weighting factor 2502 is based on that pixels location in the color space. As an example, one method which may be used would be to assign a lower weighting factor to pixels which are close to black (R=G=B=0) or close to white (R=G=B=255). As another example, pixels which would be considered "skin tones" may be assigned a relatively higher weighting factor than non-skin-toned pixels, since generally skin tones are considered important colors in terms of human perception. Weighting factor 2502 is used by weighting averaging module 2506 to calculate a weighted average for each color, the averages taken across pixels in a block. As an example, an RMS average may be used, or a combination of arithmetic average and maximum value may be used to approximate RMS with lower computational complexity. The result of the weighted average is used as an intermediate base value 2508, one numerical value for each color for each block. In at least one embodiment of the present invention, weighting factor 2502 may be chosen as to be a 1-bit number. A weighting factor of zero indicates that the pixel will not be included in the average and a weighting factor of one indicating that the pixel will be included in the average. Also, it should be noted that color-weighted average 2510 shown in FIG. 25 is an example of a color-weighted averager which is not limited to the context of the BPS representation. Any system which calculates a spatial average of pixels with a weighting factor which is determined by the pixel's location in a color space would be a color-weighted averager. Such a system may be used, for example, in a 4:2:0 YCrCb chroma sub-sampling calculation to improve the visual performance, and should be included within the scope of the present invention.

In real world applications images, or parts of images may be thought of has being either "photographic/natural" or "computer-generated/synthetic." In photographic/natural images there tends to be less very sharp edges and in particular abrupt changes in color are very rare. Computer-generated/synthetic images, most particularly text, may change abruptly both in color and intensity. There are well known techniques for detecting parts of images that fall into one of these two categories and this detection may be used to affect the base and sharpener calculations including the color-weighted averager.

Figure 26:
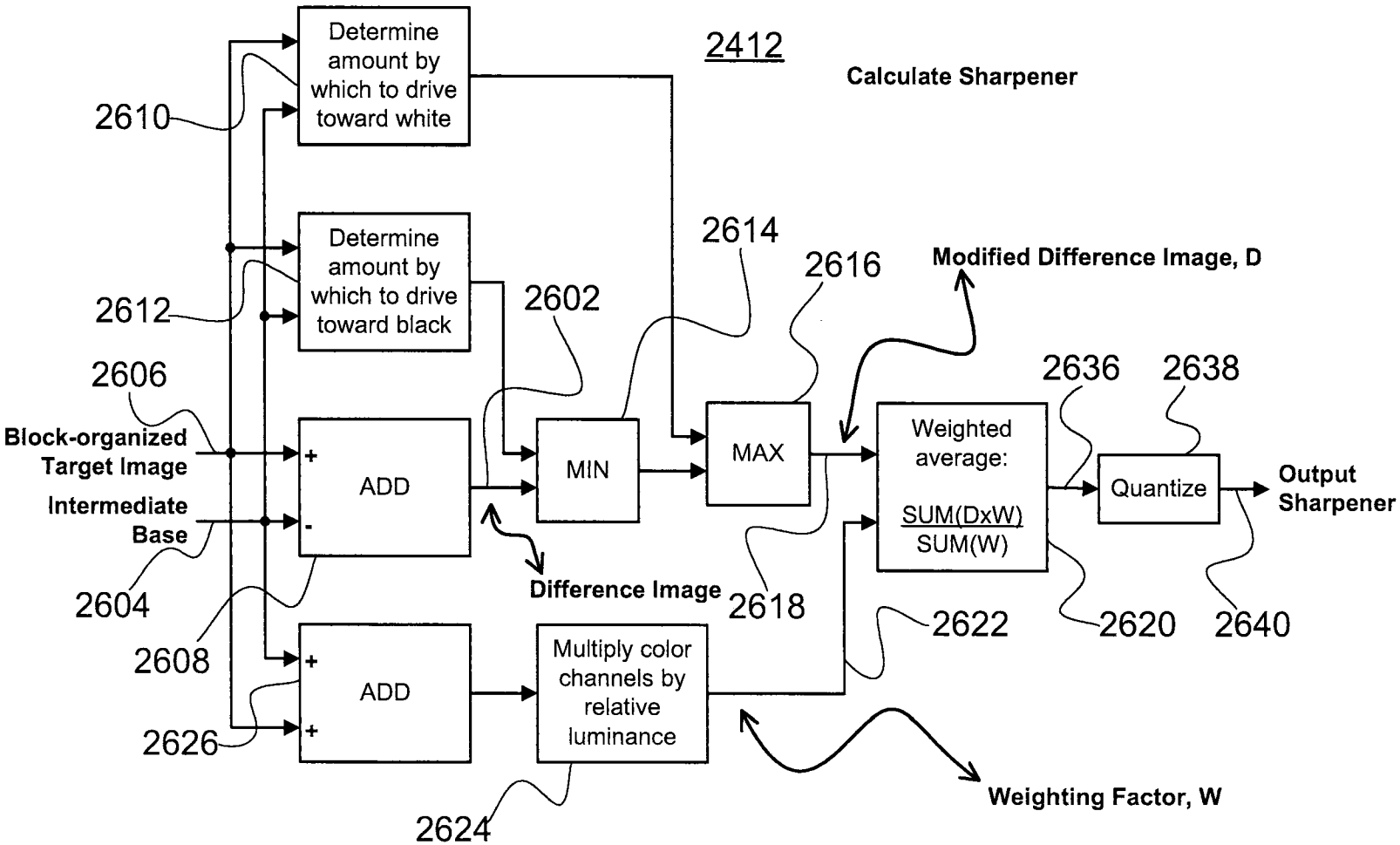
FIG. 26 shows more detail of a "calculate sharpener" unit in accordance with one embodiment of the present invention.

FIG. 26 shows calculate sharpener module 2412 of FIG. 24 in greater detail. A difference image 2602 is first calculated by subtracting an intermediate base value 2604 from a block-organized target image 2606 using adder 2608. Difference image 2602 has full resolution and all colors. Difference image 2602 may then be modified in order to drive certain pixels toward white or toward black. Block-organized target image 2606 is analyzed by a white-adjustment module 2610 and a black-adjustment module 2612 to determine which pixels are close to white or close to black, and the sharpener value which would be needed to drive these pixels toward white or toward black. A modification is then applied to difference image 2602 using a min module 2614 and a max module 2616 in order to create a sharpener that will drive the pixels more towards white or black as desired. The output of max module 2616 is D, a modified difference image 2618. In order to combine modified difference image 2618 into one color, a weighted average across the colors is calculated for each pixel by weighted averaging module 2620. In this example, W, weighting factor 2622, is calculated by luma-weighting module 2624 as the product of the relative luma for that color and the output of adder module 2626 which produces the sum of block-organized target image 2606 and intermediate base value 2604. It is common to multiply red by 0.299, green by 0.587 and blue by 0.144 to convert RGB to its luma value, however, these coefficients may be chosen differently depending on the color points of the primaries being used in the system. Weighting factor 2622 is used to take a weighted average across the color components for each pixel. Weighted averaging module 2620 uses the formula SUM(D×W)/SUM(W) to give weighted average 2636, with the sums being taken across color components. Finally, weighted average 2636 is quantized by quantization module 2638 to give output sharpener 2640. By designing quantization module 2638 to quantize on a log scale, with quantization levels being powers of two, the divider used by weighted averaging module 2620 may be combined with quantization module 2638 to significantly reduce the computation required.

Figure 27:
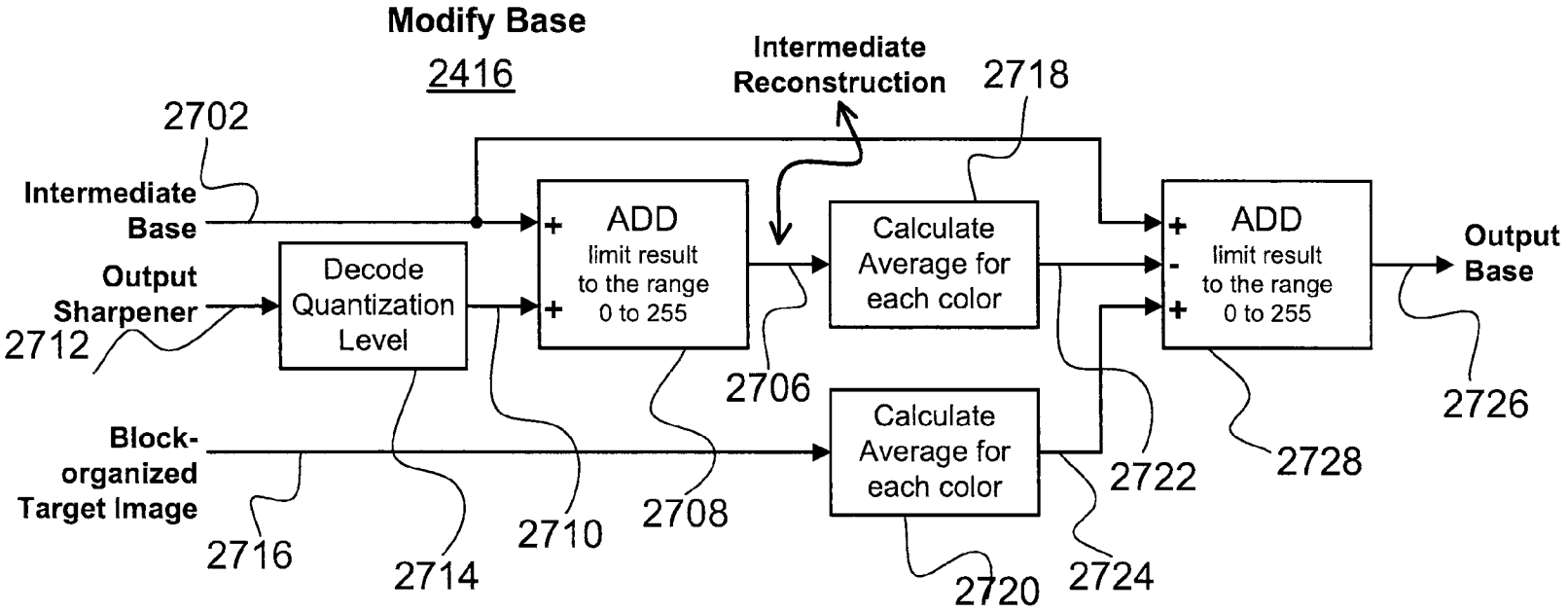
FIG. 27 shows more detail of a "modify base" unit in accordance with one embodiment of the present invention.

FIG. 27 shows modify base module 2416 of FIG. 24 in greater detail. This system modifies intermediate base 2702 which has one value for each color (R, G, B) for each block in order to compensate for the quantization performed in calculate sharpener module 2412 shown in detail in FIG. 26. This is one example of the cross-correction architecture described earlier. An intermediate reconstruction 2704 is calculated by reconstruction module 2708, which adds intermediate base 2702 and decoded sharpener 2710, and limits the result to the range 0 to 255. Decoded sharpener 2710 is the 9-bit value represented by passing 4-bit output sharpener 2712 through decoder 2714. Decoder 2714 decodes the quantized Sharpener back into a 9-bit number (including sign). An exemplary set of decoded sharpener values is shown in Table 1. The average of intermediate reconstruction 2704 and the average of block-organized target image 2716 are calculated by averaging modules 2718 and 2720 respectively. The averages being taken over each block, one average for each color. Averages 2722 and 2724 may be calculated as an arithmetic average or as some other form of average. Output base value 2726 is then computed by adder 2728 as intermediate base value 2702 plus target image average 2724 minus intermediate reconstruction average 2722, with the result limited to the range 0 to 255. If intermediate reconstruction 2704 is very close to or equal to block-organized target image 2716, then intermediate base 2702 is modified very little or not at all.

One skilled in the art would be aware of many ways of improving on this implementation, and all of these should be included in the scope of the current invention. In its most basic form, the invention disclosed here prescribes that the target image be split into two components, one nominally constituting the high frequencies and the other nominally constituting the low frequencies. These two components are then compressed by different methods. These methods may include some combination of decimation or sub-sampling, luma conversion, quantization and other known techniques. The invention also allows for cross-correction to be used between the high- and low-frequency components.

Figure 28:
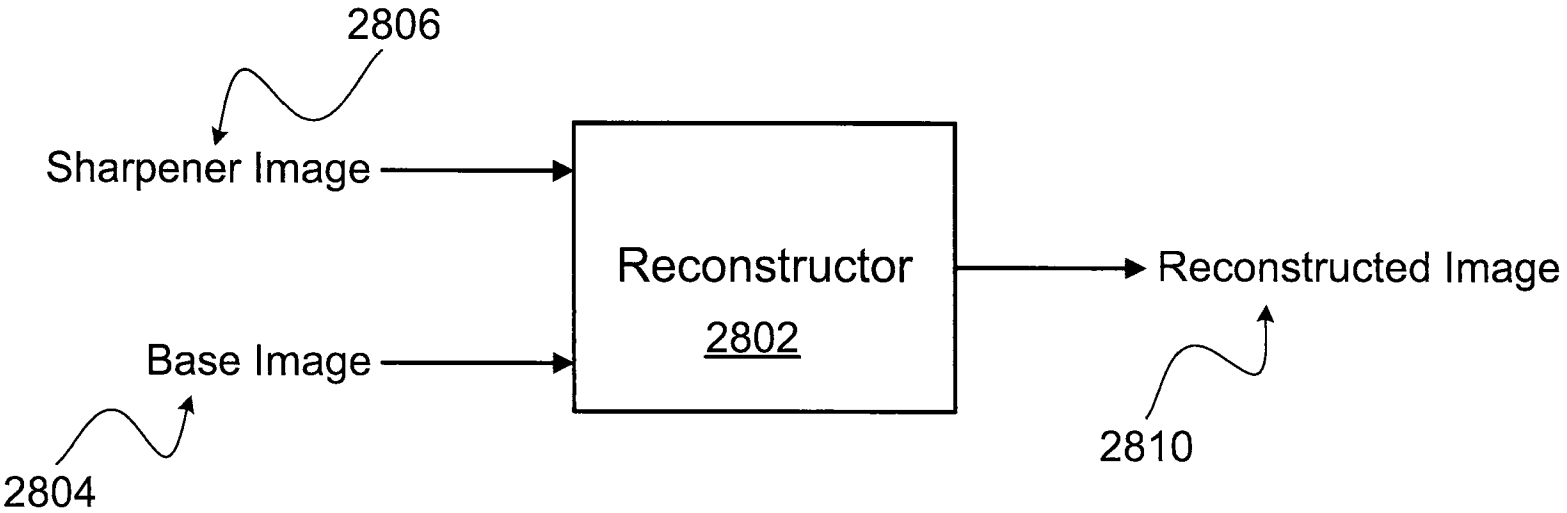
FIG. 28 shows a diagram of a reconstructor in accordance with one embodiment of the present invention.

A reconstruction system required to reconstruct an image from the BPS representation will now be described. Such a system may be referred to as a BPS reconstructor, a drawing of which is shown in FIG. 28. BPS reconstructor 2802 takes a base image 2804 and a sharpener image 2806 and reconstructs a reconstructed image 2810. Reconstructor 2802 may be designed to have low computational complexity. Further examples showing more detail of reconstructor 2802 are provided below.

Figure 29:
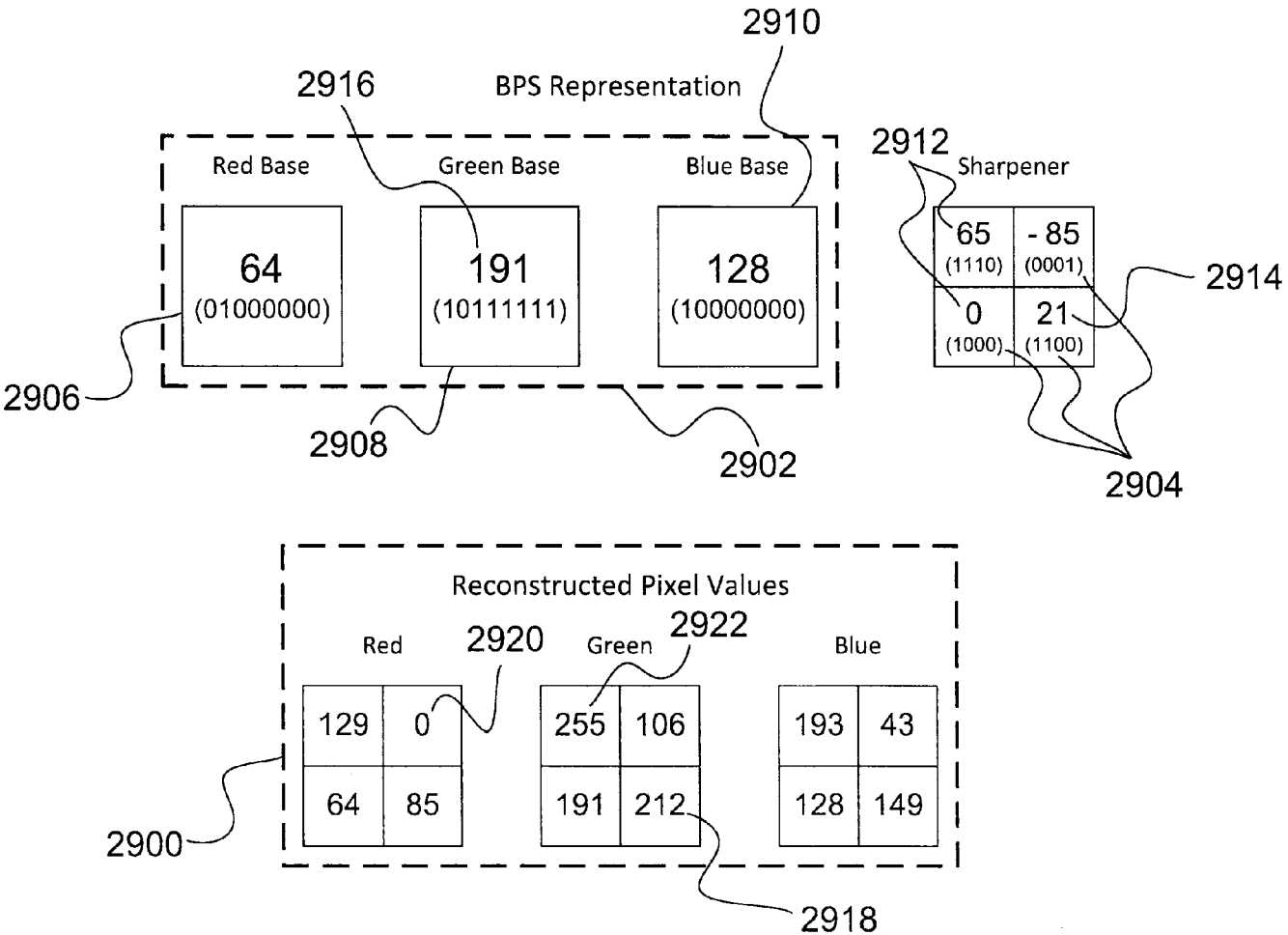
FIG. 29 shows an example for a single 2×2 block of how reconstructed pixel values are determined based on a BPS representation in accordance with one embodiment of the present invention.

An example will now be considered where the reconstructed image is partitioned into 2 by 2 blocks as this allows our reconstruction to be done independently for each block. FIG. 29 shows an example of how reconstructed pixel values 2900 are calculated from color base values 2902 and quantized sharpener values 2904 for a single 2 by 2 block. Only one 2 by 2 block is shown, because each block in the reconstructed image is produced in the same way. As can be seen in FIG. 29, for this example system, there is only one red base value 2906, one green base value 2908, and one blue base value 2910 stored for each block. Four sharpener quantized values 2904 are also stored, one for each pixel, with each of sharpener values 2904 being shared across all colors. Quantized sharpener values 2904 are binary numbers that are stored in memory and are shown in parentheses. Decoded sharpener values 2912 are obtained in this example from stored quantized sharpener values 2904 according to Table 1. For example, the lower right pixel 2914 has a sharpener value 'b1100 in binary which via Table 1 represents the decoded sharpener value 21. One sharpener value per pixel in the 2 by 2 block is used, and is applied to all three colors. Decoded sharpener values 2912 effectively add or subtract a certain intensity value from each pixel.

To calculate one reconstructed pixel color value, the decoded sharpener value is added for that pixel location to the color base value for that color. So for example, adding lower right decoded sharpener value 2914 of 21 to green base value 2916 of 191 gives 212, lower right green reconstructed value 2918. Note that if the result of the addition is negative (as it would have been from the upper right red pixel 2920) that pixel may be clamped at zero. It may actually be replaced with zero using logic or simply treated as if it were a zero, due to the way it is handled further down the data path. Similarly, as in the case of upper left green pixel 2922, a result larger than 255, should either be replaced with a 255 or treated equivalently by subsequent operations.

One important feature of this method is the low computational complexity required for calculating reconstructed pixel values 2900 from stored color base values 2902 and quantized sharpener values 2904. In this case, only one addition and zero multiplies per pixel per color are required, which is different from YUV/YCbCr with chroma subsampling, which typically requires at least two multiplies and two additions to reconstruct each green pixel value and one multiply and one addition to reconstruct each blue or red pixel value.

The partitioning of the reconstructed image into 2 by 2 bocks is not a fundamental component of the present invention. An equivalent reduction in storage requirements may be achieved by storing only one red, one green and one blue value per block, while using a more advanced technique to interpolate these signals; for example, one may use one or two dimensional finite impulse response (FIR) filtering.

Additional storage reduction techniques may be used in combination with the present invention to further reduce the storage needed. For example, the color base values may be further compressed using a frequency-space-based or wavelet-based compression technique or some other image compression technique.

One additional method which may be used to reduce the required storage is referred to as "bit sharing." This method entails identifying certain bit positions which may be shared across the data. For example, the least significant bit (LSB) of the red base value may be shared with the LSB of the green base value and may additionally be shared with the LSB of the blue base value. This technique attempts to exploit more of the shared information inherent in most image data. Bits may also be shared across some or all of the sharpener values in a block. Let us consider how bit sharing may be used to reduce the storage further. As can be seen FIG. 29, in order to represent one block of data, a total of 40 bits are stored using the BPS representation. Now suppose that bit sharing across the LSBs of the RGB base data is used, and across the LSBs of the sharpener data. In this case, the value of the LSB is forced to be the same for red, green and blue and so may be stored in the same memory location. The base values will then require 7 bits for red, 7 for green and 7 for blue, plus one shared LSB, giving 22 bits for the base values, as compared with 24 without bit sharing. The sharpener values would require 3 bits each for the upper left, upper right, lower left and lower right values, plus an additional shared bit, giving 13 bits instead of 16. The total number of bits is therefore reduced from 40 without bit sharing to 35 for this example. More bits may be shared to reduce the storage required further, at the expense of image quality.

It will be understood by one skilled in the art that it would be possible to generate the BPS values without first having to have a target image. For example, there may be a drawing engine that directly produces the BPS values.

Figure 30:
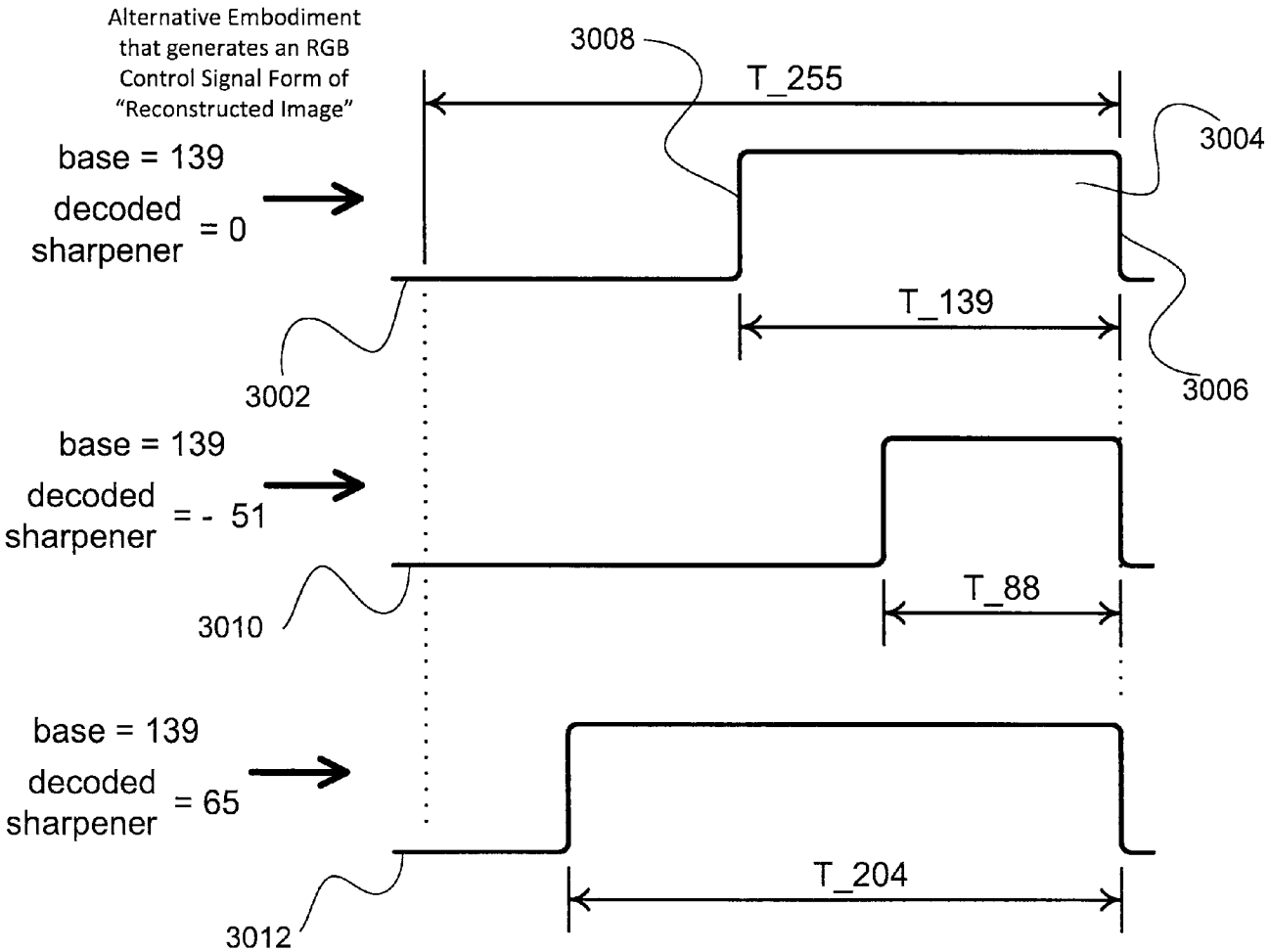
FIG. 30 shows exemplary pixel drive waveforms in accordance with one embodiment of the present invention.

We will now turn our attention to the system used to display an image which has been converted to the BPS representation. FIG. 30 shows an example of drive waveforms used in a pulse width modulated display. Waveform 3002 shows an example of an unsharpened pulse. The term "unsharpened" means that the decoded sharpener value is zero. This scheme uses a single pulse 3004, which is right-aligned. The term "right-aligned" means that the falling edge 3006 of the pulse 3004 occurs at the end of the field time, and the location of the rising edge 3008 is adjusted to produce the desired pulse width. Take as an example a base value of 139, which gives a pulse of width T_139. In general pulse widths T_0, T_1, T_2, T_255 are associated with pixel values 0, 1, 2, . . . 255, respectively. The widths may be chosen arbitrarily and will usually be chosen so that when taking into account the effects of liquid crystal rise and fall curves and illumination rise and fall curves, etc., the desired intensity of the on screen pixel is achieved, including any gamma correction desired. The time T_255 will be the field time since a value of 255 indicates that the pixel should remain on for the entire field. For waveform 3010, the base value is still 139, but the decoded sharpener value is negative 51. The corresponding pulse width is T_88 (the time associated with a pixel intensity of 88), since 139 minus 51 gives 88. For waveform 3012, the base value is still 139, but the sharpener value is positive 65. This results in a pulse whose width is T_204 (the time associated with a pixel intensity of 204), since 139 plus 65 provides a pixel intensity of 204.

The waveforms shown in FIG. 30 generally represent the signals on MRRAM mirrors/electrodes 132 of FIG. 1 which are driven by the RGB control signal form of the reconstructed image 130 of FIG. 1.

Figure 31:
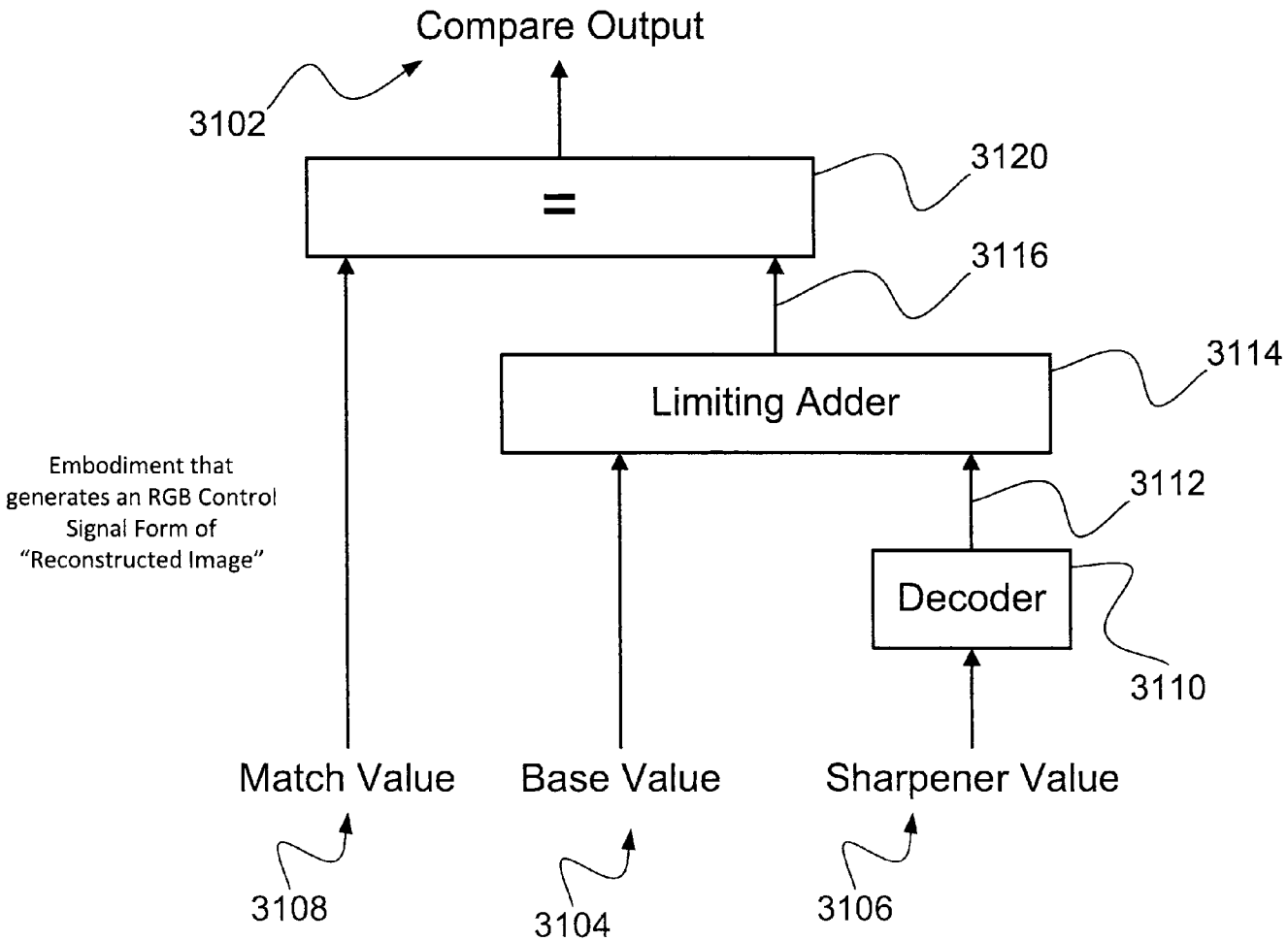
FIG. 31 shows a diagram of an arithmetic unit for calculating a compare output in accordance with one embodiment of the present invention.

The waveforms shown in FIG. 30 may be produced by a system consisting of a BPS reconstructor, followed by the match-based drive system described above which uses PPEs with equal-based comparators. FIG. 31 shows an example of a portion of a PPE which may be used in such a system. A compare output 3102 is determined based on a base value 3104 and a sharpener value 3106 and on a match-value 3108 for a particular compare stage. This circuit may be used in a PPE designed to produce the drive waveforms as shown in FIG. 30. In FIG. 31, a decoder 3110 produces a decoded sharpener value 3112 based on a sharpener value 3106. Decoder 3110 implements decode function, an example of which is shown in Table 1. An adder 3114 then adds decoded sharpener value 3112 to base value 3104 to produce a reconstructed pixel value 3116. In this example, the adder 3114 is a limiting adder and will limit its output to the range 0 through 255, which is the range of possible reconstructed pixel values. Reconstructed pixel value 3116 is then compared against a match-value 3108 for the current compare stage, using comparator 3120 to determine if the drive waveform should be switched as shown in FIG. 30.

As mentioned before, the BPS representation is very well suited to a field sequential display, and is also very well suited to a pulse width modulated display. In fact, the reconstruction may be accomplished without the need to explicitly perform either the decode operation or the mathematical addition shown in FIG. 31. Instead an implied addition occurs. The basic idea is that one edge of the pulse is controlled by the color base value, and the other edge is controlled by the sharpener value, in such a way that the total width of the pulse produced is based on the sum of the base value and decoded sharpener value.

The implied addition concept will be described using the example shown in FIG. 32. In this example, a main pulse 3202 is used which is right-aligned, and which is controlled by the base value. As the base value increases, main pulse 3202 grows toward the left of the field time. An example base value of 139 would give a waveform 3204, whose width is T_139. The base value controls a left (rising) edge 3206 of main pulse 3202. If the decoded sharpener value is negative, as shown for waveform 3208, the sharpener controls a right (falling) edge 3210 of main pulse 3202. As shown in this example, a decoded sharpener value of negative 51, causes right edge 3210 to be shifted to the left by T_51, which results in a pulse whose width is (T_139-T_51). Note that if the base value were less than 51, then the left edge and the right edge would cross each other, thus eliminating the pulse altogether. If the sharpener value is positive as shown for waveform 3212, a left-aligned secondary pulse 3214 is introduced. The term "left-aligned" means that the rising edge of the pulse occurs at the start of the field time. In this case, the base value still controls rising edge 3206 of main pulse 3202, but the sharpener now controls the falling edge 3216 of secondary pulse 3214. Falling edge 3216 may, as an example, be located at time T_190 from the end of the field time. This is because the decoded sharpener value is positive 65, and 255-65 gives 190. This means that if the base value were 190 or larger, main pulse 3202 and secondary pulse 3214 would merge into one large pulse which fills the entire field time.

It should be noted that secondary pulse 3214 may be thought of as being a continuation of the first main pulse 3202 but wrapped around in time, since the end of one field is the beginning of the next field. This wrap-around effect is made clearer in FIG. 33 which shows and example with multiple color fields. It should be noted that various embodiments of the present invention may use the implied addition method shown in FIG. 32, or the computed reconstruction method shown in FIG. 30, or some other method. For example, a hybrid scheme in which a negative sharpener is implemented by shifting the right edge of the pulse as shown in waveform 3208, and a positive sharpener may be implemented using a waveform 3012. Different embodiments may have various advantages with respect to power consumption, hardware gate count required, memory usage or achievable color field rate.

Figure 32:
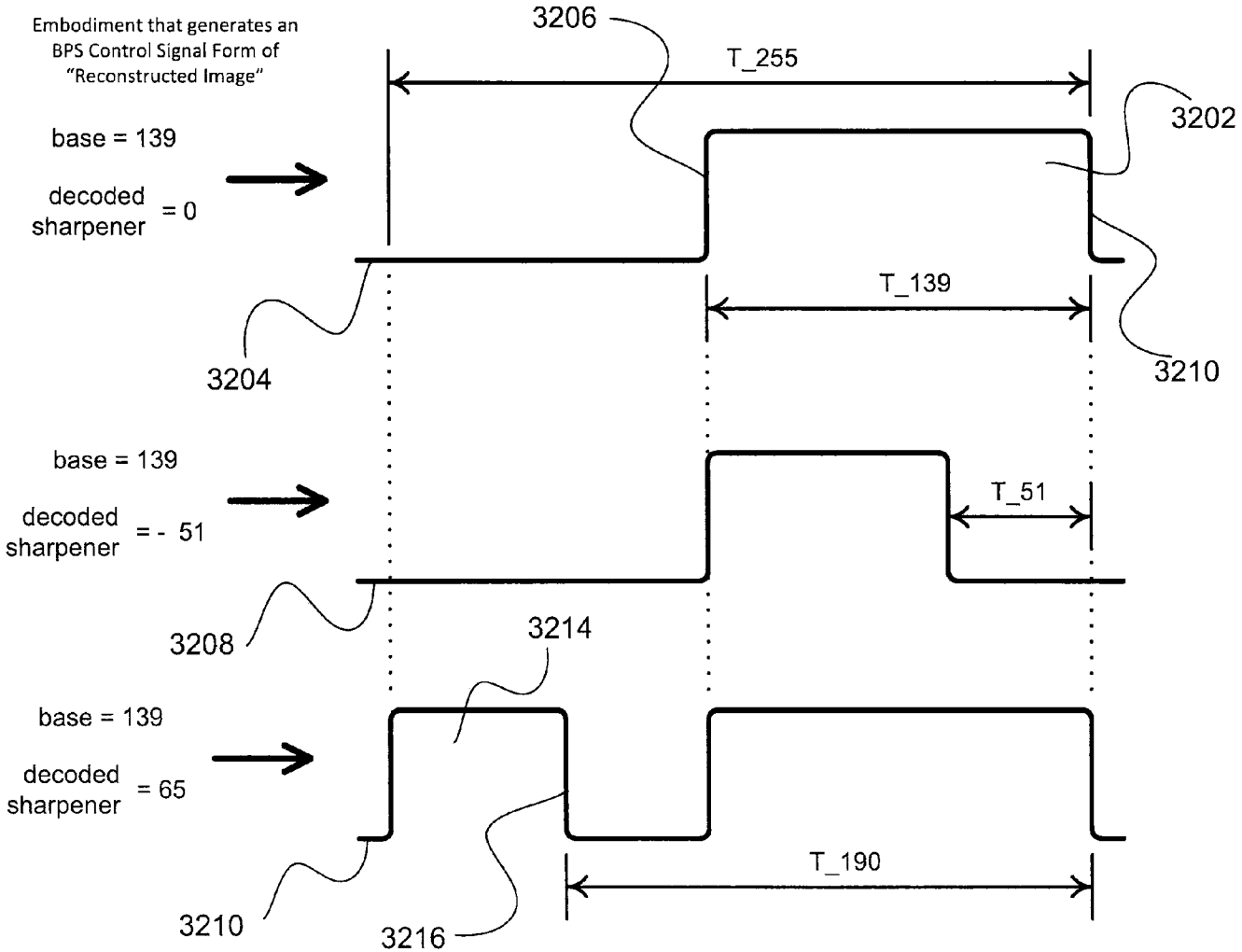
FIG. 32 shows exemplary pixel drive waveforms which performs an implied addition in accordance with one embodiment of the present invention.

The waveforms shown in FIG. 32 generally represent the signals on MRRAM mirrors/electrodes 162 of FIG. 1 which are driven by the BPS control signal form of reconstructed image 160 of FIG. 1.

Figure 33:
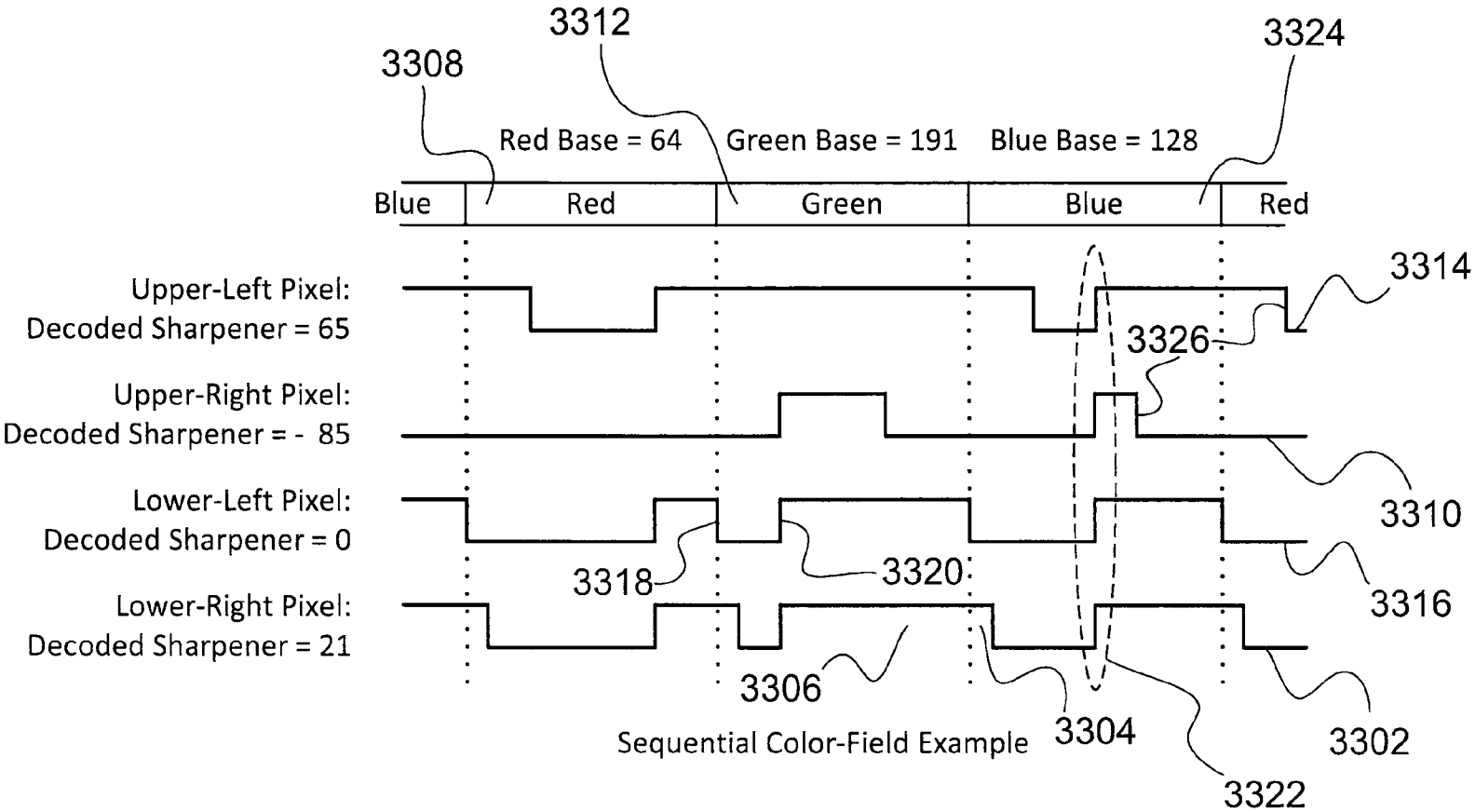
FIG. 33 shows exemplary pixel drive waveforms demonstrating the wrap-around effect in accordance with one embodiment of the present invention.

FIG. 33 shows an exemplary set of pulse waveforms for the four pixels in the example block from FIG. 29. It can be seen in lower-right pixel waveform 3302 that a secondary left-aligned pulse 3304 of a particular color field may also be thought of as a continuation of main pulse 3306 from the previous color field. This is how it possible to say that the base values control one edge of the pulse and the sharpener values control the other edge. It is understood that sometimes pulses might disappear altogether as is the case for red field 3308 in an upper right pixel waveform 3310, or the gaps between pulses might disappear as is the case for green field 3312 for upper left pixel waveform 3314, depending on the base and sharpener values. For lower-left pixel waveform 3316, each color has a pulse whose width is determined by the desired base-value-only, since the decoded sharpener value is zero for that pixel. A right edge 3318 of the pulse is fixed, and a left edge 3320 is adjusted to produce the correct color base value. In this example, the color base values are shared across four different pixels. Thus the four waveforms have a shared left edge, which can be seen by observing rising edges 3322 for the blue field 3324. Right edge 3326 is then controlled by the sharpener value, which is shared across all colors. When the decoded sharpener value is negative and has larger amplitude than the base value, the right edge may cross the left edge, causing the pulse to disappear altogether. In the FIG. 33, this has happens for red field 3308 of upper right pixel waveform 3310. Similarly, if the sharpener is positive, as the left edge gets shifted to the left it may be shifted past the point where it crosses the right edge of the previous pulse causing the space between the pulses to disappear altogether. This can be seen in FIG. 33 for green field 3312 of upper left pixel waveform 3314. Even though certain pulse edges have disappeared, it still possible to say that all 4 pixels share a rising edge because the pulse edge would be there if it had not disappeared.

In order to better understand the waveform-based reconstruction system, a very simplified example will be described below. Instead of the 16 sharpeners of Table 1, in this example only 4 possible sharpener values (i.e., a 2-bit sharpener) are used as shown in Table 2. Also, the number of base values is reduced from 256 down to only 16 possible base values (i.e., a 4-bit base). The allowable base values are 0 through 15, and the allowable sharpener values are shown in the Table 2.

TABLE 2

| Quantized Sharpener (decimal) | Quantized Sharpener (binary) | Decoded Sharpener |
|---|---|---|
| 0 | 'b00 | −10.5 |
| 1 | 'b01 | 0 |
| 2 | 'b10 | 3.5 |
| 3 | 'b11 | 13.5 |

Figure 34:
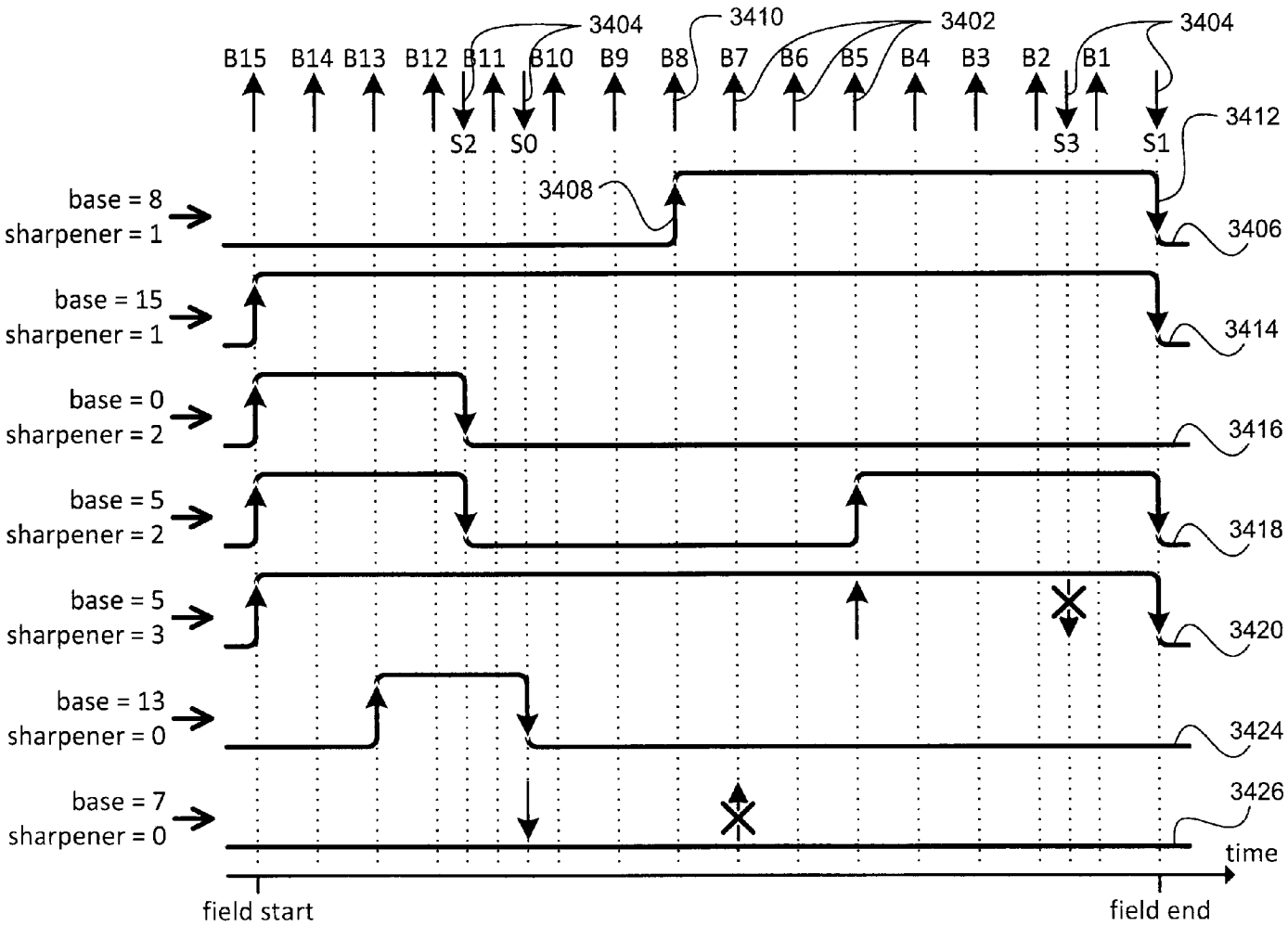
FIG. 34 shows exemplary pixel drive waveforms for a simplified example for a single color field in accordance with one embodiment of the present invention.

There are 15 possible rising pulse edges, one for each non-zero base value, and 4 possible falling edges, one for each sharpener value. All possible pulse edges are shown in FIG. 34. Possible rising edges, or "high writes" 3402, shown as upward pointing arrows represent the possible times at which a 1 may be written to MRRAM, and all rising pulse edges occur at one of these times. High writes 3402 are labeled B1 through B15 corresponding to the base values of 1 through 15. The possible falling edges or "low writes" 3404, shown as downward pointing arrows represent the possible times at which a 0 may be written to MRRAM. Low writes 3404 are labeled S0 through S3, and correspond to sharpener values of 0 through 3. In general, the high write or low write occurs if the base or sharpener is equal to the corresponding value. So if the base is 1, the B1 high write occurs, and if the base is 2 the B2 high write occurs and so on, and if the sharpener is 0, the S0 low write occurs and if the sharpener is 1, the 51 low write occurs, and so on. There are some important exceptions to this rule, which will be described in several examples below.

The waveforms for all possible combinations of base and sharpener values may be made using only high writes 3402 and low writes 3404. Waveform 3406 shows an example of an unmodified or unsharpened base pulse. For waveform 3406, the base value is 8 and the sharpener value is 1, which from Table 2 represents a decoded sharpener value of zero. Rising edge 3408 occurs at B8 high write 3410 since the base value is 8. The falling edge 3412 occurs at the end of the field time, at the 51 low write. As the base value increases, the pulse to grow toward the left until it fills the entire field time at which point, the base value is 15, as shown in waveform 3414. Waveform 3416 shows an example where the base value is zero, and the decoded sharpener value is positive. In this case, because the base value is zero, there is no main pulse, only the secondary pulse exists. Note that the high write at the start of the field, labeled B15, is still needed to form this secondary pulse, even though the base value is not equal to 15. Waveform 3418 shows an example in which there is both a main pulse and a secondary pulse. Note that in this case, the low write at the end of the field labeled S1 is done even though the sharpener value is not 1. It should be noted that the high write at the beginning of the field and the low write at the end of the field are special cases which need to be dealt with appropriately.

Now compare waveform 3418 with waveform 3420. For waveform 3418, the sharpener value is 2, which causes low write S2 to be used and serves as the falling edge of the secondary pulse. If the sharpener value is increased to 3 as shown in waveform 3420, the secondary pulse has grown to the point where it merges with the main pulse to give one large pulse which fills the entire field time. The low write has now crossed the B5 high write, and so it can be seen that in order to produce the desired pulse shape, the S3 low write must be prevented from happening. Otherwise, the falling edge of the pulse would occur too early. In general, whenever the base value plus the decoded sharpener value is bigger than 15 (the maximum base value), then the two pulses have merged, and the low write normally caused by the sharpener needs to be prevented.

Now compare waveform 3424 and waveform 3426. This example demonstrates what happens if there is a negative decoded sharpener value. For both waveforms, the sharpener value is zero, which from Table 2 corresponds to a decoded sharpener value of negative 10.5. For waveform 3424, the base value is 13, which is larger than 10.5, so the main pulse still exists. For waveform 3426, the base value has dropped to 7, which is less than 10.5, and so the main pulse has disappeared altogether. The desired waveform in this case would be for the drive signal to stay low for the entire field time. In order to achieve this, the B7 high write must be prevented as shown. In general if the decoded sharpener value is negative, and the base value is smaller in magnitude than the sharpener value, then the high write and the low write will cross each other, and the high write must be prevented in order to maintain the correct waveform shape.

In at least one embodiment of the present invention, the waveforms shown in FIG. 32, FIG. 33 and FIG. 34, may be produced by executing a sequence of match instructions. These match instructions being interpreted by a PE module operable to write either a 1 or 0 to the MRRAM. Two match-values are used; one for the base and one for the sharpener. It is possible to produce the required pulse shapes using only match instructions of the following form: at time (time) write a (high/low) to MRRAM if Base (compare operator) (value) (and/or) Sharpener (compare operator) (value).

Parentheses indicate parts of the match instruction that are programmable. For example, a valid match instruction would be: "at time 4.7 write high to MRRAM if Base=5 and Sharpener <3."

The time given in the instruction may be relative to the start of the field, the prior operation, or some other time or event. These instructions are executed at prescribed points in time, as desired to give the drive pulses their desired widths.

The set of instructions given in Table 3 achieves the desired pulse shapes for the present simplified example. This set of instructions assumes that the MRRAM is initially set to zero and that the final MRRAM value is also zero. One skilled in the art will understand that at the boundary between fields, because of the wrap-around effect, the MRRAM may not need to be set to zero, and that the set of instructions in Table 3 may be modified in order to accomplish this.

TABLE 3

| |
|---|
| at time B15 write high to MRRAM if Base = 15 or Sharpener ≥ 2 |
| at time B14 write high to MRRAM if Base = 14 and Sharpener < 2 |
| at time B13 write high to MRRAM if Base = 13 and Sharpener < 2 |
| at time B12 write high to MRRAM if Base = 12 and Sharpener < 2 |
| at time S2 write low to MRRAM if Base < 12 and Sharpener = 2 |
| at time B11 write high to MRRAM if Base = 11 and Sharpener < 3 |
| at time S0 write low to MRRAM if Base ≥ 11 and Sharpener = 0 |
| at time B10 write high to MRRAM if Base = 10 and Sharpener ≥ 1 |
| at time B9 write high to MRRAM if Base = 9 and Sharpener ≥ 1 |
| at time B8 write high to MRRAM if Base = 8 and Sharpener ≥ 1 |
| at time B7 write high to MRRAM if Base = 7 and Sharpener ≥ 1 |
| at time B6 write high to MRRAM if Base = 6 and Sharpener ≥ 1 |
| at time B5 write high to MRRAM if Base = 5 and Sharpener ≥ 1 |
| at time B4 write high to MRRAM if Base = 4 and Sharpener ≥ 1 |
| at time B3 write high to MRRAM if Base = 3 and Sharpener ≥ 1 |
| at time B2 write high to MRRAM if Base = 2 and Sharpener ≥ 1 |
| at time S3 write low to MRRAM if Base < 2 and Sharpener = 3 |
| at time B1 write high to MRRAM if Base = 1 and Sharpener ≥ 1 |
| at time S1 write low to MRRAM if Base ≥ 1 and Sharpener ≥ 1 |

The times B15, B14, S2, etc. represent the locations in time of the possible pulse edges shown in FIG. 34. The instructions given in Table 3 represent one possible set of instructions which produce the desired waveforms, and it will be understood that some or all of these instructions may be modified in such a way as to not alter the final desired waveform shapes.

The sequence of match instructions shown in Table 3 or generally any sequence of match instructions is implemented as a sequence of pixel code controls, such as the exemplary PCC of FIG. 4, i.e., PCC 402.

Figure 35:
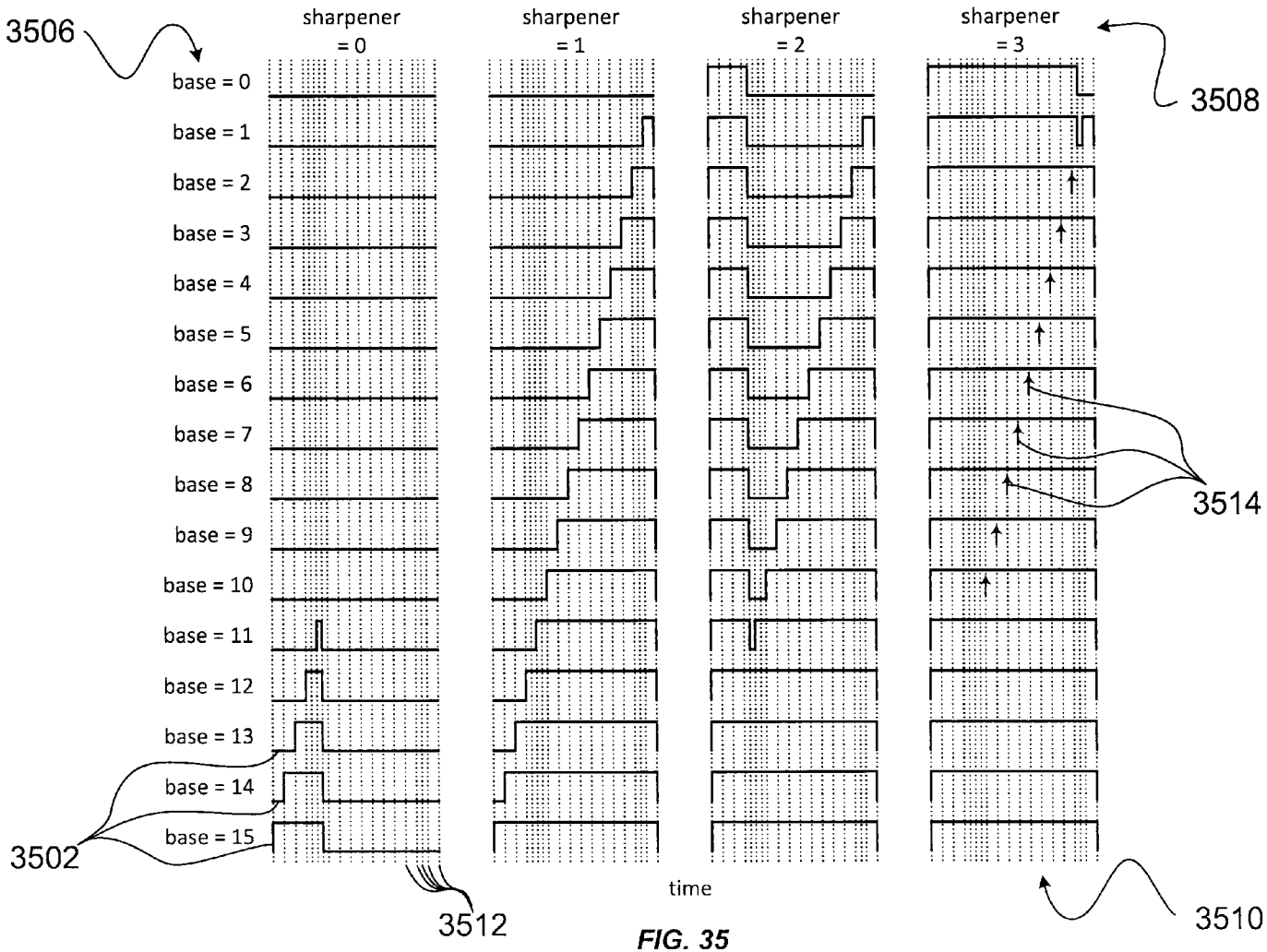
FIG. 35 shows pulse waveforms for all possible combinations of a 4-bit base and 2-bit sharpener system which would result from the exemplary list of match instructions in accordance with one embodiment of the present invention.

FIG. 35 shows a matrix of waveforms 3502 which represent all possible combinations of base values 3506 and sharpener values 3508 for this simplified example using the set of instructions given in Table 3. Note that in FIG. 35, column 3510 labeled "Sharpener=3" is referring to the quantized sharpener value being equal to 3, which from Table 2, corresponds to a decoded sharpener value of positive 13.5. Dotted lines 3512 represent the possible pulse edge locations B15, B14, . . . S1 as drawn in FIG. 34. In this example, some unnecessary high writes 3514 are produced by the set of instructions given in Table 3, however, these do not affect the pulse waveforms, since in all cases the drive signal would have already been high.

In order to allow memory to free up so as to begin loading data for the next field, a PMSK may also be used as described earlier. In this case however, there are two comparisons, and so two mask values are used, with a first PMSK applied to the Base comparison and a second PMSK applied to the Sharpener comparison. Also, to further support freeing up of storage on the panel, the result of the match compare may be used to modify the data stored in ERAM. For example, if a match occurs, the unmasked ERAM data may be replaced by all 0 values. This eliminates the occurrences of redundant writes which are introduced by masking of the MSBs. By combining the use of masked comparisons and ERAM rewriting, it is possible to free up memory for the base values as described previously. This allows us to preload almost all of the base bit planes for the next color field during a current color field. Field blanking may then be made to be very short or even removed all together. Very short field blanking is useful for several reasons including enabling the longer light-on time for increasing brightness and allowing higher field rate.

In at least one embodiment of the present invention, bits may be masked at the beginning of the field. This is done to allow the field to start before all bits have been brought in. For example, a mask value of 00000001 may be used for the first several counts while the LSB is still loading. When the LSB has finished loading, the mask value may be switched to 00000000, so that all bits are used. This technique allows for very small or zero blanking time between fields.

As will be understood by one skilled in the art, the hardware described previously is perfectly capable of generating any arbitrary waveform based on a series of match stages. While a single pulse is shown in the figures, it is also possible to produce more than one pulse depending on the match instructions used.

In at least one embodiment of the present invention, the display may show color fields which are in addition to the usual red, green and blue color fields, such as white, yellow, magenta, cyan and amber, using colors other than R, G and B will be referred to as "multi-primaries." In such cases, it should be understood that any processing done on the R, G or B color signals or to combine the R, G and B color signals may also be done on the extra color data on any of the multi-primaries in an analogous fashion, by treating the extra color as a fourth primary color, or fifth primary color or sixth primary color, and so on.

In at least one embodiment of the present invention, it may be desirable for purposes of improving the visual quality of the displayed image to use a locking indicator for at least one of the colors used. This locking indicator would indicate if the sharpener values would be applied to that particular color. If for example, the red locking indicator were set to true (1), then the red displayed value would be locked, meaning it would be treated as if the sharpener terms were all zero. In that case only the red base value would be used to reconstruct the red pixel values for that block, and not the sharpener values.

Figure 36:
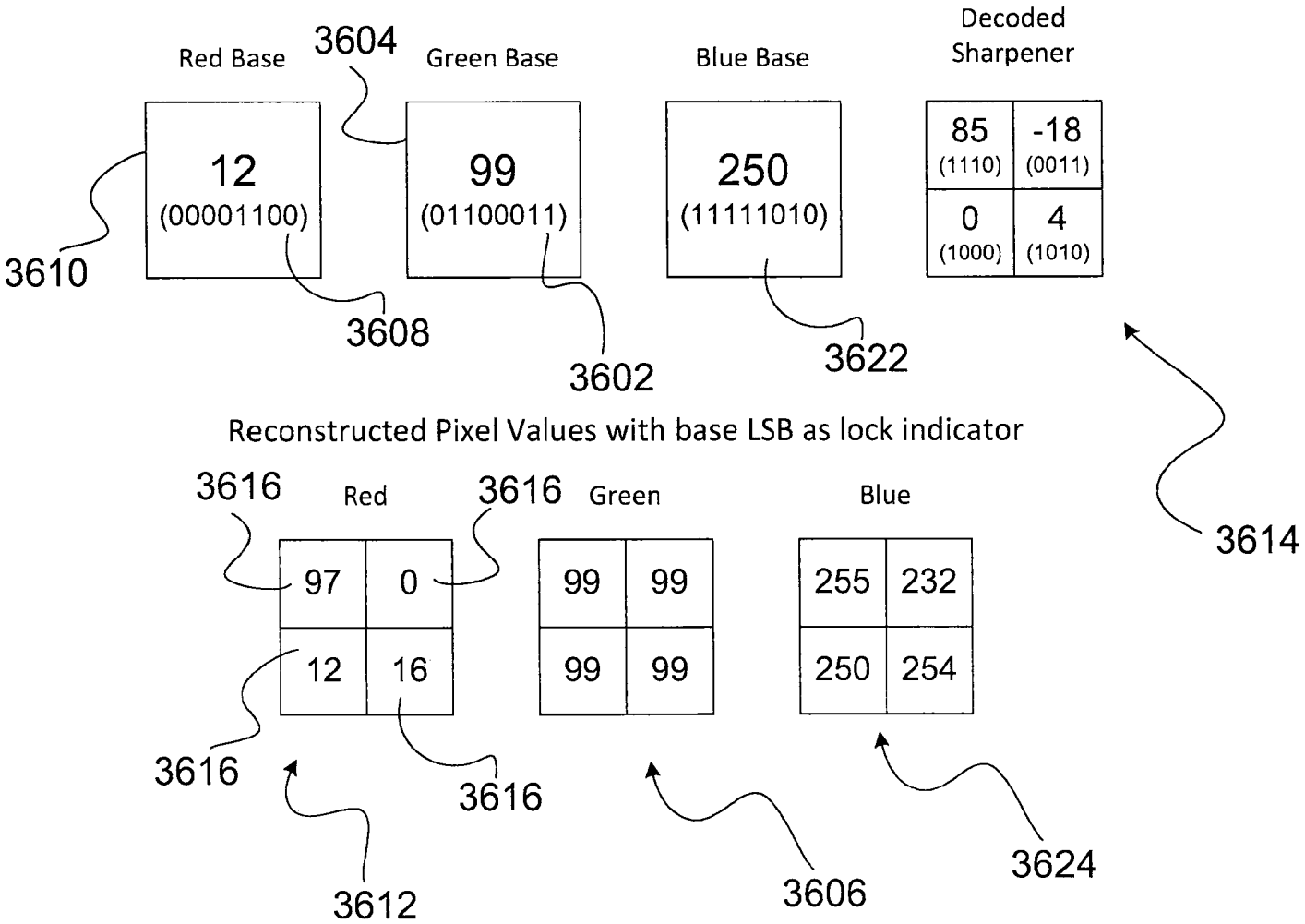
FIG. 36 shows an example of a color-locking indicator in accordance with one embodiment of the present invention.

In at least one embodiment of the present invention, one of the bits of the color base value may be used as a locking indicator. If a particular color is "locked," this means that the sharpener values are not applied to that color for a given block of pixels. For example, if the LSBs of the color base values are used as color-locking indicators, then an odd value for the red base would, for example, mean that the sharpeners are not applied to red for that block, where as an even value would mean that sharpeners are applied to red. One skilled in the art will realize that instead of one bit of the base value being used as the color-locking indicator, some combination of multiple bits may be used. The different choices of which bits to use and how to use them may have various relative advantages with respect to each other. FIG. 36 shows an example in which an LSB 3602 of a color base value 3604 is the color-locking indicator. In the example shown in FIG. 36, the sharpeners are not applied to green channel 3606, because LSB 3602 of green base value 3604 is 1. LSB 3608 of red base value 3610 is 0, and so red channel 3612 remains unlocked, and so sharpener values 3614 are added to red base value 3610 to provide reconstructed red pixel values 3616 in red channel 3612. This use of color-locking indicators gives added flexibility in better matching the target image. Also shown in FIG. 36 is blue base value 3622 and blue channel 3624.

Unless specified otherwise, the various digital components of the present invention may comprise hardware and/or software.

All documents, patents, journal articles and other materials cited in the present application are incorporated herein by reference.

Having described the many embodiments of the present invention in detail, it will be apparent that modifications and variations are possible without departing from the scope of the invention defined in the appended claims. Furthermore, it should be appreciated that all examples in the present disclosure, while illustrating many embodiments of the invention, are provided as nonlimiting examples and are, therefore, not to be taken as limiting the various aspects so illustrated.

While the present invention has been disclosed with reference to certain embodiments, numerous modifications, alterations and changes to the described embodiments are possible without departing from the spirit and scope of the present invention, as defined in the appended claims. Accordingly, it is intended that the present invention not be limited to the described embodiments, but that it have the full scope defined by the language of the following claims, and equivalents thereof.

What is claimed is:

1. A device comprising a spatial light modulator comprising:

a pixel array, and a plurality of processing elements, wherein a pixel drive for each respective multi-primary color of each pixel of the pixel array is determined by one or more processing elements of the plurality of processing elements based on one or more multi-primary base values and one or more quantized sharpener values, wherein the device comprises a partitioner for partitioning the pixel array into groups of pixels, and wherein a respective pixel drive for a respective multi-primary color for each pixel for each group of pixels of the pixel array is determined based on a common multi-primary base value, and wherein the partitioner comprises a boundary shifter for altering partitioning of the pixel array between frames and/or fields displayed on a display device.

2. The device of claim 1, wherein there are a plurality of multi-primary colors for each pixel, and wherein a pixel drive for two or more of the multi-primary colors for each pixel is determined by the one or more processing elements based on a common sharpener value.

3. The device of claim 1, wherein the pixel array is for an RGB display, and a plurality of processing elements, and wherein each of the one or more multi-primary base values is for the color red, blue or green.

4. A device comprising a reconstructor for producing a reconstructed image based on pulse widths of pulses generated by the reconstructor, wherein the pulse widths of the pulses are generated by the reconstructor based on a base image and a sharpener image, wherein the sharpener image comprises quantized sharpener values, wherein there is one quantized sharpener value for each pixel of the reconstructed image, and wherein a first edge of each pulse is controlled by a base value and a second edge of each pulse is controlled by a decoded sharpener value.

5. The device of claim 4, wherein the reconstructor comprises a spatial light modulator.

6. The device of claim 4, wherein the reconstructor comprises hardware and/or software producing a pixel control signal form of a reconstructed image.

7. The device of claim 4, wherein the reconstructor comprises a plurality of processing elements for computing a plurality of control signals for multiple pixels at or about the same time.

8. The device of claim 4, wherein the device comprises a spatial light modulator comprising a pixel array of pixels, and wherein respective pixels of the pixel array are driven by reconstructor elements based on the base image and/or sharpener image.

9. The device of claim 4, wherein the device is a computer.

10. The device of claim 4, wherein the reconstructed image and the base image are in an RGB format.

11. A method comprising the following steps:

(a) producing a reconstructed image based on pulse widths of pulses, and (b) displaying the reconstructed image on a visual display device, saving the reconstructed image to a storage medium and/or transmitting the reconstructed image to a computer, wherein the pulse widths of the pulses are based on a base image and a sharpener image, wherein the sharpener image comprises quantized sharpener values, wherein there is one quantized sharpener value for each pixel of the reconstructed image, and wherein a first edge of each pulse is controlled by a base value and a second edge of each pulse is controlled by a decoded sharpener value.

12. The method of claim 11, wherein step (b) comprises displaying the reconstructed image on a visual display device.

13. The method of claim 11, wherein step (b) comprises saving the reconstructed image to a storage medium.

14. The method of claim 11, wherein step (b) comprises transmitting the reconstructed image to a computer.

15. The method of claim 11, wherein the reconstructed image and the base image are in an RGB format.

16. A device comprising a reconstructor for producing a reconstructed image based on pulse widths of pulses generated by the reconstructor, wherein the pulse widths of the pulses are generated by the reconstructor based on a base image and a sharpener image, wherein at least one bit position of the base image is a color-locking indicator, wherein the sharpener image comprises quantized sharpener values, wherein there is one quantized sharpener value for each pixel of the reconstructed image, and wherein a first edge of each pulse is controlled by a base value and a second edge of each pulse is controlled by a decoded sharpener value.

17. The device of claim 16, wherein the reconstructed image and the base image are in an RGB format.

* * * * *